US011400503B2

(12) United States Patent
Plummer et al.

(10) Patent No.: US 11,400,503 B2
(45) Date of Patent: Aug. 2, 2022

(54) CIRCUIT FOR CONDUIT BENDER

(71) Applicant: Greenlee Tools, Inc., Rockford, IL (US)

(72) Inventors: Jeffrey J. Plummer, Rockford, IL (US); Sean A. Daugherty, Gilberts, IL (US)

(73) Assignee: GREENLEE TOOLS, INC., Rockford, IL (US)

( * ) Notice: Subject to any disclaimer, the term of this patent is extended or adjusted under 35 U.S.C. 154(b) by 180 days.

(21) Appl. No.: 16/669,826

(22) Filed: Oct. 31, 2019

(65) Prior Publication Data

US 2020/0070230 A1 Mar. 5, 2020

Related U.S. Application Data

(62) Division of application No. 15/193,841, filed on Jun. 27, 2016, now Pat. No. 10,478,881, which is a division of application No. 13/101,573, filed on May 5, 2011, now Pat. No. 9,375,773.

(60) Provisional application No. 61/409,805, filed on Nov. 3, 2010, provisional application No. 61/407,774, filed on Oct. 28, 2010, provisional application No. 61/331,559, filed on May 5, 2010.

(51) Int. Cl.

| | |
|---|---|
| ***B21D 7/12*** | (2006.01) |
| ***B21D 7/02*** | (2006.01) |
| ***B21D 7/024*** | (2006.01) |
| ***B21D 7/16*** | (2006.01) |

(52) U.S. Cl.

CPC ..... *B21D 7/12* (2013.01); *B21D 7/021* (2013.01); *B21D 7/024* (2013.01); *B21D 7/16* (2013.01)

(58) Field of Classification Search

CPC ..... B21D 7/02; B21D 7/021; B21D 7/024; B21D 7/12; B21D 7/14; B21D 7/16; G05B 2219/37403

See application file for complete search history.

(56) References Cited

U.S. PATENT DOCUMENTS 2,614,605 A 10/1952 Senna
3,141,494 A 7/1964 Flessate et al.
(Continued)

FOREIGN PATENT DOCUMENTS

JP H1-197011 8/1989

OTHER PUBLICATIONS

Instructional Manual for 854 Quad Bender, 2007 Greenlee Textron Inc., 25 pages.

(Continued)

*Primary Examiner* — Edward T Tolan
(74) *Attorney, Agent, or Firm* — Klintworth & Rozenblat IP LLP

(57) ABSTRACT

A conduit bender having a unitary frame is mounted to a wheeled base which provides for transportation of the bender. A braking assembly provides for simplified locking of the wheels to secure the bender in a location. The bender is mounted to the base through a pivoting assembly which allows for bending of conduit in either a horizontal or vertical plane. A circuit is provided for controlling the bending operation. An auto-sensing portion of the circuit receives information regarding the characteristics of the conduit to be bent upon placement of the conduit in the bender. A feedback portion of the circuit is used to provide a precise bending operation.

8 Claims, 45 Drawing Sheets

(56) References Cited

U.S. PATENT DOCUMENTS

| | | | | |
|---|---|---|---|---|
| 3,417,590 | A | 12/1968 | Ensley | |
| 3,949,584 | A | 4/1976 | Pearson et al. | |
| D242,948 | S | 1/1977 | Grimaldo et al. | |
| 4,141,071 | A | 2/1979 | Yerkes et al. | |
| 4,485,664 | A | 12/1984 | Richards | |
| 4,546,632 | A | 10/1985 | Van Den Kieboom et al. | |
| 4,568,864 | A | 2/1986 | Gisske | |
| 4,590,779 | A | 5/1986 | Stange et al. | |
| D284,668 | S | 7/1986 | Salley et al. | |
| 4,719,577 | A | 1/1988 | Eley | |
| D304,590 | S | 11/1989 | Adleman et al. | |
| 4,926,672 | A | 5/1990 | Swanson | |
| 4,998,871 | A | 3/1991 | Ledoux | |
| 5,007,264 | A | 4/1991 | Haack | |
| 5,009,097 | A | 4/1991 | Del Fabro et al. | |
| 5,044,190 | A | 9/1991 | Hoff et al. | |
| 5,226,305 | A | 7/1993 | Adleman et al. | |
| D345,742 | S | 4/1994 | Adleman et al. | |
| 5,305,223 | A | 4/1994 | Saegusa | |
| 5,315,522 | A | 5/1994 | Kauffman et al. | |
| 5,390,522 | A | 2/1995 | Dircks | |
| 5,499,521 | A | 3/1996 | Luikart et al. | |
| 5,689,988 | A | 11/1997 | Schwarze | |
| 6,026,668 | A | 2/2000 | Oda et al. | |
| 6,079,246 | A * | 6/2000 | Caporusso | B21D 7/08 72/173 |
| 6,373,207 | B1 | 4/2002 | Yablonovitch | |
| 6,457,344 | B2 | 10/2002 | Godin | |
| 6,531,839 | B1 | 3/2003 | Shin et al. | |
| 6,980,880 | B1 | 12/2005 | Ramsey | |
| 7,549,310 | B2 | 6/2009 | Donnelly | |
| 7,900,495 | B2 | 3/2011 | Latoria | |
| 8,400,096 | B2 | 3/2013 | Miyashita et al. | |
| 8,646,300 | B2 * | 2/2014 | Caporusso | B21D 7/08 72/173 |
| 2006/0248937 | A1 | 11/2006 | Lovsin et al. | |
| 2009/0188291 | A1 | 7/2009 | Itrich et al. | |
| 2014/0144201 | A1 | 5/2014 | Elder | |
| 2017/0095850 | A1 | 4/2017 | McNurlin et al. | |

OTHER PUBLICATIONS

One (1) sheet of drawings depicting Greenlee's Model No. 855 Bender; Dated Apr. 15, 1996.

One (1) sheet of drawings depicting Greenlee's Model No. 855 Bender; Dated Feb. 6, 2002.

Four (4) sheets of drawings depicting Greenlee's Model No. 555 Bender; Dated Jan. 14, 2000.

Two (2) sheets of drawings depicting Greenlee's Model No. 555 frame weldment; Dated May 24, 1993.

Instruction Manual for 855 Smart Bender and 01711 Optional Deluxe Pendant; Copyright 2001 Greenlee Textron Inc.; Sixty-two (62) pages.

Service Bulletin for 5004615.2 Replacement Frame; Copyright 1997 Greenlee Textron Inc.; Four (4) pages.

Pages 114-118 from Greenlee Textron's Full Line Product Catalog; Copyright 2008; Five (5) pages.

32000 Cyclone Elec-Power Conduit Bender, 115V/15A, 1/2" to 2" Rigid, EMT, IMC, PVC Coated Rigid, Includes Cover, 1/Unit, Gardner-Bender, ECM Industries, LLC, Menomonee Falls, WI, https://www.gardnerbender.eom/en/p/B2000/B2000-Cyclone-Elec-Power-Conduit-Bender, 2018, 2 pages.

* cited by examiner

CIRCUIT FOR CONDUIT BENDER

This application is a divisional patent application of U.S. patent application Ser. No. 15/193,841, filed on Jun. 27, 2016, which is a divisional patent application of U.S. patent application Ser. No. 13/101,573, now U.S. Pat. No. 9,375,773, issued on Jun. 28, 2016, and claims the benefit of U.S. provisional patent application Ser. No. 61/331,559 filed May 5, 2010, U.S. provisional patent application Ser. No. 61/407,774 filed Oct. 28, 2010, and U.S. provisional patent application Ser. No. 61/409,805 filed Nov. 3, 2010 the disclosures of which are hereby incorporated by reference in their entirety.

FIELD OF THE DISCLOSURE

This invention is generally directed to a conduit bender which provides for accurate bending of a variety of sizes and types of conduit.

BACKGROUND OF THE DISCLOSURE

A variety of conduit benders for bending different types and sizes of conduits have been utilized for many years. Many of these conduit benders include a generally-circular shaped shoe and a roller assembly. The circumference of the shoe often includes a plurality of channels of different sizes to receive conduits having various diameters. A gripping member is provided at a leading end of the channel and grips a portion of the conduit. As the shoe is rotated, the roller assembly provides a resistive force as the conduit is bent around the shoe to desired degree.

In order for the operator to bend the conduit to a desired angle, the operator must know the type of conduit to be bent (e.g. EMT, IMC or Rigid), the size of conduit to be bent (e.g. 1", 1¼", 1½", or 2" diameter), the bend starting point, the bend ending point, the elasticity of the conduit to be bent, and the wall thickness. Utilizing the above criteria, the operator determines the necessary bending operation to achieve the desired bend in the conduit. For example, the operator must determine how far the shoe should be rotated. At times, the conduit must initially be bent past the desired bend angle to account for spring back of the conduit. In addition, at times, additional support rollers will be needed to provide a greater resistive force for bending the conduit. To assist in making the proper bend operation, look-up tables are utilized. These look-up tables allow the operator to make a determination regarding the specifics of the bend operation based on the properties of the conduit to be bent. Proper selection and use of the look-up tables are critical in order to obtain the proper bend instructions. Other conduit benders include a microprocessor and allow the operator to input characteristics about the conduit to be bent along with the desired bend information. The information is typically input using a number of switches and/or dials. The microprocessor is configured to determine the necessary bend operation which will achieve the desired bend. With these conduit benders it is important that the operator correctly inputs the information.

The process of using look-up tables and setting dials and/or switches prior to bending requires time consuming steps and are subject to operator error. Often one or more parameters is overlooked or set incorrectly, resulting in bending mistakes and thus wasting materials and time.

It is sometimes preferable to bend conduit in a vertical plane and at other times preferable to bend conduit in a horizontal plane (i.e. a table top configuration). In order to provide versatility, conduit benders include a frame supporting the shoe assembly which is pivotally connected to a base. This pivotal connection allows the frame to be rotated relative to the base to provide for bending of the conduit in either a horizontal or vertical plane. The pivot axis is positioned perpendicular to the shoe shaft, and is further positioned away from the shoe in order to provide a clear path to feed and bend the conduit. With the pivot axis perpendicular to the shoe shaft, the operator rotates the frame 90 degrees about the pivot axis to alternate between the horizontal and vertical bending positions. Benders provide two shoes in order to accommodate various types and sizes of conduits to be bent. With two shoes mounted to the frame, the pivot axis is positioned between the shoes at or very near the center of gravity to minimize the effort required by the user to pivot the shoe between the vertical and horizontal positions.

Often benders are provided on a wheeled base which allows for easy movement of the bender assembly between bending locations. The wheeled base typically includes casters having wheels which can be pivoted relative to the bender frame. In order to prevent the bender assembly from rolling during the bending operation, brakes are provided on each casters to prevent the wheel of the caster from rotating. Actuation of these brakes must be performed at each caster. In addition, upon actuation of the brakes, the casters often still pivot (at least slightly) unless a swivel lock is also provided. A disadvantage of swivel locks is that clearance must be provided for the swivel locks and each swivel lock must be individually engaged.

The present invention overcomes problems presented in the prior art and provides additional advantages over the prior art. Such advantages will become clear upon a reading of the attached specification in combination with a study of the drawings.

SUMMARY

Briefly, the present invention discloses a conduit bender having a unitary frame. The bender is mounted to a wheeled base which provides for transportation of the bender between locations. A braking assembly provides for simplified locking of the wheels to secure the bender in a location. The bender is mounted to the base through a pivoting assembly which allows for bending of conduit in either a horizontal or vertical plane. The bender includes a circuit for controlling the bending operation. The circuit includes a microprocessor in communication with the motor. The microprocessor provides a motor control signal to the motor which rotates the shoe of the bender. An auto-sensing portion of circuit receives information regarding the characteristics of the conduit to be bent upon placement of the conduit in the bender. The motor control signal is based upon the conduit characteristic information. A feedback portion of the circuit receives information regarding the bending process. The feedback information is used to adjust the motor control signal to provide a precise bending operation.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
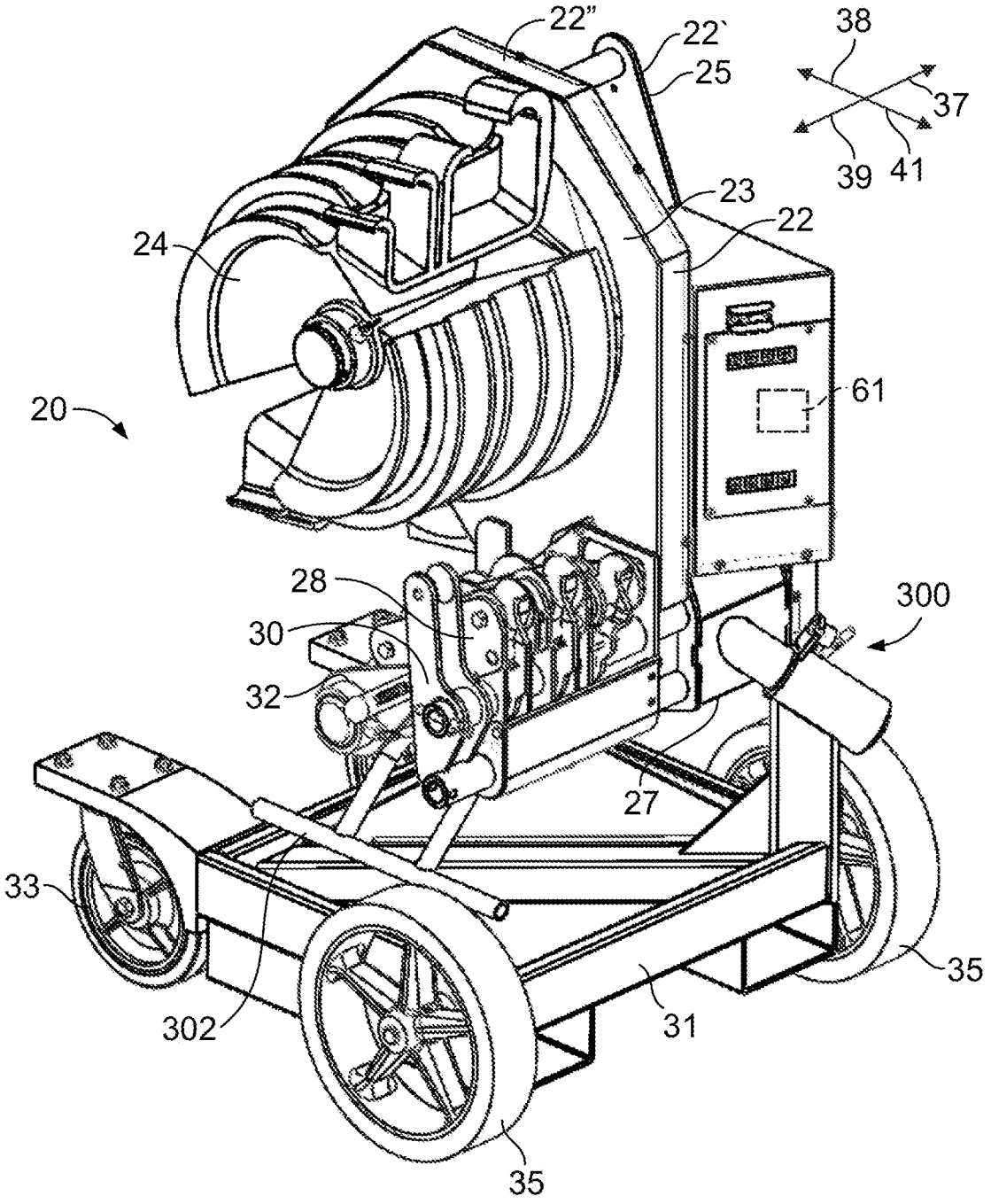
FIG. 1 is a perspective view of a conduit bender which incorporates the features of the present invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

A first embodiment of the invention is illustrated in FIGS. 1-22; a second embodiment of the invention is illustrated in FIGS. 23-26 and 29-33; alternative pivot mechanisms are illustrated in FIGS. 27 and 28; and the circuit for the invention is illustrated in FIGS. 34-39.

Figure 2:
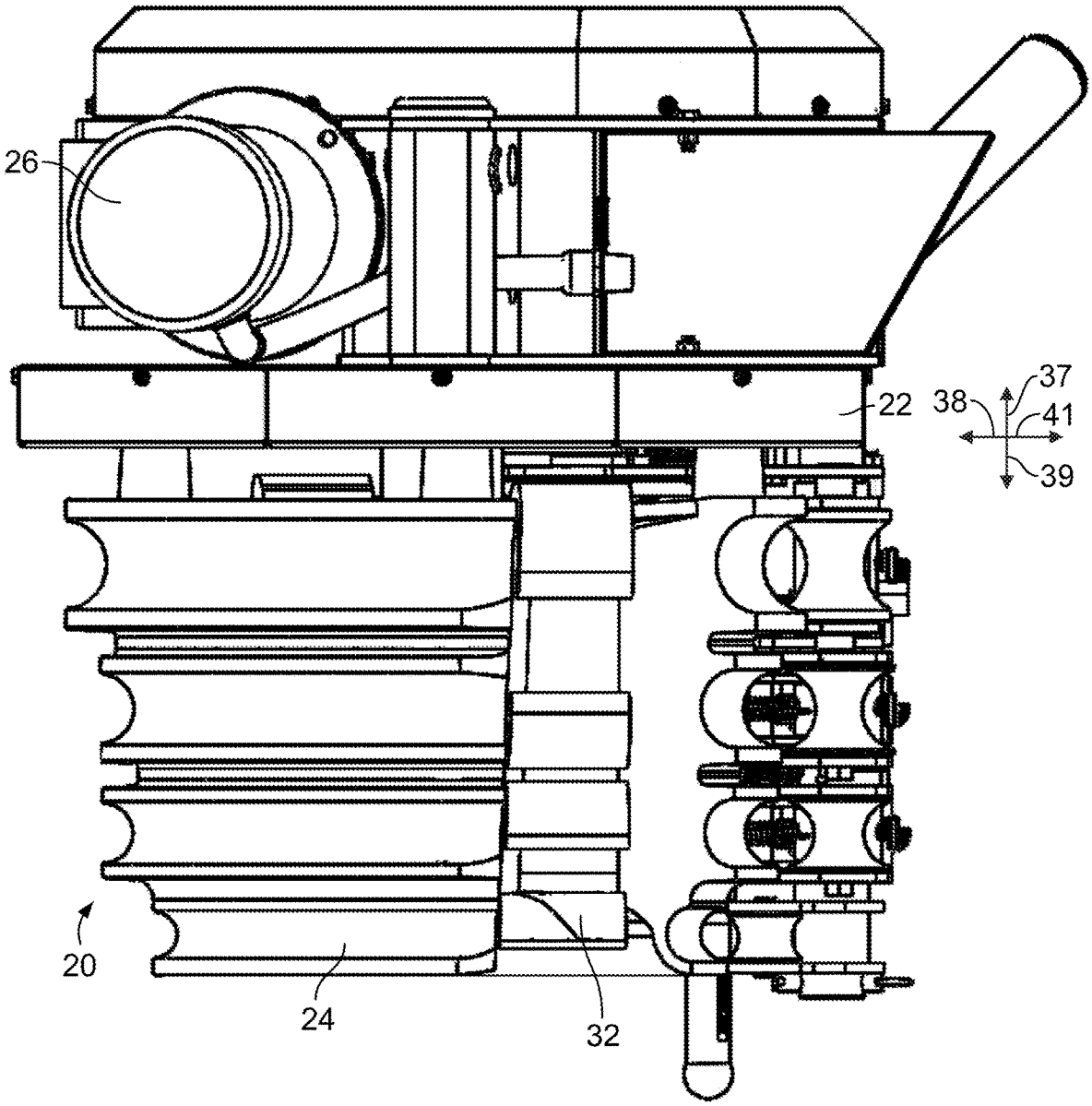
FIG. 2 is a top plan view of the conduit bender.

As best shown in FIGS. 1 and 2, a conduit bender 20 generally includes a frame 22, a shoe 24 rotatably mounted to the frame 22, a motor 26 for providing rotational force to the shoe 24, a main roller assembly 28, an auxiliary roller assembly 30, a roller positioning assembly 32 and a microprocessor 61. The shoe 24, the main roller assembly 28, the auxiliary roller assembly 30 and the roller positioning assembly 32 are cantilevered on the frame 22 as described herein. The microprocessor 61 is provided within the frame 22 and is configured to control a motor which rotates the shoe 24 to perform the bending operation as will be described herein.

As shown, the conduit bender 20 is mounted to a base 31 which includes a pair of lead wheels 33 (one of which is shown in FIG. 1) and a pair of rear wheels 35 which are used to transport the conduit bender 20 from one location to the next. Of course, the conduit bender 20 is not required to be mounted to the movable base 31. A braking assembly used to prevent rotation of the rear wheels 35 is described in connection with the second embodiment of the conduit bender 400. It is to be understood that this braking mechanism can be utilized in connection with the base 31 as well.

As will be described herein, the conduit bender 20 is pivotally mounted to the base 31 and therefore can be pivoted between a vertical position as shown in FIG. 1 (i.e. a position in which the conduit is bent in a vertical plane) and a horizontal position (i.e. a position in which the conduit is bent in a horizontal plane, "a table-top" configuration). Thus, in describing the conduit bender 20, the terms "up" or "upper" and "down" or "lower" will be used with reference to the orientation of the conduit bender 20 shown in FIG. 1. The term "inner" will generally be used to refer to the direction shown by the arrow 37, and the term "outer" will be used to refer to the direction shown by the arrow 39. The term "lead" will generally refer to the direction the conduit is advanced by the conduit bender 20 as shown by the arrow 38, and the term "rear" will generally refer to the direction from which the conduit is taken as shown by the arrow 41. It is to be understood however, that these references and directions are provided in order to more easily describe the invention and are not intended to limit the invention.

Figure 3:
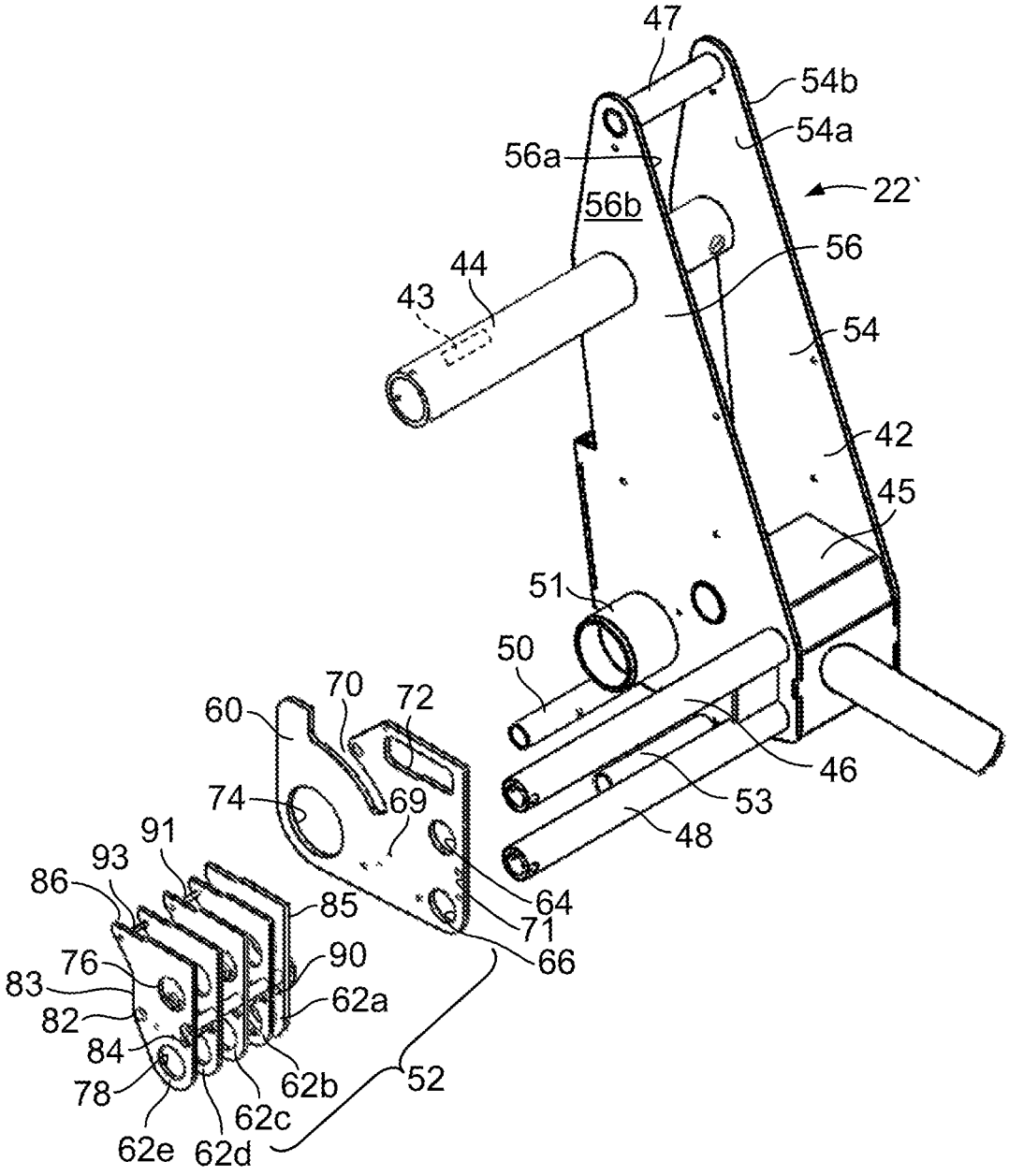
FIG. 3 is an exploded perspective view of a portion of a frame and support assembly of the conduit bender.

The frame 22 is formed of a first portion 22' shown in FIGS. 1 and 3 and a second portion 22" shown in FIG. 1. As shown in FIG. 3, the first portion 22' of the frame 22 is provided by a single weldment and includes a base 42, a shoe shaft 44, an upper support shaft 46, a lower support shaft 48, a lead support shaft 50, a roller assembly positioning shaft 51, a rear support shaft 53, and a support member assembly 52. The shafts 44, 46, 48, 50, 51, 53 are attached to the frame 22 in a cantilevered manner, such that an end of each shaft 44, 46, 48, 50, 51, 53 is secured to the frame 22 and the opposite end of each shaft 44, 46, 48, 50, 51, 53 is free. The support shafts 46, 48, 50, 53 support the main roller assembly 28 and provide a resistive force for bending the conduit. The second portion 22" forms a generally enclosed box having apertures which align with the shoe shaft 44 to allow the shoe shaft 44 to pass therethrough. The shafts 46, 48, 50, 51, 53 extend below the second portion 22" of the frame 22. Frame face 23 is provided by the second portion 22". An inner end of the shoe 24 is positioned proximate the frame face 23. The frame face 23 extends in a plane perpendicular to the shoe shaft 44. Frame back 25 is provided opposite the frame face 23 and a frame bottom 27 generally extends from the frame face 23 to the frame back 25.

The frame base 42 includes first and second generally triangularly-shaped plates 54, 56 spaced from one another by a lower spacer 45 and an upper spacer/hoist bar 47. Each plate 54, 56 includes a first surface 54*a*, 56*a* and an opposite second surface 54*b*, 56*b*. The first surfaces 54*a*, 56*a* of the first and second plates 54, 56 face each other. The plates 54, 56 include aligned shoe shaft apertures through which the shoe shaft 44 extends, aligned upper support shaft apertures through which the upper support shaft 46 extends, aligned lower support shaft apertures through which the lower support shaft 48 extends, aligned lead support shaft apertures through which the lead support shaft 50 extends, and aligned rear support shaft apertures through which the rear support shaft 53 extends. The shoe shaft 44, the upper support shaft 46, the lower support shaft 48, the lead support shaft 50, the roller assembly positioning shaft 51, and the rear support shaft 53 extend beyond the second surface 56*b* of the second plate 56.

Figure 4:
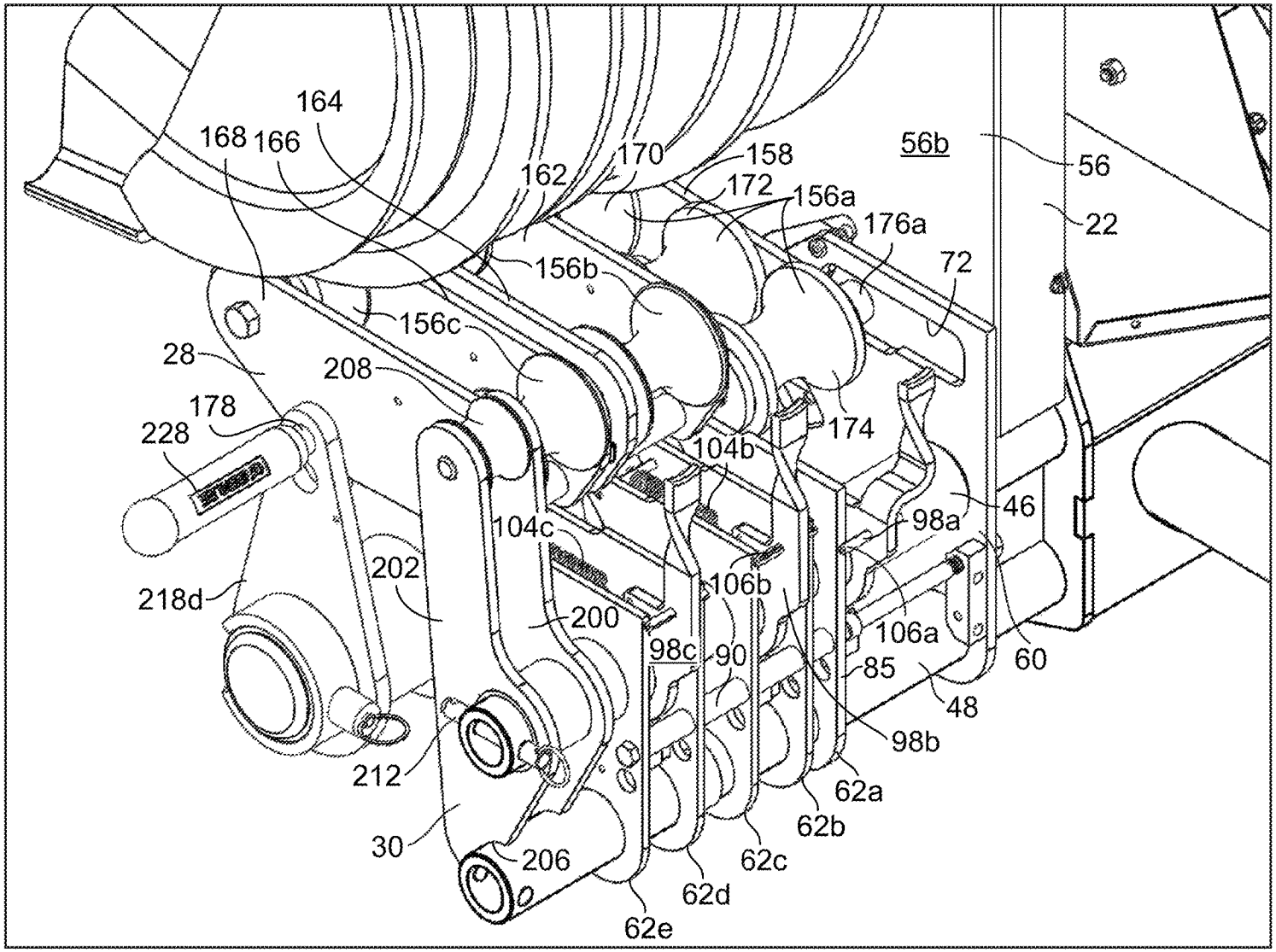
FIG. 4 is a perspective view of a portion of the conduit bender with the roller assembly in an up position.
Figure 5:
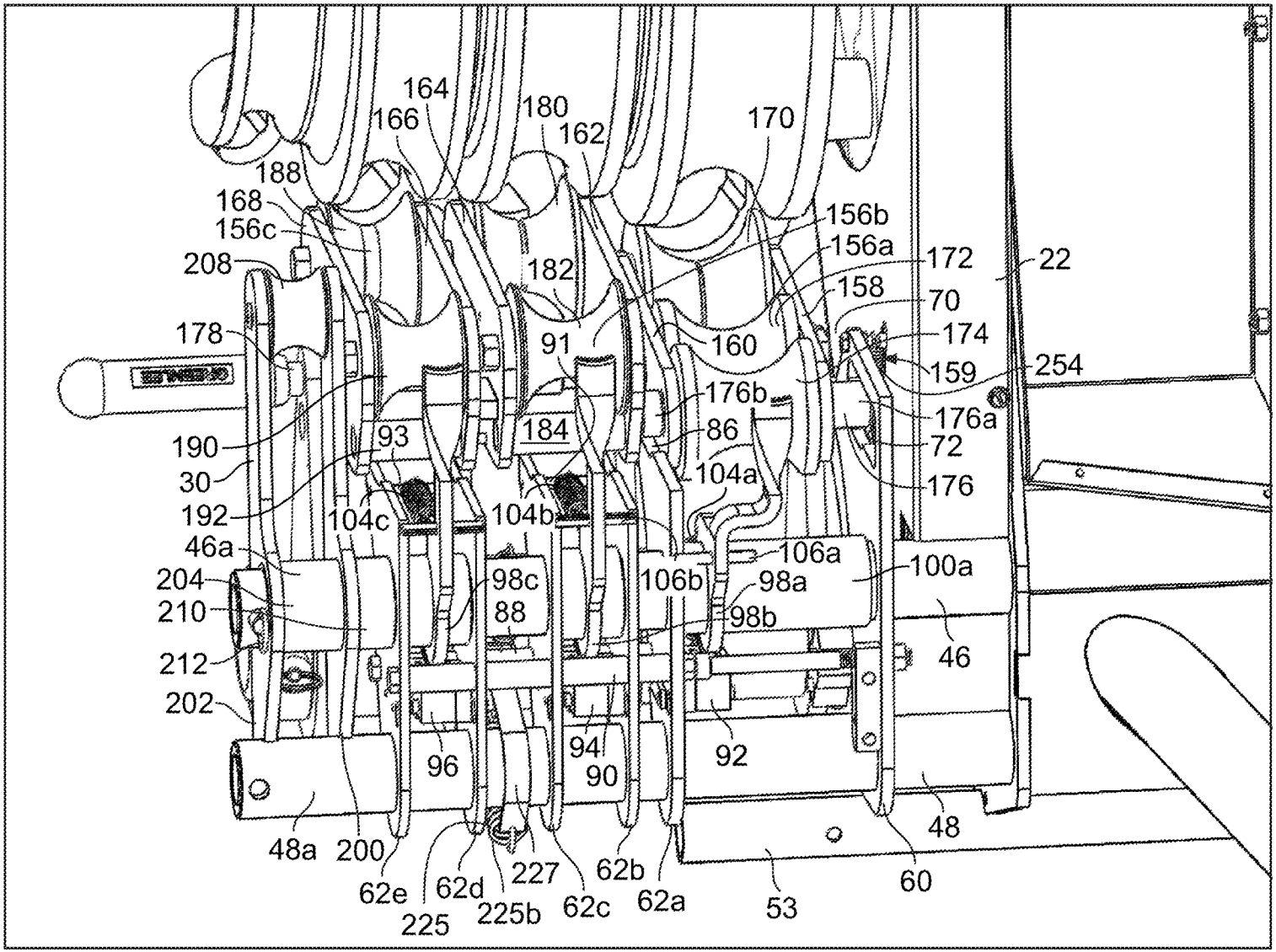
FIG. 5 is a rear perspective view of a portion of the conduit bender with the roller assembly in the up position.

As best shown in FIGS. 3-5, the support member assembly 52 is mounted on the frame 22 by the upper support shaft 46, the lower support shaft 48, and the roller assembly positioning shaft 51. The support member assembly 52 includes a guide wall 60 and a plurality of support members 62*a*-62*e* which are spaced apart from each other along the upper and lower support shafts 46, 48.

The guide wall 60 is formed of a plate which is generally rectangularly shaped having a front, rear, top and bottom edges. The guide wall 60 includes an upper support shaft aperture 64, a lower support shaft aperture 66, a lead guide path 70, a rear guide path 72, and a roller assembly positioning shaft aperture 74 which are spaced apart from each other. The upper support shaft aperture 64 and the lower support shaft aperture 66 are vertically aligned with each other and are proximate to the rear edge of the guide wall 60. The rear guide path 72 is spaced upwardly from the upper support shaft aperture 64 and extends horizontally from proximate the rear edge toward the front edge. The lead guide path 70 extends from the top edge of the guide wall 60 proximate to the front edge of the guide wall 60, and extends downwardly and rearwardly. The lead guide path 70 is curved. The roller assembly positioning shaft aperture 74 is positioned proximate to the corner provided by the front edge and the bottom edge. The upper support shaft aperture 64 receives the upper support shaft 46 therethrough; the lower support shaft aperture 66 receives the lower support shaft 48 therethrough; and the roller assembly positioning shaft aperture 74 receives the roller assembly positioning shaft 51. The guide wall 60 is positioned proximate the second surface 56*b* of the second plate 56 of the frame 22. The lead and rear guide paths 70, 72 assist in positioning the main roller assembly 28 in either the up or down position as will be described herein. The guide wall 60 further includes a lead mounting bar aperture 69 and a rear mounting bar aperture 71 which are spaced apart from each other and from the other apertures/paths 64, 66, 70, 72, 74. The lead mounting bar aperture 69 is positioned between the roller assembly positioning shaft aperture 74 and the vertically aligned upper and lower support shaft apertures 64, 66. The rear mounting bar aperture 71 is positioned proximate the rear edge and between the vertically aligned upper and lower support shaft apertures 64, 66.

The first support member 62*a*, second support member 62*b*, third support member 62*c*, fourth support member 62*d* and fifth support member 62*e* are each similarly shaped. Each support member 62*a*-62*e* is a plate generally shaped as a right triangle having an upper guide surface 86, a lead surface 83 and a rear surface 85. Each support member 62*a*-62*e* includes an upper support shaft aperture 76, a lower support shaft aperture 78, a lead lever switch mounting bar aperture 82, and a rear lever switch mounting bar aperture 84. As best shown in FIGS. 4 and 5, the upper support shaft 46 of the frame 22 extends through the upper support shaft apertures 76 of the support members 62*a*-62*e*; the lower support shaft 48 of the frame extends through the lower support shaft apertures 78 of the support members 62*a*-62*e*; a lead mounting bar 88 extends through the lead mounting bar apertures 82 of the support members 62*a*-62*e*; and a rear mounting bar 90 extends through the rear mounting bar apertures 84 of the support members 62*a*-62*e*. As best shown in FIG. 5, an outermost portion 46*a* of the upper support shaft 46 and an outermost portion 48*a* of the lower support shaft 48 extend outwardly of the fifth support member 62*e*.

The first support member 62*a* is spaced outwardly from the guide wall 60 to accommodate rollers of the main roller assembly 28 as will be described herein. The second support member 62*b* is spaced from the first support member 62*a* and the third support member 62*c* is spaced from the second support member 62*b* to accommodate rollers of the main roller assembly 28 as will be described herein. The fourth support member 62*d* is spaced from the third support member 62*c* and the fifth support member 62*e* is spaced from the fourth support member 62*d* to accommodate rollers of the roller assembly 28 as will be described herein.

The lead mounting bar 88 extends through the lead mounting bar apertures 82 of the first, second, third, fourth and fifth support members 62*a*-62*e* and through the lead mounting bar aperture 69 of the guide wall 60. The lead mounting bar 88 is fixed at its ends to the guide wall 60 and to the fifth support member 62*e*. The rear mounting bar 90 extends through the rear mounting bar apertures 84 of the first, second, third, fourth, and fifth support members 62*a*-62*e* and through the rear mounting bar aperture 71 of the guide wall 60. The rear mounting bar 90 is fixed at its ends to the guide wall 60 and to the fifth support member 62*e*.

As best shown in FIG. 5, a first lever switch 92 is mounted to the lead and rear mounting bars 88, 90 and is positioned between the guide wall 60 and the first support member 62*a*. A second lever switch 94 is mounted to the lead and rear mounting bars 88, 90 and is positioned between the second and third support members 62*b*, 62*c*. A third lever switch 96 is mounted to the lead and rear mounting bars 88, 90 and is positioned between the fourth and fifth support members 62*d*, 62*e*. Each of the lever switches 92, 94, 96 is in electrical communication with the microprocessor 61 as will be described herein. An inner spring mount 91 is positioned between the second and third support member 62*b*, 62*c* proximate the upper leading ends thereof. An outer spring mount 93 is positioned between fourth and fifth support members 62*d*, 62*e* proximate the upper leading ends thereof.

A plurality of lever assemblies 98*a*, 98*b*, 98*c* are mounted on the upper support shaft 46 of the frame 22.

Figure 6:
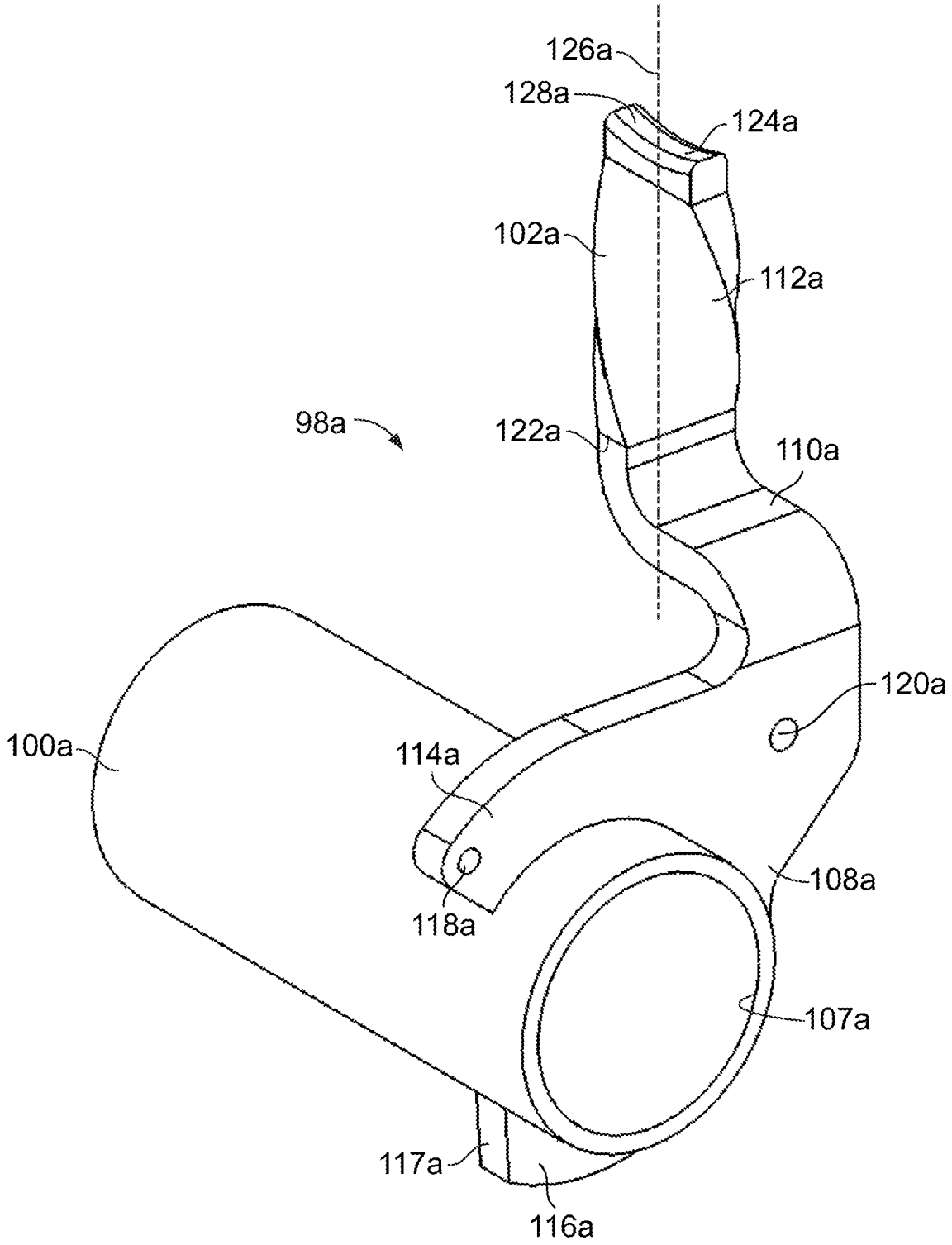
FIG. 6 is a perspective view of a portion of a lever assembly.

The first lever assembly 98*a* includes a lever tube 100*a* and a lever 102*a* fixed thereto as best shown in FIG. 6, and a stop bar 106*a*, as shown in FIG. 5. The lever tube 100*a* is cylindrically-shaped and defines an upper shaft passageway 107*a*. The lever 102*a* includes a lower gripping portion 108*a*, an intermediate elbow portion 110*a*, and an upper arm portion 112*a*. The lower gripping portion 108*a* includes first extension 114*a* and second extension 116*a* which extends around a portion of the outer surface of the lever tube 100*a*. The second extension 116*a* terminates in an end surface 117*a*. An aperture 118*a* is provided proximate a leading end of the first extension 114*a* and a stop bar aperture 120 is provided proximate the rear end of the first extension 114*a*. The elbow portion 110*a* extends between the lower gripping portion 108*a* and the upper arm portion 112*a* and is generally S-shaped. The arm portion 112*a* of the lever assembly 98*a* extends upwardly from the elbow portion 110*a* and includes a lower end 122*a* and an upper end 124*a*. The arm portion 112*a* defines an axis 126*a* about which the upper arm portion 112*a* is twisted. The arm portion 112*a* is twisted so as to provide a ninety-degree rotation of the upper end 124*a* of the arm portion 112*a* relative to the lower end 122*a* of the arm portion 112*a*. An arc-shaped end surface 128*a* is provided at the upper end 124*a* of the arm portion 112*a*. Alternatively, a roller (not shown) may be provided instead of the upper twisted arm portion 112*a*. A first lever spring 104*a* has an end attached to the first extension 114*a* through the aperture 118*a*, is wrapped around a portion of the lever tube 100*a*, and an opposite end attached to the lead mounting bar 88. The first lever spring 104*a* provides a rotational force to the lever tube 100*a* and lever 102*a* to urge the lever 102*a* to an upright position.

The first lever tube 100*a* is positioned on the upper support shaft 46 of the frame 22 between the guide wall 60 and the first support member 62*a*. The first lever tube 100*a* and lever 102*a* rotate about the upper support shaft 46. As shown in FIGS. 4 and 5, the first stop bar 106*a* is positioned through the stop bar aperture 120*a*. The first stop bar 106*a* abuts the rear surface 85 of the first support member 62*a* to prevent the first lever 102*a* from rotating beyond the upright position as shown in FIGS. 4 and 5.

Figure 7:
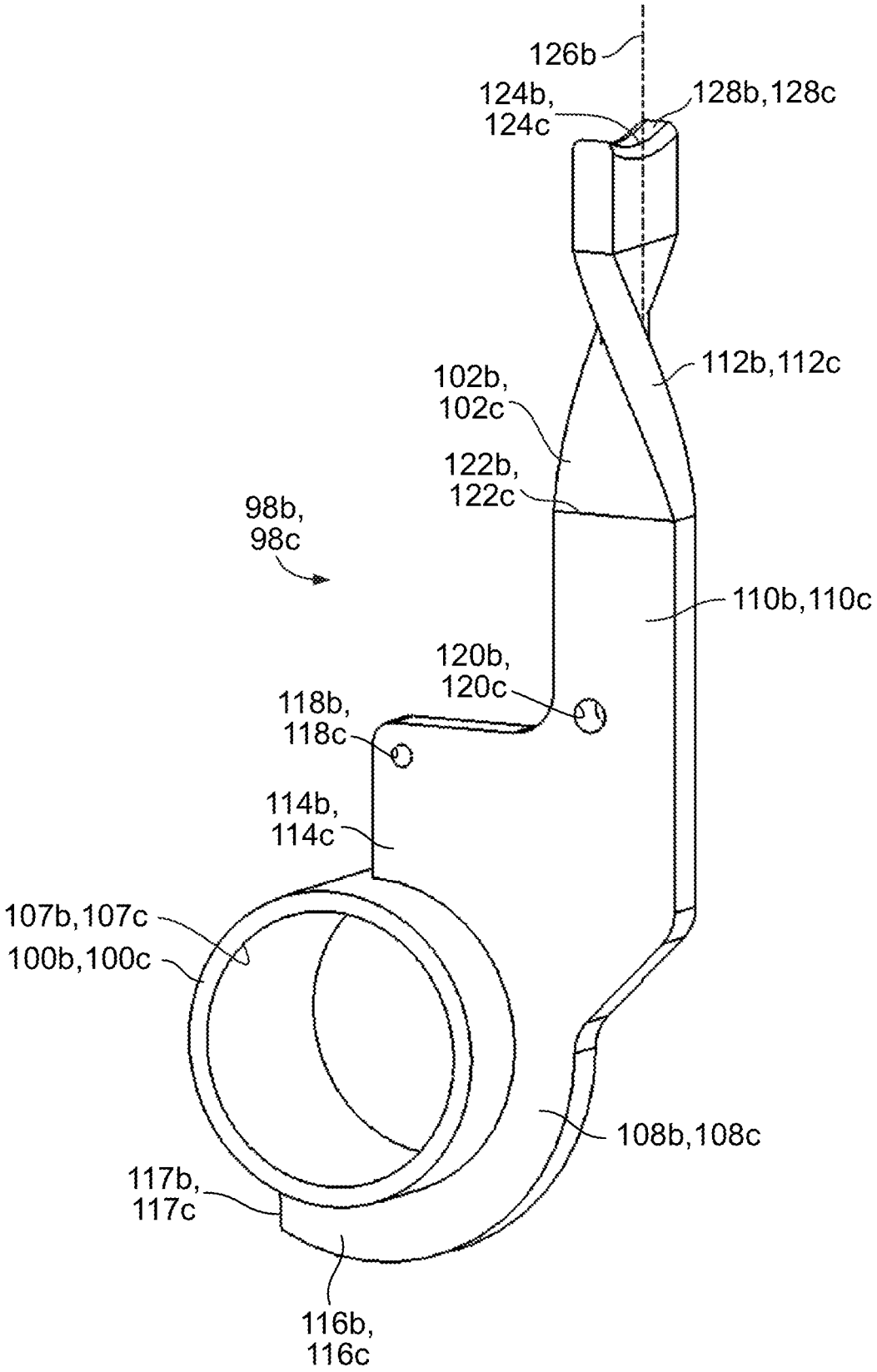
FIG. 7 is a perspective view of a portion of a lever assembly.

The second lever assembly 98*b* is positioned on the upper support shaft 46 of the frame 22 and between the second and third support members 62*b*, 62*c*. As best shown in FIG. 7, the second lever assembly 98*b* includes a lever tube 100*b* (which is shorter than the lever tube 100*a*) and a lever 102*b* fixed to the lever tube 100*b*. As shown in FIG. 5, the second lever assembly 98*b* also includes a lever spring 104*b* and a stop bar 106*b*. The lever tube 100*b* is cylindrically-shaped and defines an upper shaft passageway 107*b*. The lever 102*b* includes a lower gripping portion 108*b*, an intermediate elbow portion 110*b*, and an upper arm 112*b*. The lower gripping portion 108*b* includes first extension 114*b* and second extension 116*b* which extends around a portion of the outer surface of the lever tube 100*b*. The second extension 116*b* terminates at an end surface 117*b*. A spring aperture 118*b* is provided proximate a leading end of the first extension 114*b*. The elbow portion 110*b* extends upwardly from the lower portion 108*b* to the upper arm 112*b* and is generally planar. A stop bar aperture 120*b* is provided proximate the lower end of the elbow portion 110*b*. The arm 112*b* of the lever 98*b* extends upwardly from the elbow portion 110*b* and includes a lower end 122*b* and an upper end 124*b*. The arm 112*b* defines an axis 126*b* about which the upper arm 112*b* is twisted. The arm 112*b* is twisted so as to provide a ninety-degree rotation of the upper end 124*b* of the arm 112*b* relative to the lower end 122*b* of the arm 112*b*. An arc-shaped end surface 128*b* is provided at the upper end 124*b* of the arm 112*b*. Alternatively, a roller (not shown) may be provided instead of the upper twisted arm 112*b*.

The second lever tube 100*b* is positioned on the upper support shaft 46 of the frame 22 and between the second support member 62*b* and the third support member 62*c*. The second lever tube 100*b* and lever 102*b* rotate about the upper support shaft 46. A rear end of the second lever spring 104*b* is attached to the second lever 102*b* through the spring aperture 118*b* and a leading end of the first lever spring 104*b* is attached to the inner spring mount 91 of the support member assembly 52. The second lever spring 104*b* provides a rotational force to the lever tube 100*b* and lever 102*b* to urge the lever 102*b* to an upright position. The second stop bar 106*b* is positioned through the stop bar aperture 120*b* and abuts the rear surfaces 85 of the second and third support member 62*b*, 62*c* to prevent the second lever 102*b* from rotating beyond the upright position as shown in FIGS. 4 and 5.

The third lever assembly 98*c* includes a lever tube 100*c* and a lever 102*c* fixed thereto, a lever spring 104*c* and a stop bar 106*c*. The structure of the third lever 102*c* and the lever tube 100*c* of the third lever assembly 98*c* are identical to the lever 102*b* and lever tube 100*b* of the second lever assembly 98*b* as shown in FIG. 7 and therefore, the specifics are not repeated herein. Elements of the lever tube 100*c* and lever 102*c* are designated in FIG. 7 with the suffix "c". A roller (not shown) may be provided instead of the upper twisted arm portion 112*c*. The lever tube 100*c* is positioned on the upper support shaft 46 of the frame 22 between the fourth support member 62*d* and the fifth support member 62*e*. The lever tube 100*c* and the lever 102*c* rotate about the upper support shaft 46. A rear end of a third lever spring 104*c* is attached to the lever 102*c* through a spring aperture 118*c* and a leading end of the third lever spring 104*c* is attached to the outer spring mount 93 of the support member assembly 52. The third lever spring 104*c* provides a rotational force to the lever tube 100*c* and lever 102*c* of the third lever assembly 98*c* to urge the third lever 102*c* to an upright position. The third stop bar 106*c* is positioned through the stop bar aperture 120*c* and abuts rear surfaces 85 of the fourth and fifth support members 62*d*, 62*e* to prevent the third lever 102*c* from rotating beyond the upright position as shown in FIGS. 4 and 5.

Figure 8:
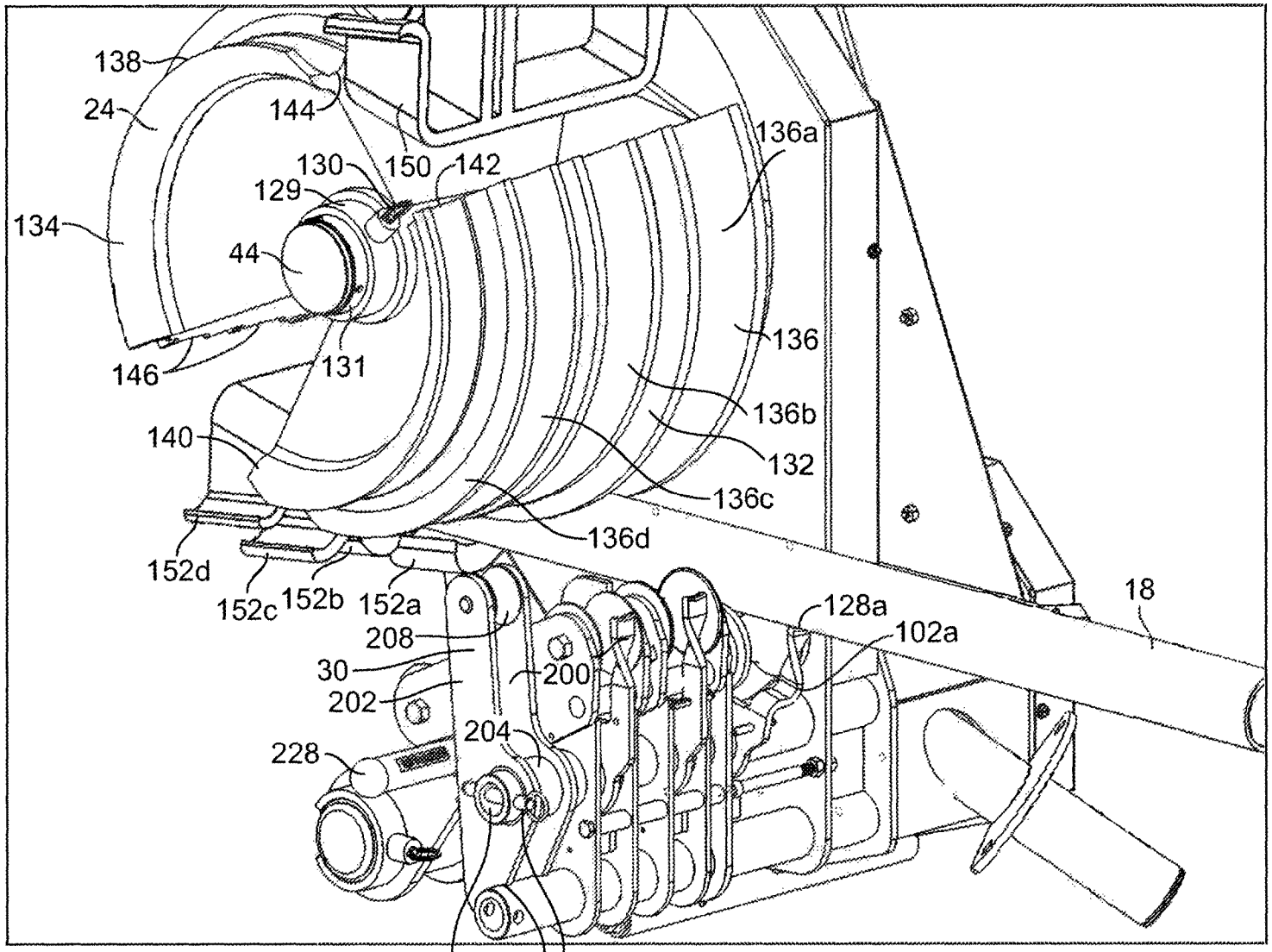
FIG. 8 is a rear perspective view of a portion of the conduit bender with the roller assembly in a down position and a conduit positioned for bending.
Figure 13:
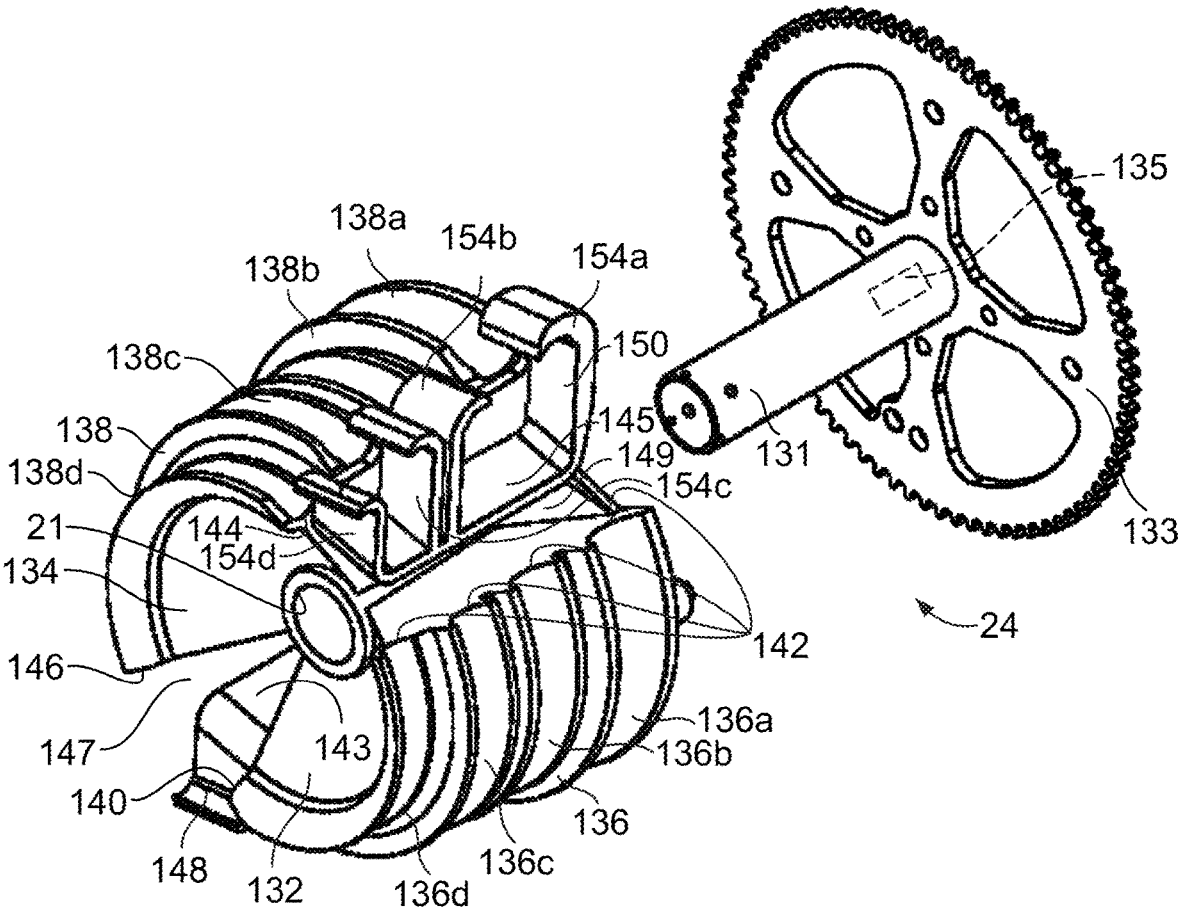
FIG. 13 is an exploded perspective view of a shoe of the conduit bender.

As best shown in FIGS. 2, 8 and 13, the shoe 24 is generally cylindrically-shaped. A central passageway 21 is provided through the axial center of the shoe 24. The generally cylindrically-shaped shoe 24 includes a first portion 132 which is used to bend rigid or IMC type conduit, and a second portion 134 which is used to bend EMT type conduit. The first portion 132 of the shoe 24 includes a set of four arc-shaped channels 136*a-d* along the outer circumference of the shoe 24. The second portion 134 of the shoe 24 includes a set of four arc-shaped channels 138*a-d* along the outer circumference of the shoe 24. Each channel 136*a-d* of the first set is aligned with a corresponding channel 138*a-d* of the second set. The channels 136*a-d* of the first set provide leading ends 140 and trailing ends 142, and the channels 138*a-d* of the second set provide leading ends 144 and trailing ends 146. The innermost channel 136*a* of the first portion 132 is proximate the frame 22, and the innermost channel 138*a* of the second portion 134 is proximate the frame 22, and are preferably configured to receive conduit having an outer diameter of two inches. The channel 136*b* of the first portion 132 proximate to the innermost channel 136*a* and the channel 138*b* of the second portion 134 proximate to the innermost channel 138*a* next closest to the frame 22 are preferably configured to receive conduit having an outer diameter of one and one-half inches. The channel 136*c* of the first portion 132 proximate to the channel 136*b* and the channel 138*c* of the second portion 134 proximate to the channel 138*b* are preferably configured to receive conduit having an outer diameter of one and one-quarter inches. The outermost channel 136*d* of the first set and the outermost channel 138*d* of the second set are preferably configured to receive conduit having an outer diameter of one inch.

A first gripping member 148, see FIG. 13, is mounted proximate the leading ends 140 of the first set of channels 136*a-d*, and a second gripping member 150 is mounted proximate the leading ends 144 of the second set of channels 138*a-d*. The leading ending 140 of each channel 136*a*-136*d* of the first set is spaced approximately forty-five degrees from the trailing end 146 of each corresponding channel 138*a*-138*d* of the second set 138 to provide a gap 147. A base 143 of the first gripping member 148 is positioned within the gap 147. The leading end 144 of each channel 138*a*-138*d* of the second set is spaced approximately forty-five degrees from the trailing end 142 of each corresponding channel 136*a*-136*d* of the first set to provide a gap 149. A base 145 of the second gripping member 150 is positioned within the gap 149.

The gripping members 148, 150 associated with the first and second portions 132, 134 of the shoe 24 are similarly-formed. The second gripping member 150 is best shown in FIGS. 1 and 13. The second gripping member 150 includes a plurality of hooks 154*a*-154*d* and the first gripping member 148 includes a plurality of hooks 152*a*-152*d*. Each hook 154*a-d* is generally associated with a channel 138*a-d*. The first hook 154*a* is generally outwardly bent. The first hook 154*a* is aligned with the first channel 138*a* and is configured to grip a conduit having an outer diameter of two inches. The second hook 154*b* is generally inwardly bent. The second hook 154*b* is aligned with the channel 138*b* and is configured to grip a conduit having an outer diameter of one and one-half inches. The third hook 154*c* is outwardly bent. The third hook 154*c* is aligned with the third channel 138*c* and is configured to grip a conduit having an outer diameter of one and one-quarter inches. The fourth hook 154*d* is generally outwardly bent. The fourth hook 154*d* is aligned with the fourth channel 138*d* and is configured to grip a conduit having an outer diameter of one inch.

Each hook 152*a-d* (see FIG. 8) of the first gripping member 148 is generally associated with a channel 136*a-d* of the first portion 132 of the shoe 24. The first hook 152*a* is generally outwardly bent. The first hook 152*a* is aligned with the first channel 136*a* and is configured to grip a conduit having an outer diameter of two inches. The second hook 152*b* is generally inwardly bent. The second hook 152*b* is aligned with the channel 136*b* and is configured to grip a conduit having an outer diameter of one and one-half inches. The third hook 152*c* is outwardly bent. The third hook 152*c* is aligned with the third channel 136*c* and is configured to grip a conduit having an outer diameter of one and one-quarter inches. The fourth hook 152*d* is generally outwardly bent. The fourth hook 152*d* is aligned with the fourth channel 136*d* and is configured to grip a conduit having an outer diameter of one inch.

As best shown in FIG. 13, a shoe sleeve 131 is fixed to a toothed gear 133. The toothed gear 133 is mounted within the second portion 22" of the frame 22 and the shoe sleeve 131 extends outwardly through an aperture in the second portion 22". The shoe shaft 44 extends through a central passageway in the gear 133 and through the shoe sleeve 131. The shoe 24 is then mounted to the shoe sleeve 131 by passing the shoe sleeve 131 through the central passageway 21 of the shoe 24. The shoe 24 is secured to the shoe sleeve 131 by a collar 129 and locking pin 130 (see FIG. 8).

The shoe sleeve 131, gear 133 and shoe 24 are mounted to the shoe shaft 44 of the frame 22 and are rotated relative to the fixed shoe shaft 44 in response to activation of the motor 26 connected to the gear 133, so as to bend a conduit mounted to the shoe 24 as will be described herein. A magnet 43 (see FIG. 3) is mounted within the shoe shaft 44. A sensor 135 (see FIG. 13) such as, for example, an absolute encoder, is mounted within the shoe sleeve 131. Using the magnetic field provided by the magnet 43, the absolute encoder 135 provides a determination as to the degree to which the shoe sleeve 131, along with the shoe 24, has been rotated relative to the shoe shaft 44. The absolute encoder 135 is in electrical communication with microprocessor 61 and provides shoe position information to the microprocessor 61. For example, if prior to beginning the bend operation the first portion 132 of the shoe 24 is positioned proximate the main roller assembly 28, the sensor 135 will provide a signal to the absolute encoder 135 that the shoe 24 is positioned for bending IMC or rigid type conduit. On the other hand, if prior to beginning the bend operation, the shoe 24 along with the shoe sleeve 131 have been rotated relative to the shoe shaft 44 such that the second portion 134 of the shoe 24 is positioned proximate the roller assembly 28, the absolute encoder 135 will provide a signal to the microprocessor 61 indicating that the shoe 24 is positioned for bending EMT type conduit. Although the combination of a magnet 43 and an absolute encoder 135 have been described to determine the position of the shoe 24 relative to the frame 22, it is to be understood that a variety of switches can be used can be used to detect the position of the shoe 24 relative to the frame 22. For example, an optical switch could be used wherein a light source provided on the shoe 24, or shoe sleeve 131 provides a signal detected by an optical sensor on the frame 22 to determine the position of the shoe 24 relative to the frame 22.

As shown in FIGS. 4 and 5, the main roller assembly 28 includes a plurality of rollers 156*a-c*. An innermost set of rollers 156*a* is provided proximate the frame 22, an intermediate set of rollers 156*b* is provided outwardly of the inner most set of rollers 156*a*, and an outermost set of rollers 156*c* is provided outwardly of the intermediate set of rollers 156*b*.

The innermost set of rollers 156*a* is supported by an inner support plate 158 and an outer support plate 160. The intermediate set of rollers 156*b* is supported by an inner support plate 162 and an outer support plate 164. The outermost set of rollers 156*c* is supported by an inner support plate 166 and an outer support plate 168. Each plate 158, 160, 162, 164, 166, 168 includes a roller positioning shaft aperture therethrough proximate the leading ends of the plates 158, 160, 162, 164, 166, 168. A lead guide rod 178 extends through the roller positioning shaft apertures aperture of each plate 158, 160, 162, 164, 166, 168.

As best shown in FIG. 5, the innermost set of rollers 156*a* includes a lead roller 170, an intermediate roller 172, and a rear roller 174. Each roller 170, 172, 174 is rotatably mounted between the inner support plate 158 and the outer support plate 160. The lead roller 170 is positioned proximate the leading ends of the inner and outer support plates 158, 160 and is mounted on a lead roller shaft; the rear roller 174 is positioned proximate rear ends of the inner and outer support plates 158, 160 and is mounted on a rear guide rod 176; and the intermediate roller 172 is positioned between the lead roller 170 and the rear roller 174 and is mounted on an intermediate roller shaft. Each roller 170, 172, 174 includes an arcuate surface which is configured to receive a conduit having a diameter of two inches.

The intermediate set of rollers 156*b* includes a lead roller 180 and a rear roller 182. Each roller 180, 182 is rotatably mounted between the inner support plate 162 and the outer support plate 164. The lead roller 180 is positioned proximate the leading ends of the inner and outer support plates 162, 164 and is mounted on a lead roller shaft; the rear roller 182 is positioned proximate rear ends of the inner and outer support plates 162, 164 and is mounted on a rear roller shaft. Each roller 180, 182 includes an arcuate surface which is configured to receive a conduit having a diameter of one and one-half inches. A rear guide rod 184 extends from the inner plate 162 to the outer plate 164 proximate the rear ends thereof and below the rear roller 190. The rear guide rod 184 rests on the upper guide surfaces 86 of second and third support members 62*b*, 62*c*.

The outermost set of rollers 156*c* includes a lead roller 188 and a rear roller 190. Each roller 188, 190 is rotatably mounted between the inner support plate 166 and the outer support plate 168. The lead roller 188 is positioned proximate the leading ends of the inner and outer support plates 166, 168 and is mounted on a lead roller shaft; the rear roller 190 is positioned proximate rear ends of the inner and outer support plates 166, 168 and is mounted on a rear roller shaft. Each roller 188, 190 includes an arcuate surface which is configured to receive a conduit having a diameter of one and one-quarter inches. A rear guide rod 192 extends from the inner plate 166 to the outer plate 168 proximate the rear ends thereof and below the rear roller 190. The rear guide rod 192 rests on the upper guide surfaces 86 of fourth and fifth support members 62*d*, 62*e*.

The auxiliary roller assembly 30 is best shown in FIGS. 4, 5 and 8. The auxiliary roller assembly 30 is provided proximate the main roller assembly 28. The auxiliary roller assembly 30 includes oblong-shaped first and second support members 200, 202 spaced by a cylindrically-shaped spacer 204 and fixed thereto. The first and second support members 200, 202 include rounded upper and lower ends. An upper shaft passageway is provided through the first and second support members 200, 202. The upper shaft 46 of the frame 22 is positioned within the upper shaft passageways of the first and second support members 200, 202 and through the spacer 204. An arc shaped abutment surface 206 is provided proximate the lower end of each support member 200, 202. An auxiliary roller 208 is mounted between the first and second members 200, 202 proximate upper ends of the first and second members 200, 202. A cylindrically-shaped supplemental spacer 210 having an upper support shaft passageway therethrough is provided between the fifth support member 62*e* of the frame 22 and the first support member 200 of the auxiliary roller assembly 30 to maintain proper positioning of the auxiliary roller assembly 30 relative to the fifth support member 62*e* and main roller assembly 28. A locking pin 212 is provided to maintain the auxiliary roller assembly 30 on the upper support shaft 46 of the frame 22.

Figure 10:
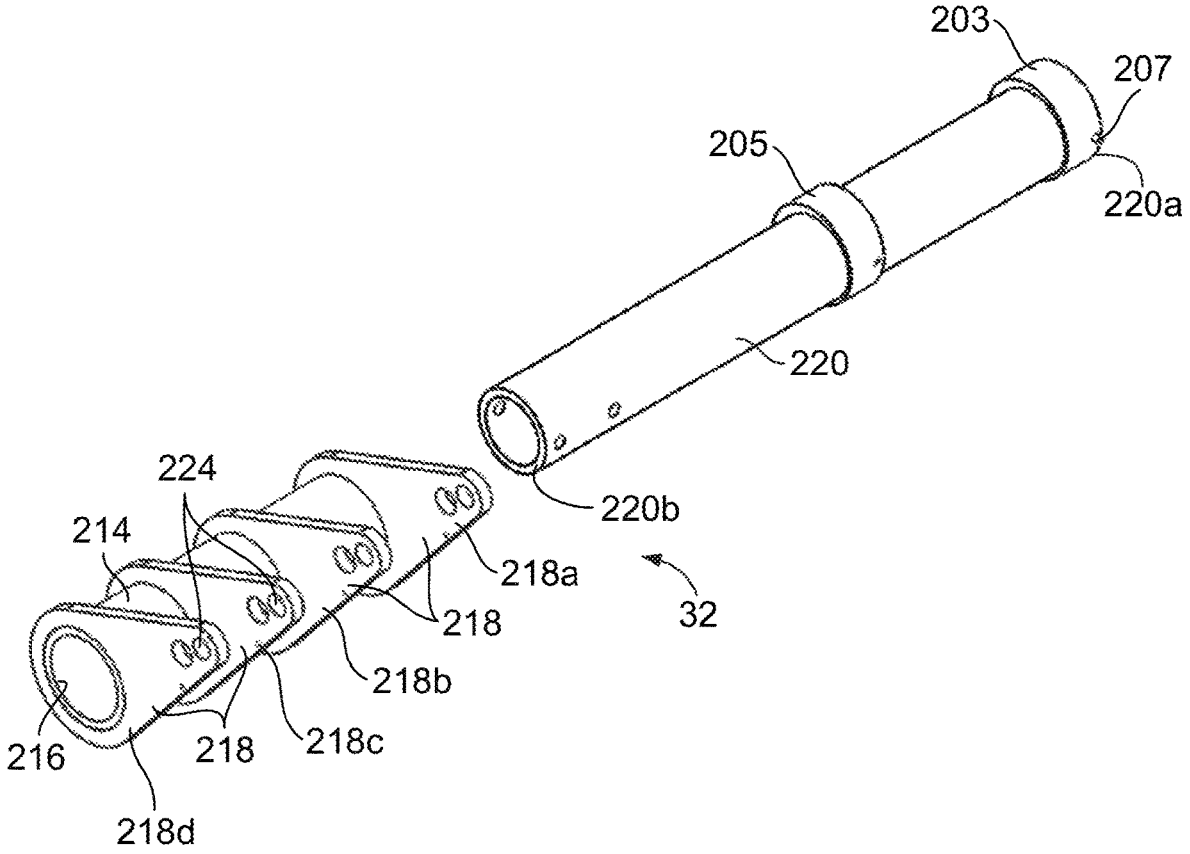
FIG. 10 is an exploded perspective view of a roller positioning member of the conduit bender.
Figure 14:
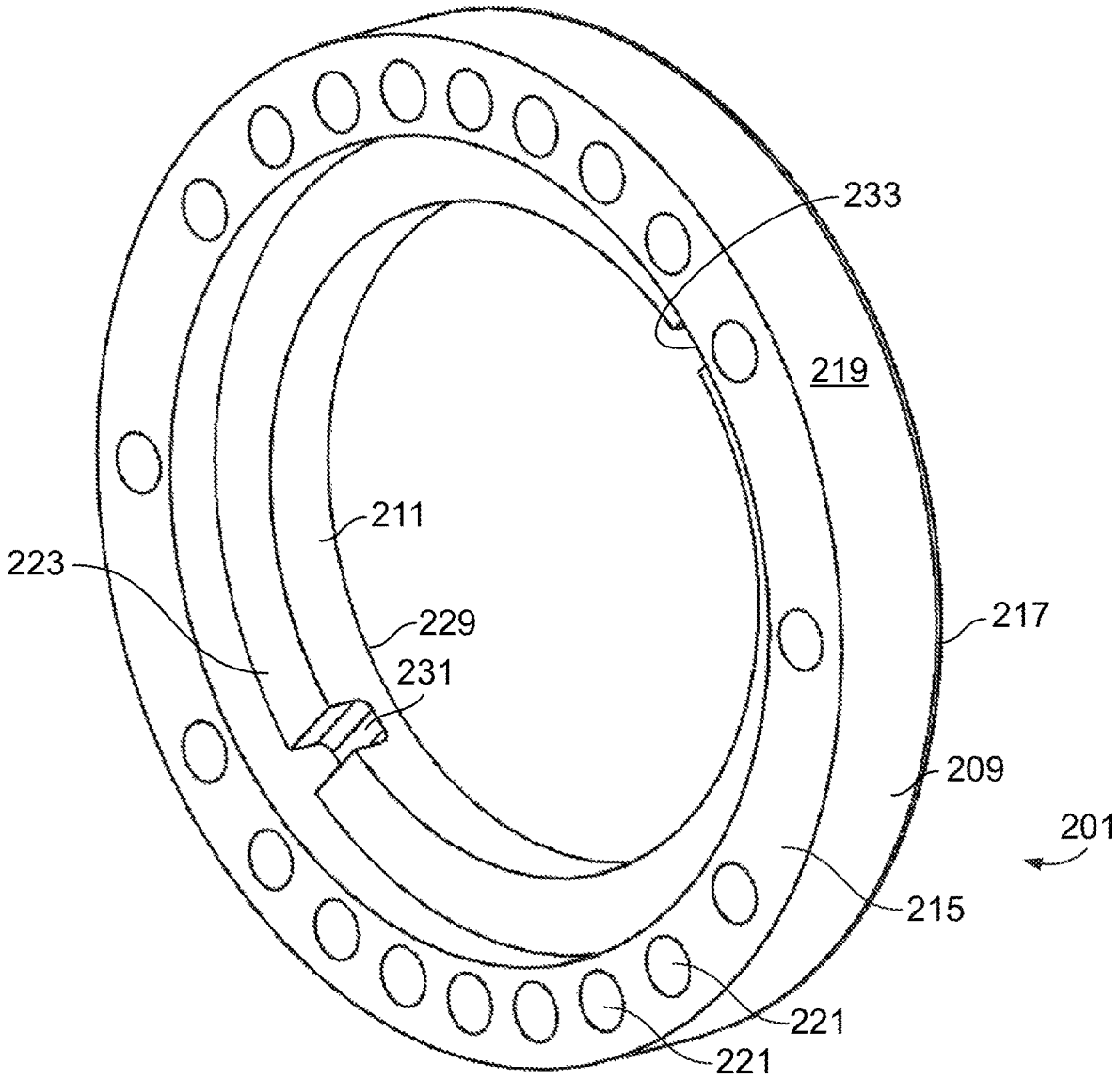
FIG. 14 is a perspective view of the positioning ring.

The roller positioning assembly 32 is shown in FIGS. 10 and 14. The roller positioning assembly 32 includes an outer sleeve 214, an inner sleeve 220, and a positioning ring 201.

The cylindrically-shaped outer sleeve 214 defines a central passageway 216. A plurality of arms 218 extend from the outer sleeve 214. The cylindrically-shaped inner sleeve 220 includes an inner end 220*a* and an outer end 220*b*. The inner sleeve 220 further includes a first eccentric bushing 203, and a second eccentric bushing 205. The first eccentric bushing 203 is provided at the inner end 220*a* of the inner sleeve 220. The second eccentric bushing 205 is spaced from the first eccentric bushing 203. First and second diametrically opposed locking pins 207 extend through the first eccentric bushing 203.

Figure 15:
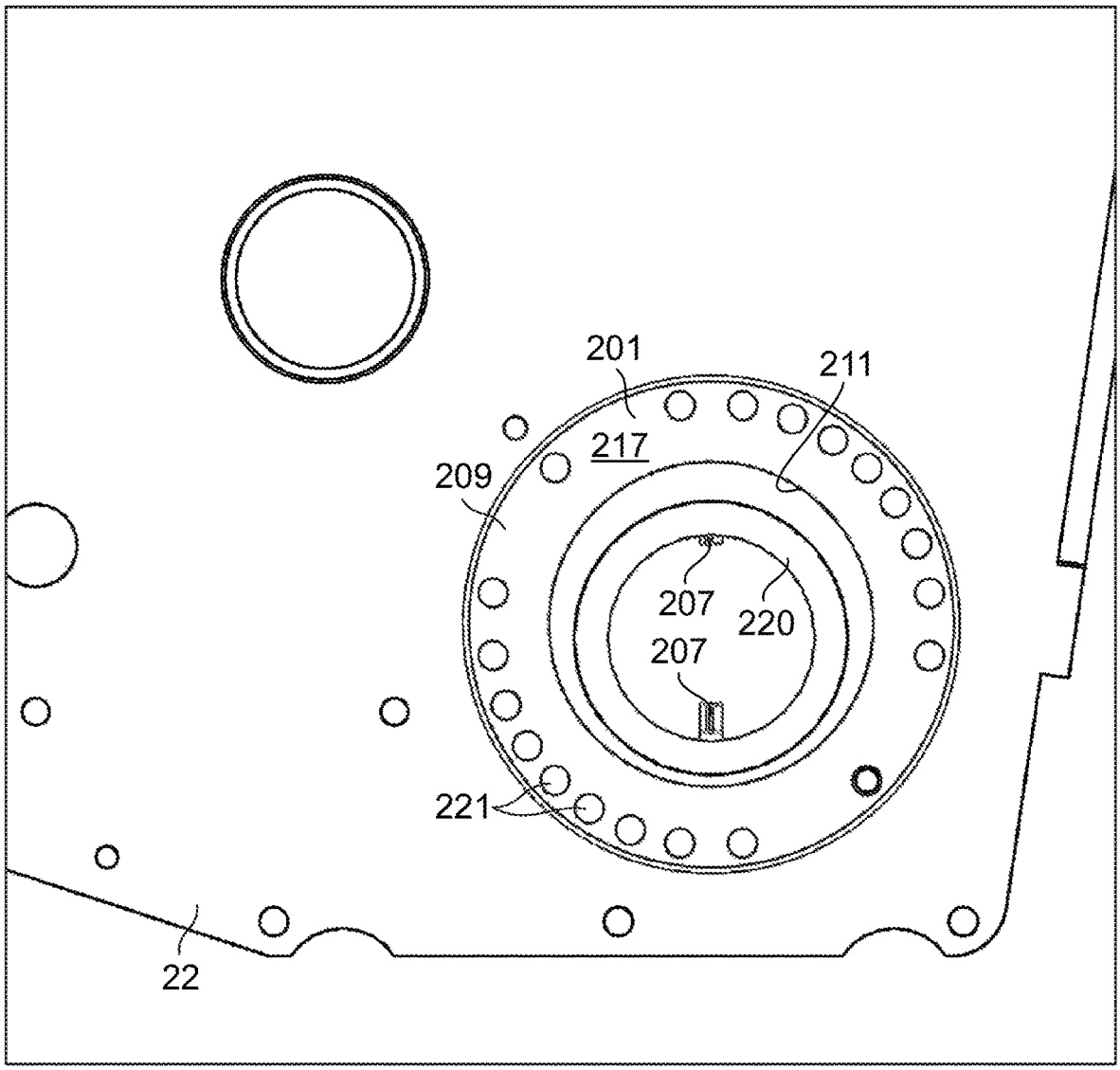
FIG. 15 is an elevated view of the positioning ring relative to the frame base and sleeve, with the sleeve positioned at a minimum height.

As best shown in FIGS. 14 and 15, the positioning ring 201 includes an outer cylindrically-shaped wall 209 and an inner generally cylindrically-shaped wall 211. The outer wall 209 includes a first planar surface 215, a second planar surface 217, and a circumferential surface 219. A number of positioning apertures 221 extend from the first surface 215 to the second surface 217. The outer wall 209 and the inner wall 211 have a uniform thickness.

The inner wall 211 is concentric and is positioned within the outer wall 209. The inner wall 211 includes a first planar surface 223 and a second planar surface 229. The inner wall 211 further includes a first receiving notch 231 and a second receiving notch 233.

The cylindrically-shaped inner sleeve 220 is positioned within the roller assembly positioning shaft 51 and extends therefrom in a cantilevered fashion. The inner end 220*a* of the inner sleeve 220 extends beyond the second surface 54*b* of the first plate 54 of the frame 22. The positioning ring 201 is mounted to the inner end 220*a* of the inner sleeve 220 such that the second planar surface 217 of the positioning ring 201 is placed proximate the second surface 54*b* of the first plate 54 of the frame base 42. In addition, the locking pins 207 of the inner sleeve 220 are positioned within the receiving notches 231, 233 of the positioning ring 201. The first eccentric bushing 203, therefore, is positioned within the inner wall 211 of the positioning ring 201. The second eccentric bushing 205 is positioned within the roller assembly positioning shaft 51. The eccentric bushings of the inner sleeve 220 along with the concentrically shaped positioning ring 201 provide for height adjustment of the roller assembly 28 as will be described herein. The inner sleeve 220 is cantilevered such that the outer end 220*b* extends beyond the positioning shaft 51 of the frame base 42 and receives the outer sleeve 214.

The arms 218 of the outer sleeve 214 are spaced along the length of the outer sleeve 214. When mounted, a first or innermost arm 218*a* is positioned proximate the inner support plate 158 of the roller assembly 28; a second arm 218*b* is positioned between the outer support plate 160 and the inner plate 162 of the roller assembly 28; a third arm 218*c* is positioned between the outer plate 164 and the inner plate 166*c* of the roller assembly 28; and a fourth arm 218*d* is positioned proximate the outer plate 168 of the roller assembly 28.

Each arm 218*a*-218*d* is generally tear-drop shaped with a rounded narrow upper end and a rounded wide lower end. The central passageway 216 extends through the lower end of each arm 218. A roller positioning guide shaft aperture 224 is provided through the upper end of each arm 218 and is aligned with the roller positioning shaft apertures of each plate 158, 160, 162, 164, 166, 168. The lead guide rod 178 which extends through the roller positioning shaft apertures of the plates 158, 160, 162, 164, 166, 168 also extends through the roller positioning guide shaft apertures 224 of each arm 218. A portion of the lead guide rod 178 extends outwardly of the fourth arm 218*d* to which a handle 228 is mounted. The handle 228 provides for rotation of the roller positioning assembly 32 from an up or forward position as shown in FIGS. 4 and 11 to a down or rearward position as shown in FIGS. 8 and 12.

Figure 18:
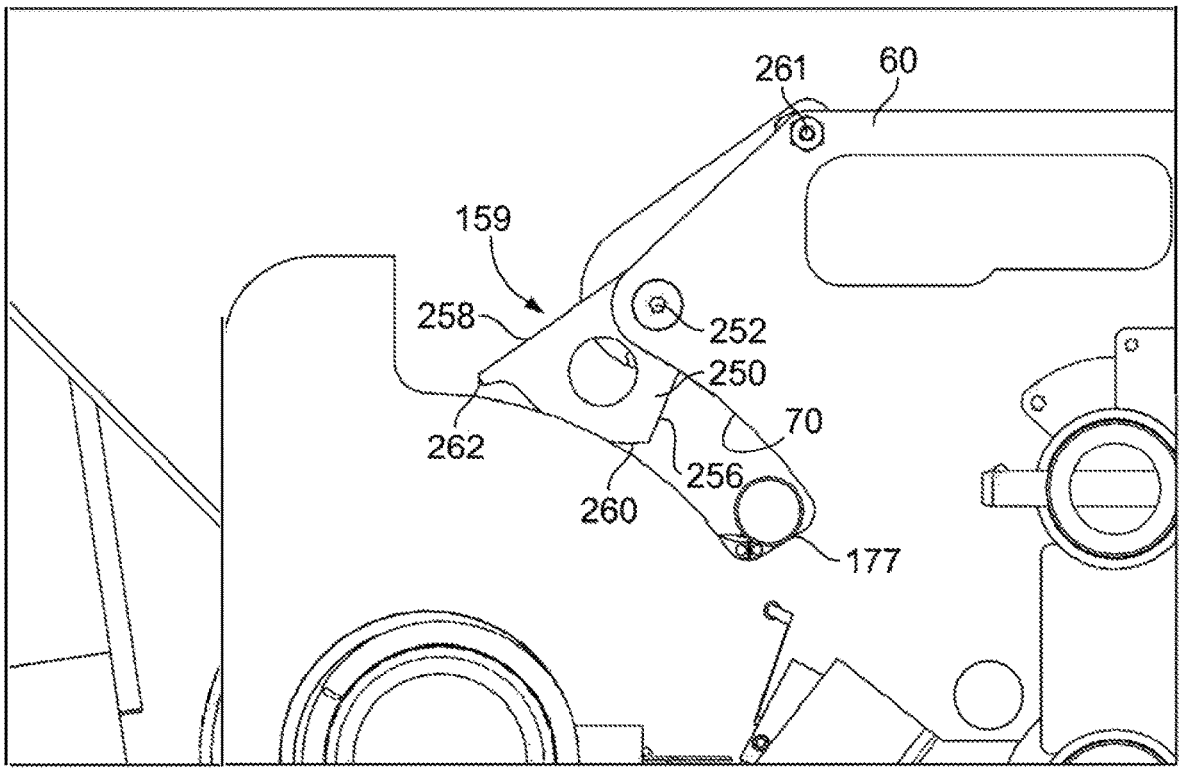
FIG. 18 is an elevated view of the guide wall illustrating the position of the guide shaft relative to the lead guide path and with the guide shaft illustrated in a rest position.

As shown in FIG. 18, movement of the roller assembly 28 is guided by shaft 177 and the lead guide path 70. The shaft 177 (see FIG. 18) extends inwardly of the inner support plate 158 and is seated within the lead guide path 70. When the main roller assembly 28 is moved relative to the frame 22, the shaft 177 translates along lead guide path 70. A cam assembly 159 which is known in the art, engages the shaft 177 to hold the shaft 177 and main roller assembly into an up position as will be described herein. The cam assembly 159 includes a cam 250, a pivot pin 252, and a cam spring 254 (see FIG. 5). The cam 250 is generally bell-shaped. The cam 250 includes a first side surface 256, a second side surface 258, an arcuate holding surface 260, and a protrusion 262. The cam 250 is rotatably mounted to the guide wall 60 via the pivot pin 252. A first end of the spring 254 is attached to a spring pin 261 and a second end of the spring 254 is attached to a lower portion of the cam 250.

As noted above and as shown in FIG. 5, the rear guide rod 176 extends through the rear roller 174. A first portion 176*a* of the rear guide rod 176 extends toward the guide wall 60 and is seated within the rear guide path 72 of the guide wall 60. A second portion 176*b* of the rear guide rod 176 extends over and rests upon the upper guide surface 86 of the support member 62*a*.

Figure 11:
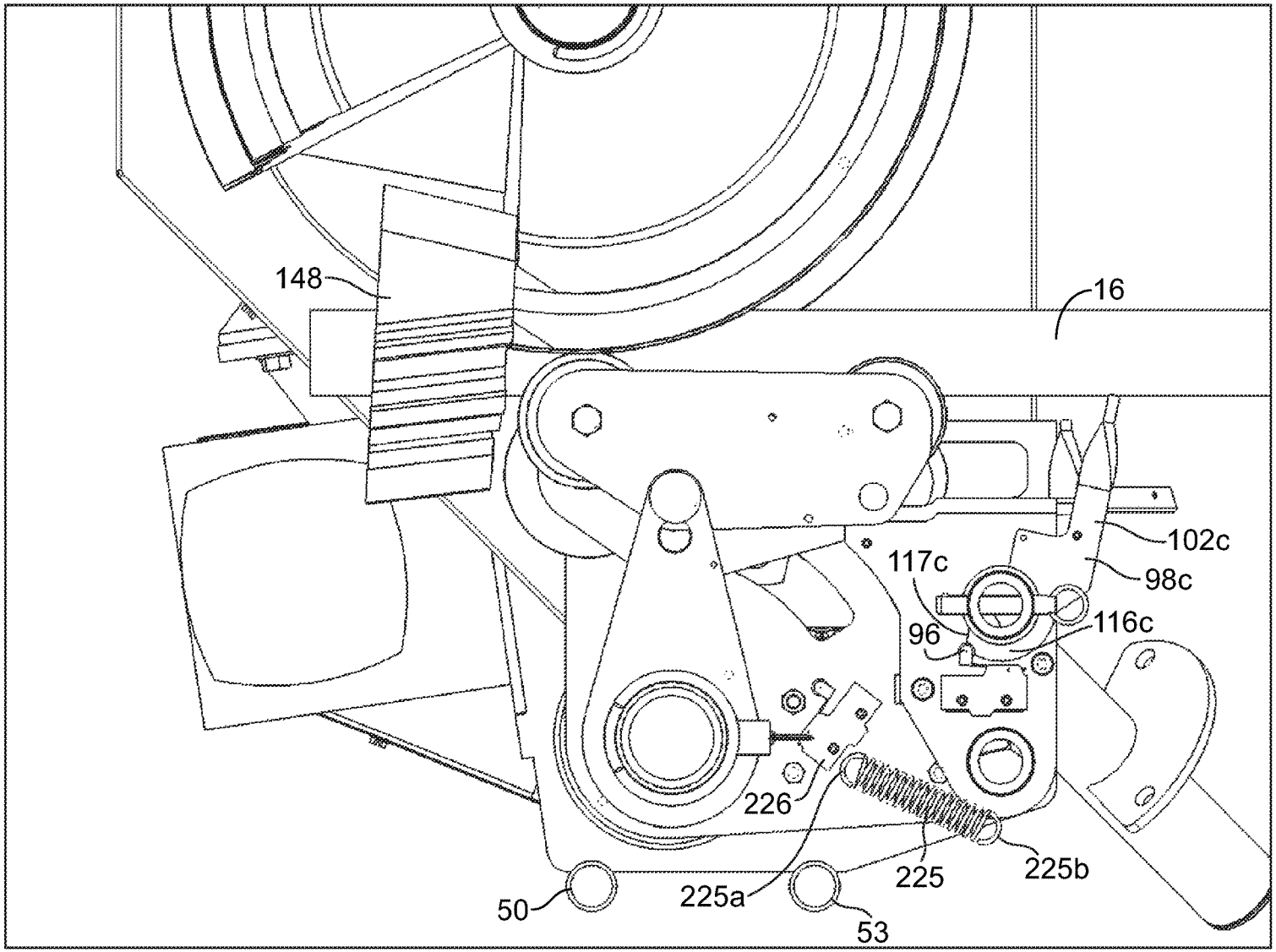
FIG. 11 is a side elevation view of a portion of the conduit bender with the roller assembly shown in an up position and certain elements removed for clarity and with a conduit positioned for bending.
Figure 12:
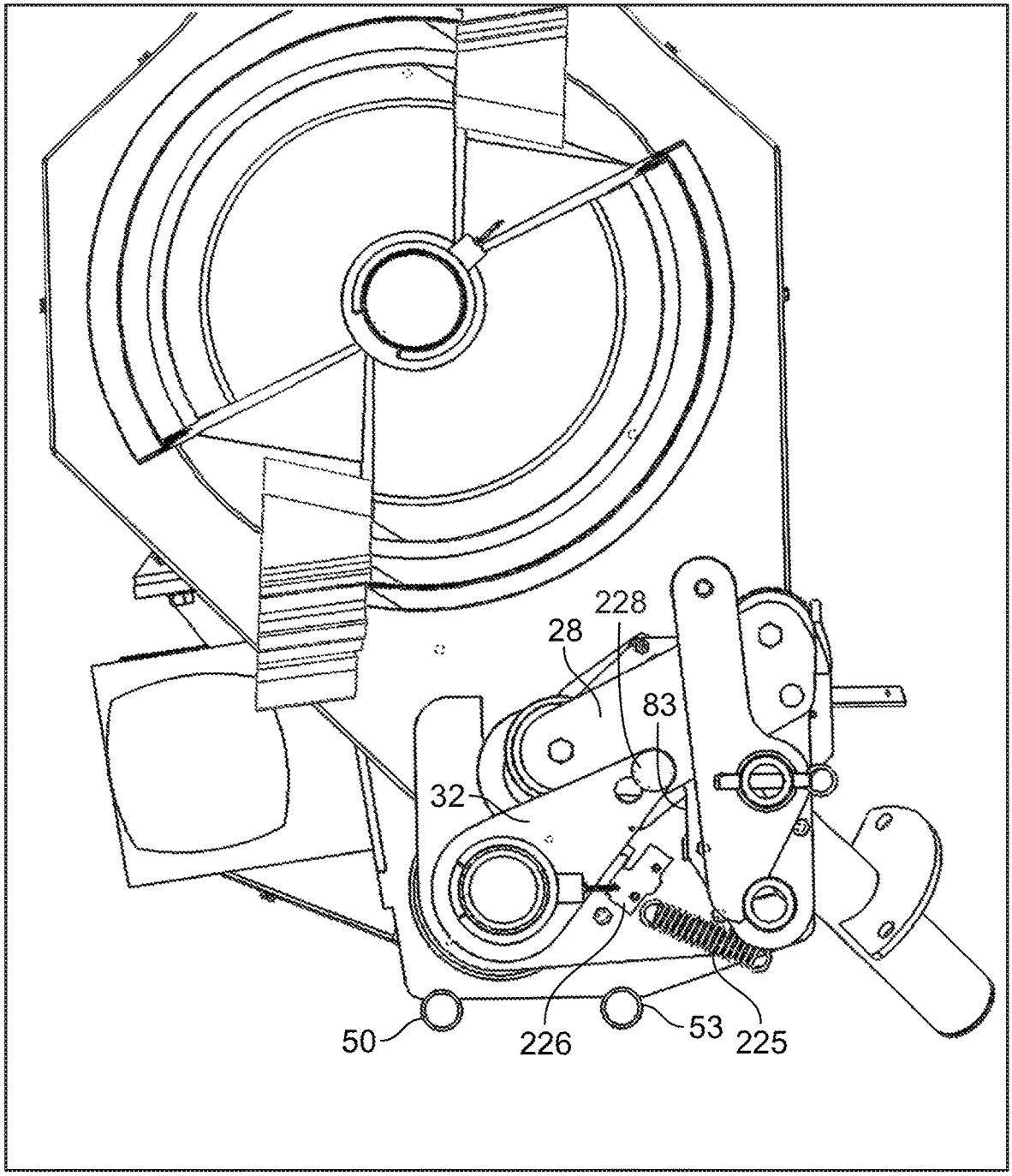
FIG. 12 is a side elevation view of a portion of the conduit bender with the roller assembly in a down position.

A roller positioning spring 225 is shown in FIGS. 5 and 11. Attachment of the roller positioning spring 225 is not illustrated in FIG. 11. A first end 225*a* of the spring 225 is attached to the roller positioning assembly 32 and as shown in FIG. 5, a second end 225*b* of the spring 225 is attached to band 227 positioned around the lower support shaft 48 of the frame 22. The force of the spring 225 pulls the roller positioning assembly 32 generally downward and rearward to place the main roller assembly 28 in the down position. In order to place the main roller assembly 28 in the up position, the operator must pull upwardly and forwardly on the handle 228 against the force of the spring 225 to place the main roller assembly 28 in the up position.

A roller positioning switch 226 is also illustrated in FIGS. 11 and 12. The roller positioning switch 226 is mounted to the guide wall 60 and is in electrical communication with the microprocessor 61. When the roller positioning assembly 32 is in the down position, as shown in FIG. 12, the roller positioning assembly 32 contacts an arm of the roller positioning switch 226, providing a signal to the microprocessor 61 that the roller positioning assembly 32 together with the main roller assembly 28 is in the down position. When the roller positioning assembly 32 is in the up position, as shown in FIG. 11, the roller positioning assembly 32 is no longer in contact with the arm of the roller positioning switch 226 and therefore the roller positioning switch 226 provides a signal to the microprocessor 61 that the roller positioning assembly 32 together with the main roller assembly 28 are in the up position.

Figure 9:
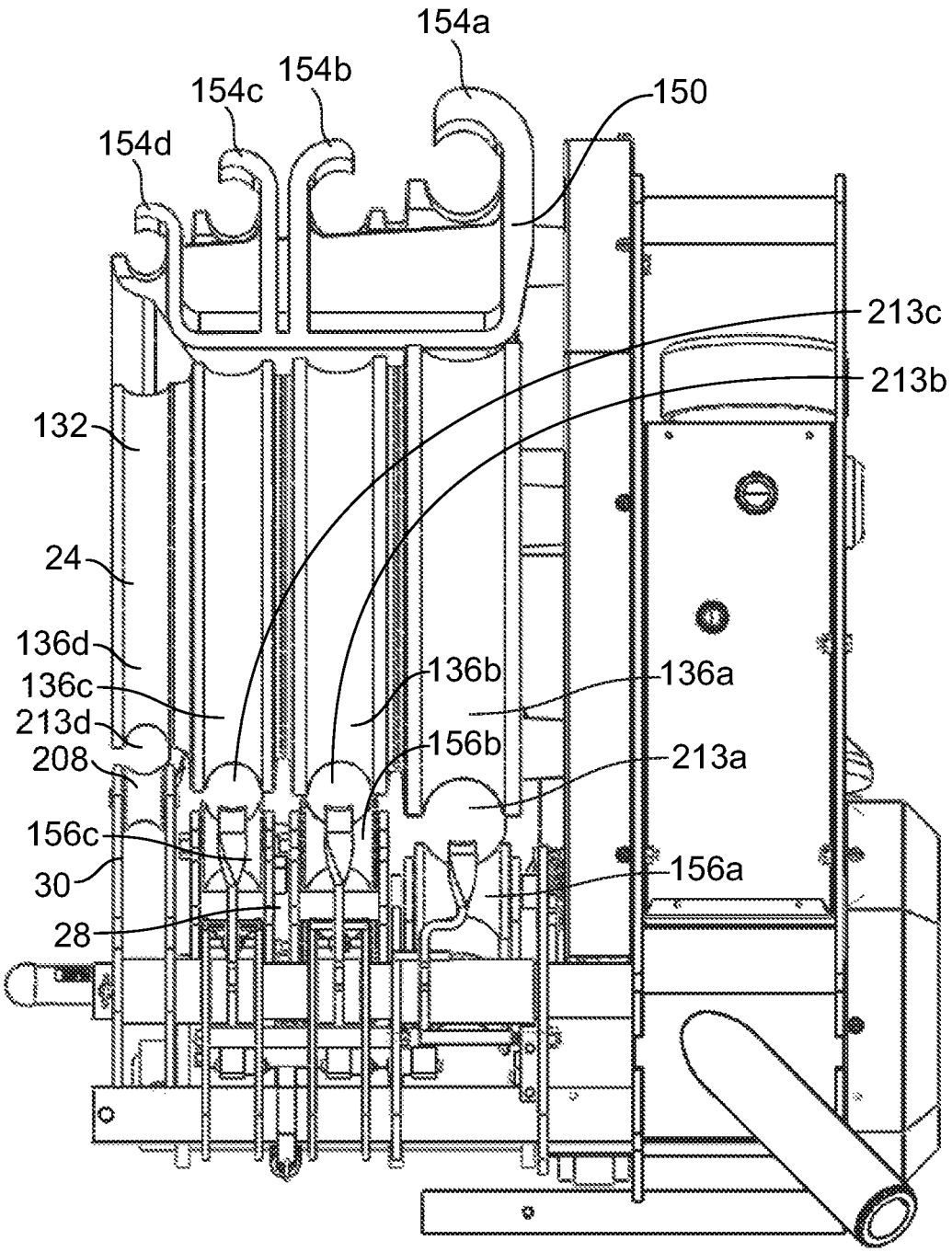
FIG. 9 is a rear elevation view of a portion of the conduit bender.

As best illustrated in FIG. 9, conduit passageways are provided between the shoe 24 and roller assembly 28. When the first portion 132 of the shoe 24 is positioned proximate the roller assembly 28, the conduit passageways are provided between the first portion 132 of the shoe 24 and the roller assembly 28. When the second portion 134 of the shoe 24 is positioned proximate the roller assembly 28, the conduit passageways are provided between the second portion 134 of the shoe 24 and the roller assembly 28. More specifically, a two-inch conduit passage 213*a* is provided between the innermost channels 136*a*/138*a* of the shoe 24 and the innermost set of rollers 156*a* of the roller assembly 28; a one and one-half inch conduit passage 213*b* is provided between the channels 136*b*/138*b* of the shoe 24 and the intermediate set of roller 156*b* of the roller assembly 28; a one and one-quarter inch conduit passage 213*c* is provided between the channels 136*c*/138*c* of the shoe 24 and the outermost set of rollers 156*c* of the roller assembly; and a one inch conduit passage 213*d* is provided between the channels 136*d*/138*d* of the shoe 24 and auxiliary roller 208 of the auxiliary roller assembly 30.

Figure 40:
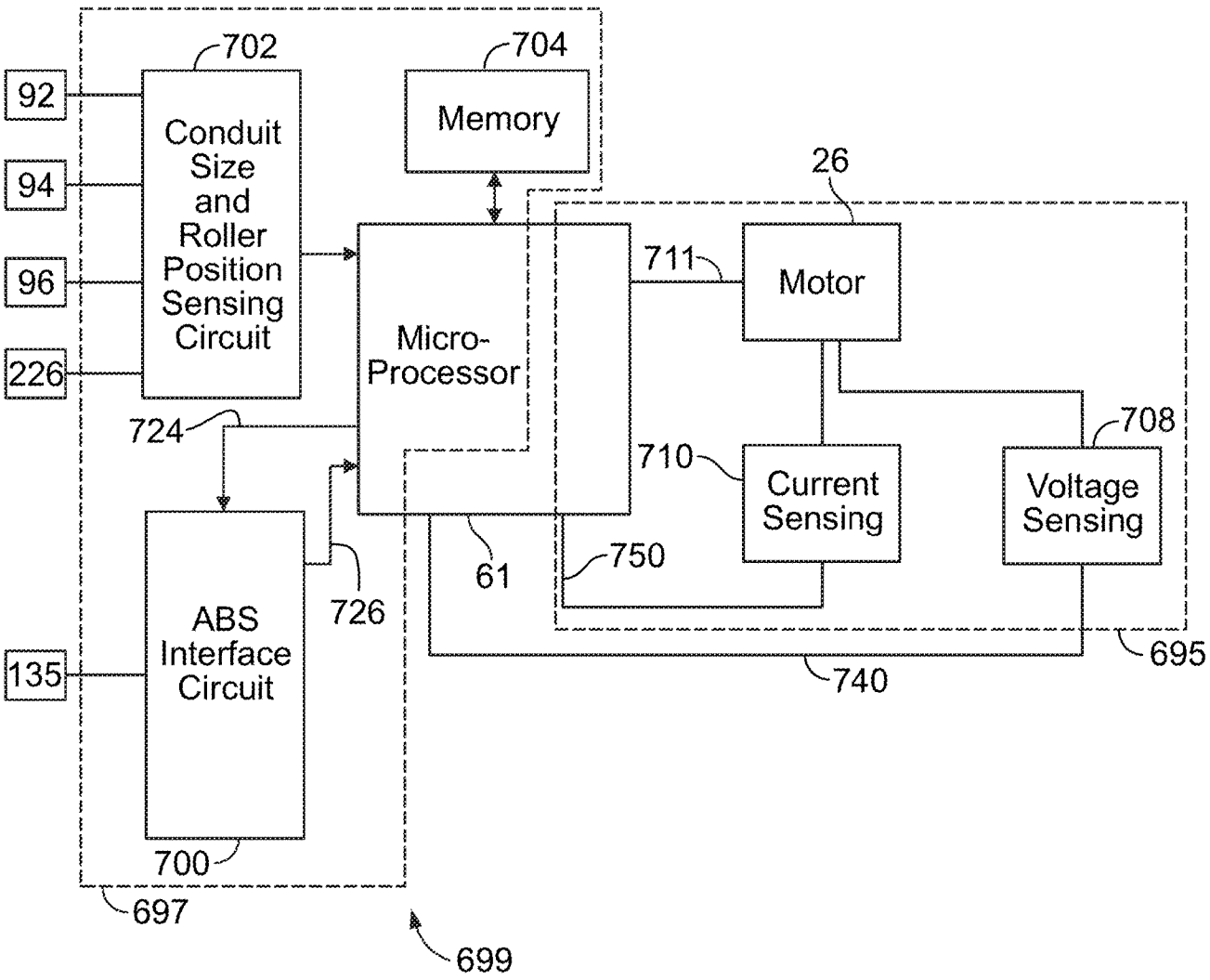
FIG. 40 is a block diagram illustrating portions of the circuit associated with the bender.

Portions of the electronic circuit associated with the conduit bender 20 are illustrated in FIGS. 34-40. As shown in FIG. 40, the circuit 699 generally includes an auto-sensing portion 697 which provides information about the characteristics of the conduit to be bent and a feedback portion 695 which provides feedback information to achieve bending accuracy.

Figure 35:
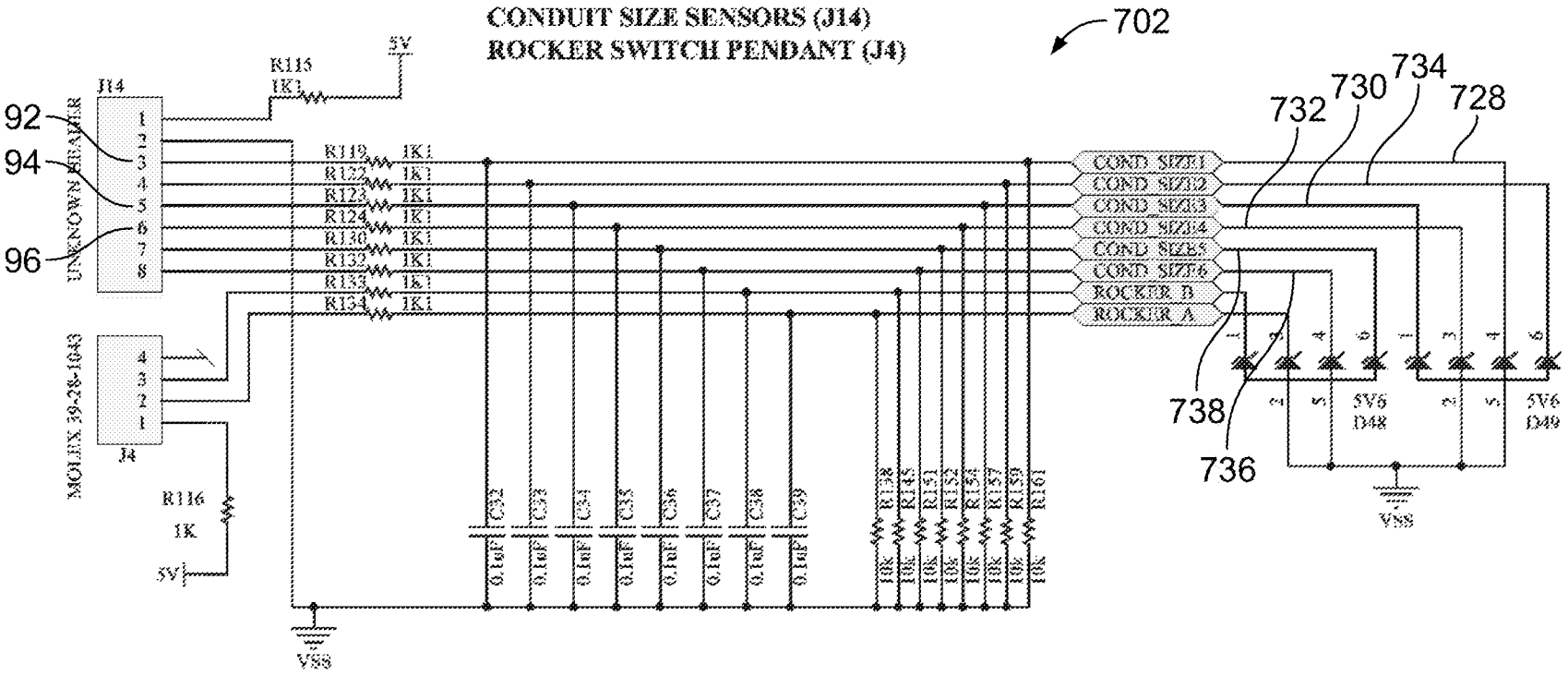
FIG. 35 illustrates the conduit size and roller positioning sensors circuit of the circuit of the present invention.
Figure 36A:
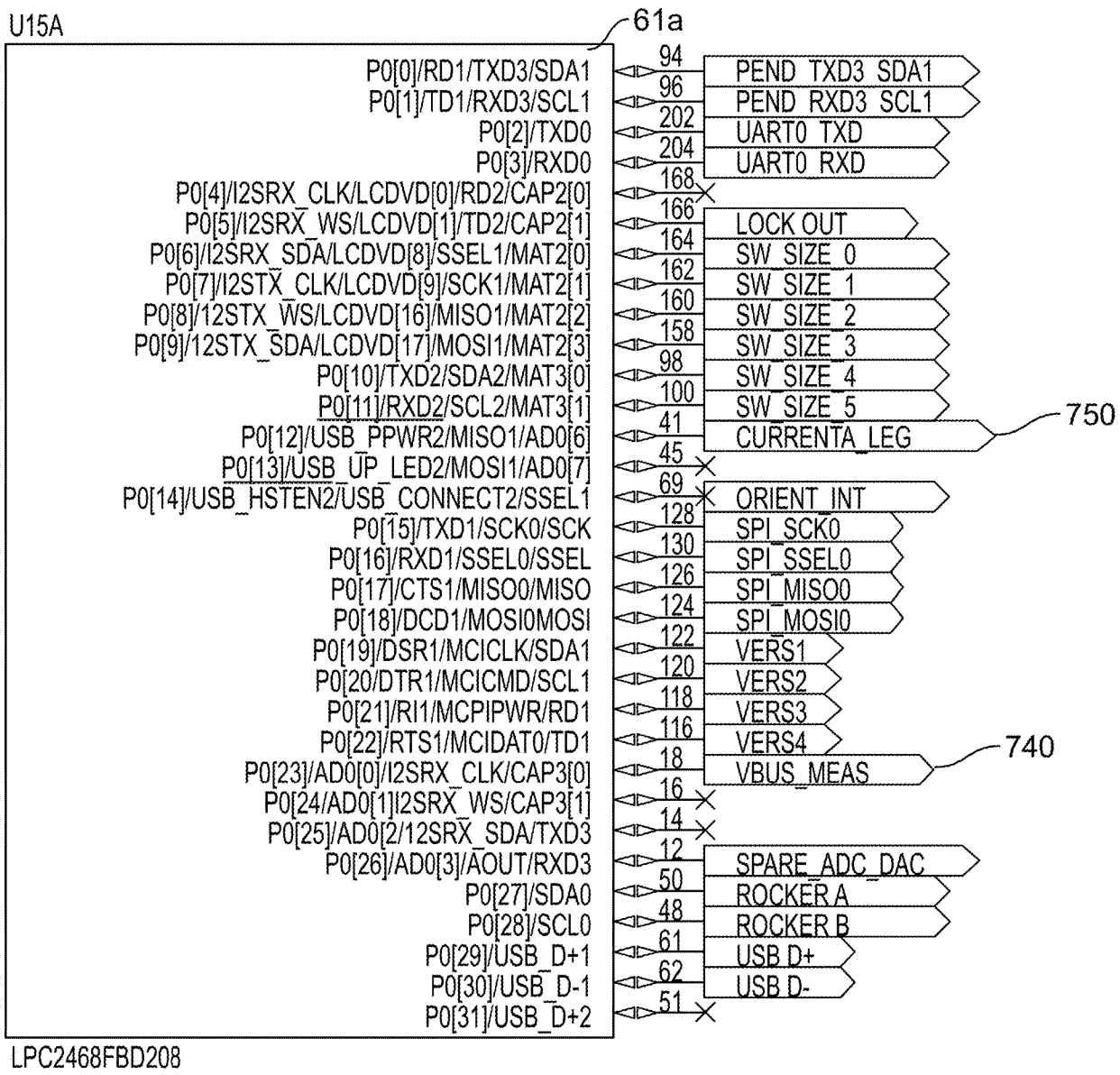
FIGS. 36*a*-*c* illustrate portions of the microprocessor of the circuit of the present invention.
Figure 36B:
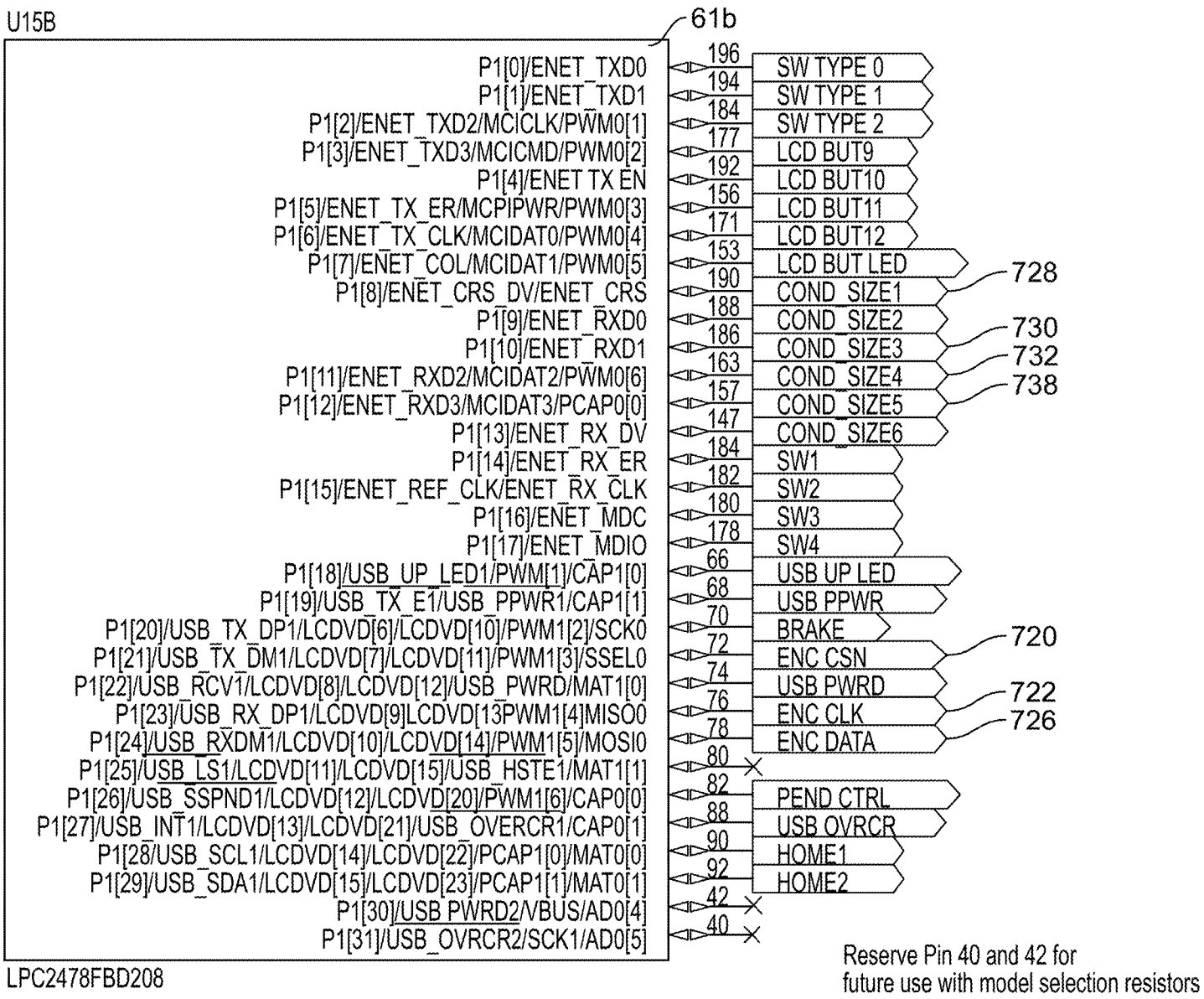
Figure 36C:
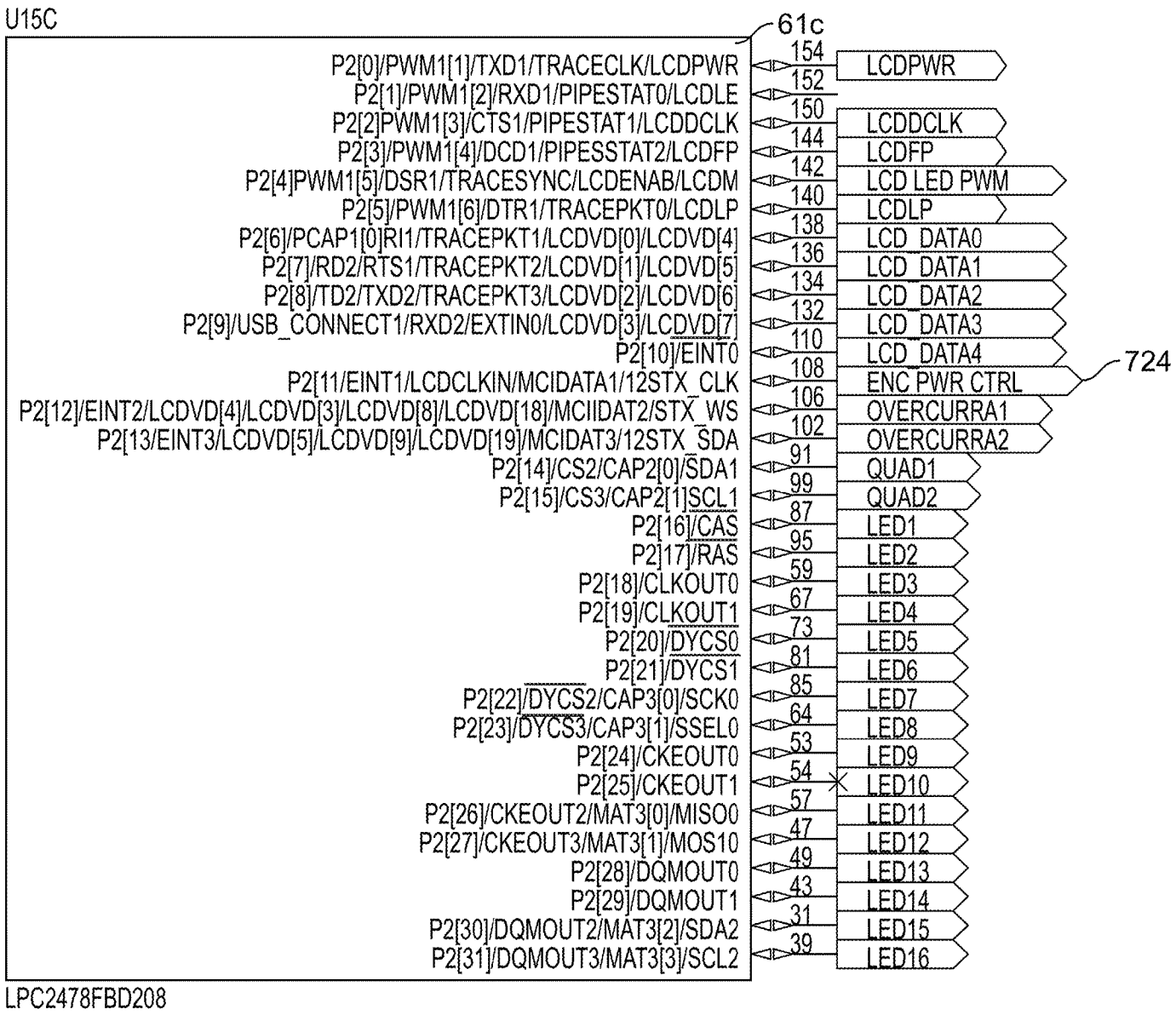
Figure 37A:
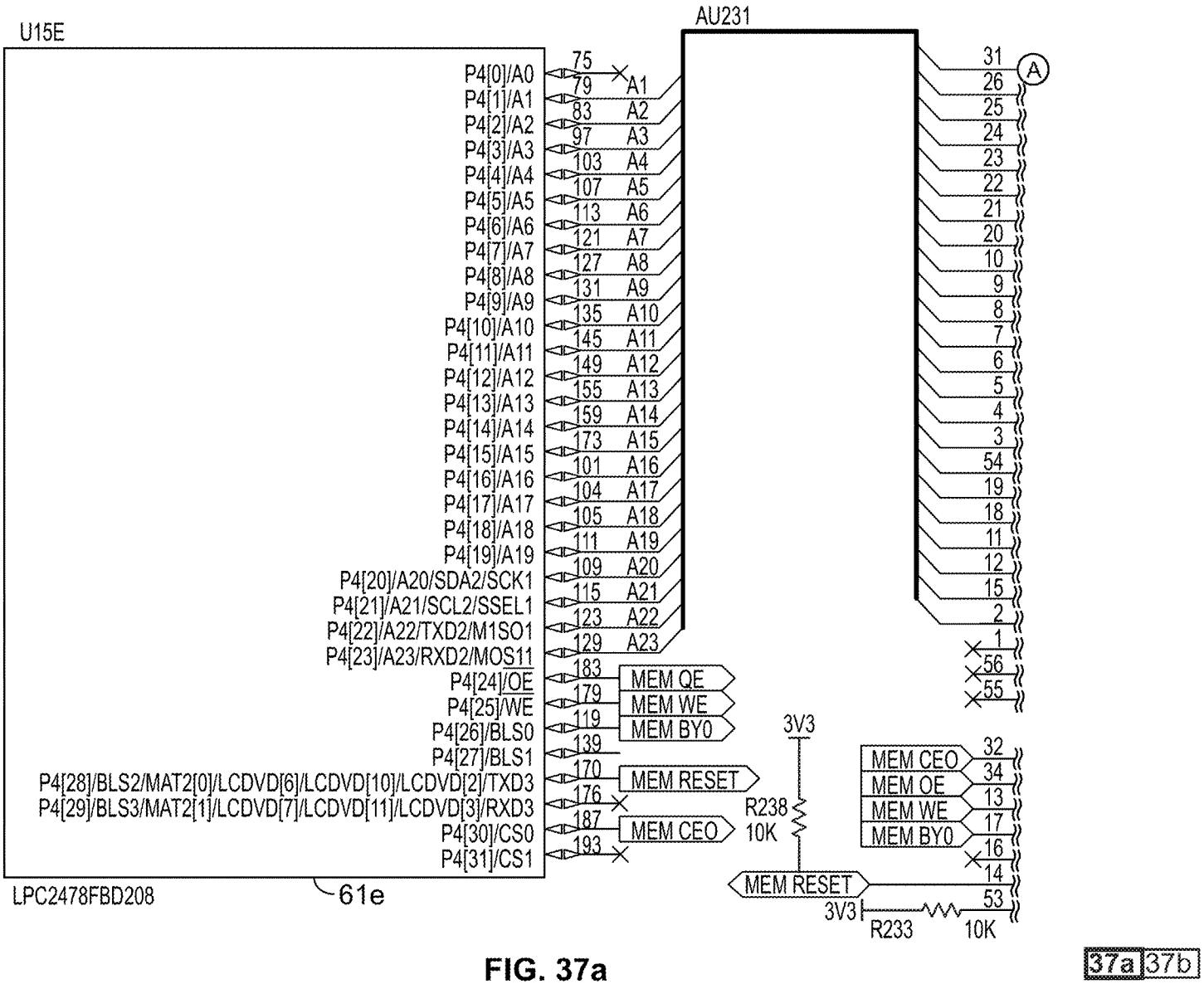
FIGS. 37*a* and 37*b* illustrate portions of the microprocessor and the flash memory of the circuit of the present invention.
Figure 37B:
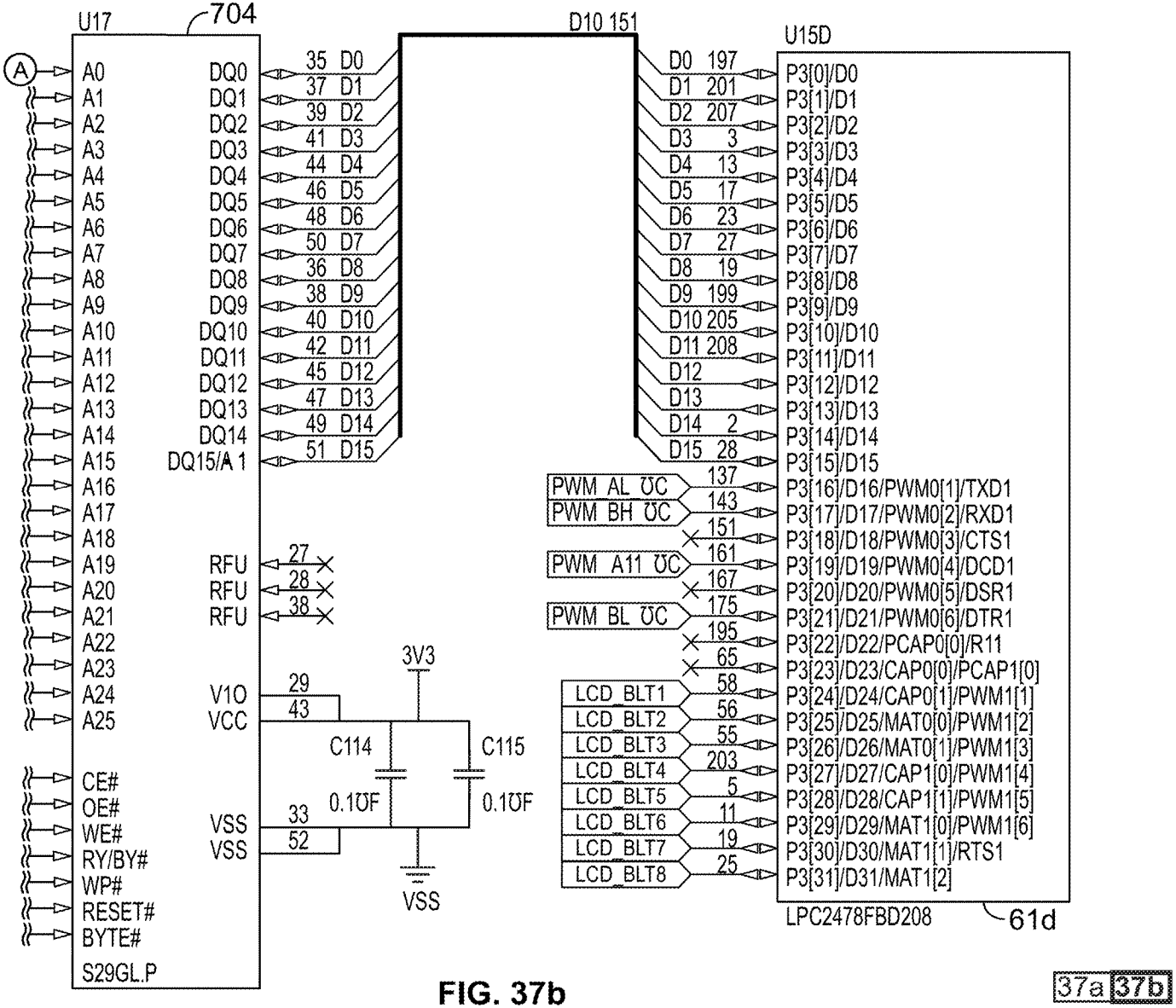

The auto-sensing portion 697 of the circuit 699 includes the absolute encoder 135 (see FIG. 13), an ABS encoder interface 700 (see FIG. 34), the conduit size and roller positioning sensor circuit 702 (see FIG. 35), the microprocessor 61, and a flash memory 704 (see FIGS. 36 and 37). Portions 61*a*, 61*b*, and 61*c* of the microprocessor 61 are shown in FIGS. 36*a*-*c* and portions 61*d* and 61*e* of the microprocessor 61 are shown in FIG. 37. FIG. 37 further illustrates electrical connections between portions 61*d* and 61*e* of the microprocessor 61 and the flash memory 704.

As discussed above, the absolute encoder 135 is mounted within the shoe sleeve 131. The absolute encoder 135 is preferably an AEAT-6012 type absolute encoder. Connection between the microprocessor 61 and the absolute encoder 135 is provided by the ABS encoder interface 700 shown in FIG. 34. A length of wire is provided along the shoe sleeve 131 to connect the absolute encoder 135 to the J18 connector of the interface 700. The interface 700 includes leveling circuit including transistor Q14 to translate the 3.3V ENC CSn signal 720 from the microprocessor 61 (see portion 61*b* illustrated in FIG. 36*b*) to the 5V signal required by the absolute encoder 135. The interface 700 also includes leveling circuit including transistor Q15 to translate the 3.3V ENC_CLK signal 722 from the microprocessor 61 to the 5V signal required by the absolute encoder 135. Capacitors C107, C109, C111 of the interface 700 are provided to reduce the noise on the signal lines thereby preventing false signals from the absolute encoder 135.

Interface 700 further includes element U10 to provide power to the absolute encoder 135. U10 is controlled by the ENC PWR CTRL signal 724 from the microprocessor 61 (see portion 61*c* illustrated in FIG. 36*c*). Resistor R117 and capacitor C126 provide an RC delay circuit to delay power-on of the encoder 135 to ensure that the absolute encoder 135 will not power up until after the microprocessor 61 is ready.

In order to simplify the assembly process, the absolute encoder 135 may be mounted with any orientation on the shoe sleeve 131. Upon initially powering the conduit bender 20 on, the system is moved into the factory "zero" or initial setting. In this "zero" initial setting, a unique combination of keys is entered and an initial value is provided by signal ENC_DATA signal 726 from the encoder 135 to the microprocessor 61 (see portion 61*b* illustrated in FIG. 36*b*). This initial value of the signal ENC_DATA signal 726 is stored in the flash memory 704 on the control board. The absolute encoder 135 continuously provides the ENC_DATA signal 726 to the microprocessor 61. A comparison between the value of the ENC_DATA signal 726 to the initial value of the ENC_DATA signal stored in the flash memory allows a precise position of the shoe 24 relative to the shoe shaft 44 to be determined at any given time.

The conduit size and roller positioning sensor circuit 702 illustrated in FIG. 35 provides an interface between the controller and microprocessor 61 and the lever switches 92, 94, 96 discussed above. The circuit 702 includes a conduit size connector J14 and surrounding components. The conduit size connector J14 includes inputs 3, 5, 6, associated with switches 92, 94, and 96. Signal COND_SIZE2 734 and signal COND_SIZE6 736 are not currently associated with switches on the conduit bender 20, however, additional inputs 4 and 8 of the connector J14 are provided should the opportunity arise for including additional signals to be provided to the microprocessor 61 upon modification of the invention. Input 7 of the connector J14 is associated with the roller positioning switch 226 and provides the roller positioning signal COND_SIZE5 738 to the microprocessor 61 (see portion 61*b*). This COND_SIZE5 signal 738 provides an indication to the controller as to whether the main roller assembly 28 is in an up position or in a down position and thus indicates to the microprocessor 61 what type of conduit has been placed in the conduit bender 20 for the bending operation. The inputs of the connector J14 are consistently monitored by the microprocessor 61 to determine the size of conduit placed in the conduit bender 20 and to determine the type of conduit placed in the bender. Noise suppression circuit is provided in connection with the signals 728-738 to prevent the transmission of switch bouncing signals to the microprocessor 61.

A motor control signal 711, such as for example, a pulse width modulator (PWM) signal, controls the motor 26 and thus controls rotation of the shoe 24. To make a bend in a conduit, the microprocessor 61 utilizes the information received from the user regarding the desired bend to be made and the information from the auto-sensing portion of the circuit 699 regarding the characteristics of the conduit to be bent, in order to determine the degree to which the shoe 24 is to be rotated, i.e. the stop position/location of the shoe 24, to achieve the desired bend. As the shoe 24 approaches the stop position, the PWM signal 711 is adjusted to gradually reduce the power delivered to the motor 26, thereby gradually reducing the speed at which the shoe 24 is rotated until eventually the rotation of the shoe 24 is stopped. Because rotation of the shoe 24 is stopped gradually, no mechanical brake is needed to stop rotation of the shoe 24.

Figure 38:
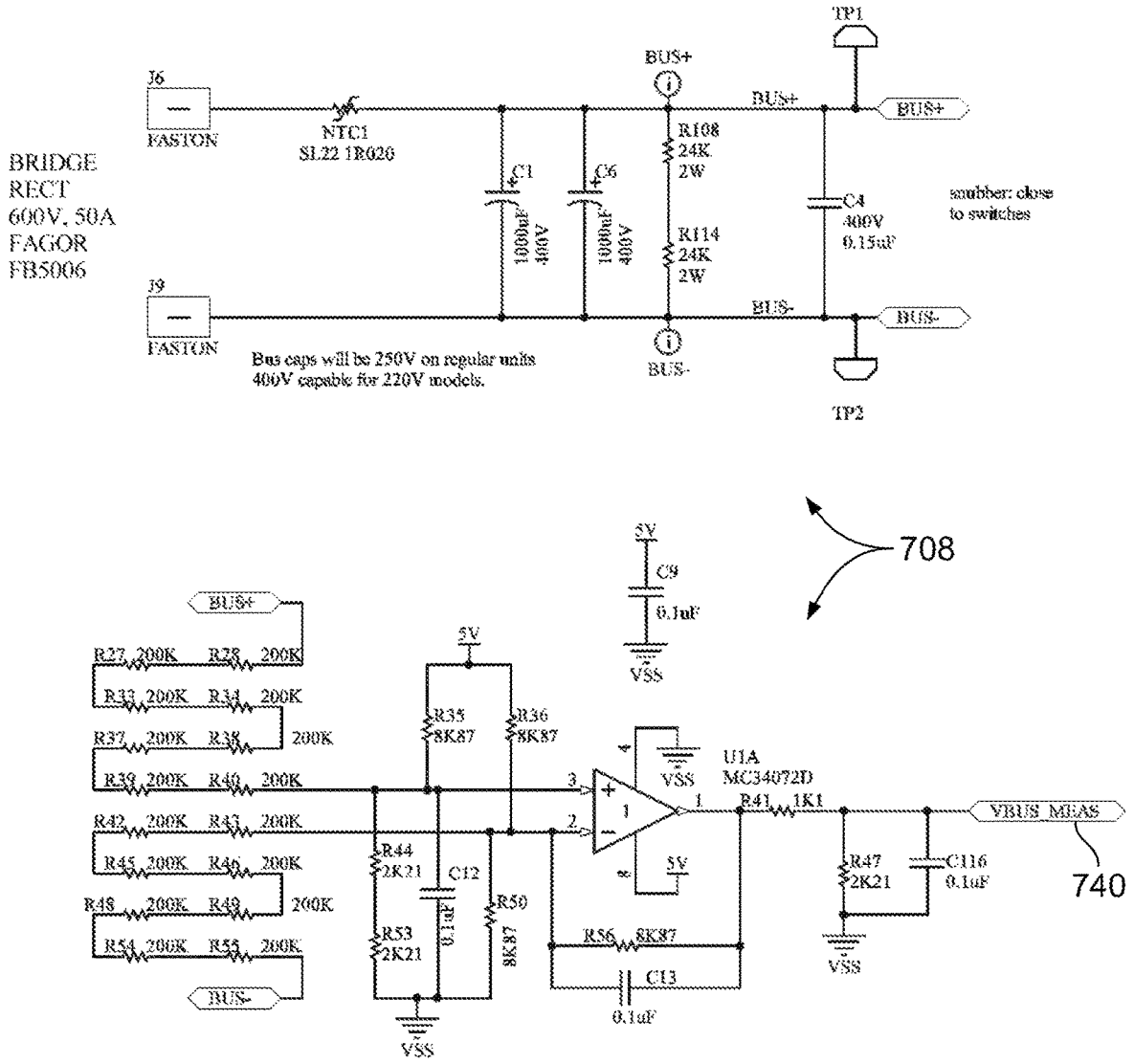
FIG. 38 illustrates a VBUS sensing portion of the circuit of the present invention.
Figure 39:
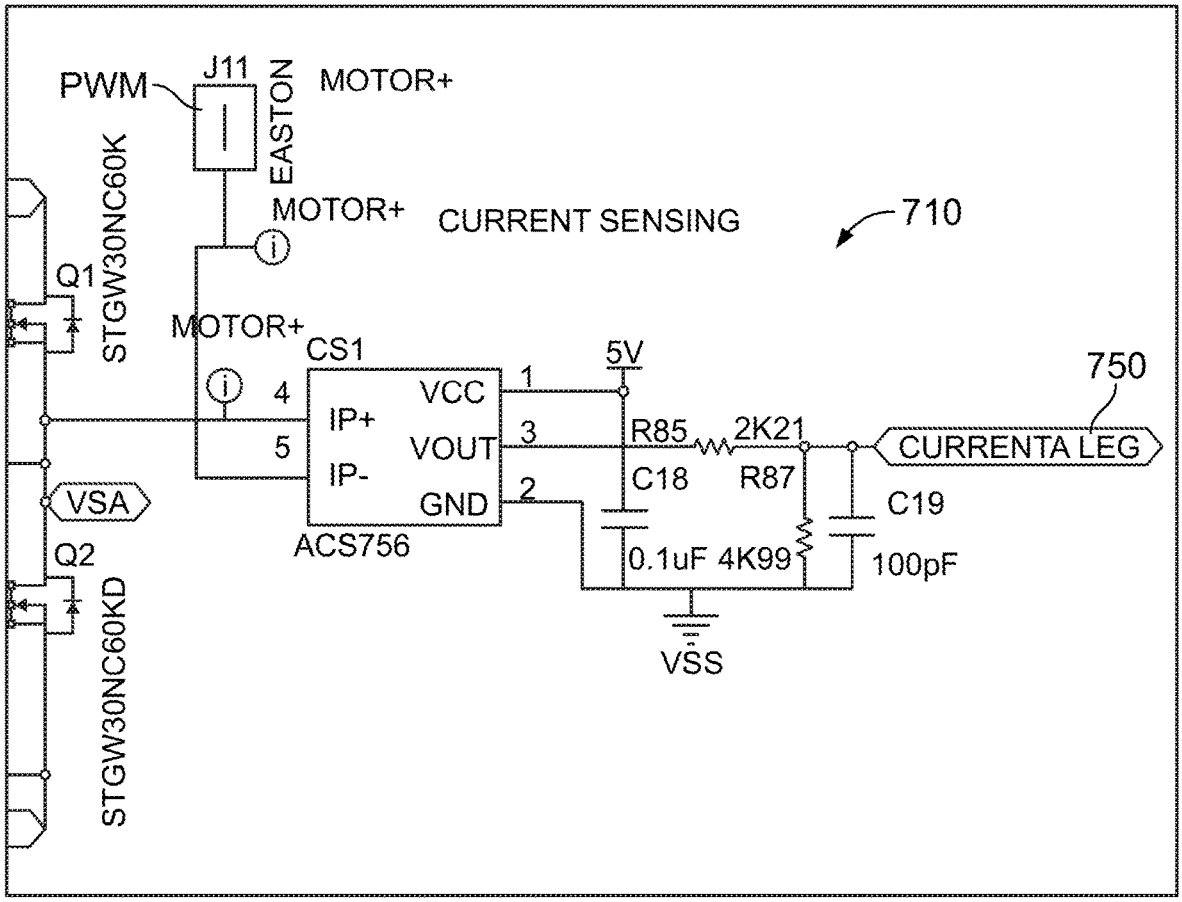
FIG. 39 illustrates a current sensing portion of the circuit of the present invention.

As noted above, the feedback portion 695 of the circuit 699 provides feedback regarding the bending operation. Key components of the feedback portion 695 of the circuit 699 include a VBUS sensing circuit 708 (see FIG. 38), a current sensing circuit 710 (see FIG. 39), and the microprocessor 61. The VBUS sensing circuit 708 is illustrated in FIG. 38 and provides a measure of the voltage consumed by the motor 26. A bridge rectifier provides voltages at BUS+ and BUS−. The VBUS sensing circuit 708 includes an op-amp U1A and associated components for translating the voltage levels at BUS+ and BUS− down to an acceptable level to be provided to the microprocessor 61 at VBUS MEAS. The signal VBUS MEAS 740 is a measure of the voltage consumed by the motor 26. The signal VBUS MEAS 740 is provided to an analog-to-digital input pin of the microprocessor 61 (see 61*a*) wherein the signal is converted to a digital value which is then translated by the microprocessor 61 to a known value.

The current sensing circuit 710 includes component CS1 for translation of the bus voltage down to an acceptable level to be provided to the microprocessor 61 at CURRENTA LEG. The signal CURRENTA LEG 750 is a measure of the current consumed by the motor 26. The signal CURRENTA LEG 750 is provided to an analog-to-digital input pin of the microprocessor 61 (see 61*a*) wherein the signal is converted to a digital value which is then translated by the microprocessor 61 to a known value.

The microprocessor 61 then utilizes the known value derived from the signal VBUS MEAS 740 and the known value derived from the signal CURRENTA LEG 750 to determine the power consumed by the motor 26. The microprocessor 61 continuously monitors the signals VBUS MEAS 740 and CURRENT A LEG 750. By monitoring the power consumption, adjustment can be made to the PWM signal to control the bending operation. For example, if the signal CURRENTA LEG 750 indicates that current consumption is too high (i.e. indicating that the amperage rating for the conduit bender application may be exceeded), the microprocessor 61 is utilized to adjust the PWM signal and to lower the speed of the motor 26 thereby avoiding the possibility of exceeding the amperage rating of the conduit bender 20.

The feedback portion 695 of the circuit 699 also provides the ability to provide a precise bend to the conduit. For example, although conduits of the same type (e.g. EMT, rigid or IMC) are presumed to have the same rigidity, the rigidity of each conduit generally falls within a range of rigidities. Thus, one piece of EMT conduit may bend more easily than another piece of EMT conduit. Although a PWM signal 711 can be provided to the motor 26 based upon the presumed rigidity, if the actual rigidity of the conduit varies from the presumed rigidity, the bend provided to the conduit will be either insufficient or too great. The feedback portion of the circuit 699 allows the bending operation to be adjusted to account for fluxuations in rigidity. By monitoring the power consumed by the motor 26 through the signals VBUS MEAS 740 and CURRENTA LEG 750, the PWM signal 711 can be adjusted. For example, if the power consumption is greater than anticipated, indicating that the rigidity of the conduit is greater than anticipated, the PWM signal 711 can be adjusted to increase the degree to which the motor 26 will rotate the shoe 24, to account for the additional spring back which will be experienced by the conduit. Thus, in addition to using the PWM signal 711 to eliminate the need for a mechanical brake, the feedback portion 695 provides additional information to adjust the PWM signal 711 to more precisely stop rotation of the shoe based upon the physical characteristics of the conduit placed in the bender.

Use of the conduit bender 20 begins by determining which portion 132, 134 of the shoe 24 will be used for bending the conduit. If the conduit to be bent is IMC or rigid type conduit, the first portion 132 of the shoe 24 is positioned to receive the conduit. If the conduit to be bent is EMT type conduit, the second portion 134 of the shoe 24 is positioned to receive the conduit to be bent. In order to more easily identify which shoe portion 132 or 134 is associated with IMC or rigid type conduit and which shoe portion 132, 134 is associated with EMT type conduit, color coding can be provided on the gripping members 148, 150. The color coding provides a visual indication as to the type of conduit that each portion of the shoe 24 is used to bend. For example, the gripping member 148 associated with the first portion 132 of the shoe 24 and therefore associated with IMC and rigid type conduit can be made green, and the gripping member 150 associated with the second portion 134 of the shoe 24 and therefore associated with EMT type conduit can be made silver.

FIG. 8 shows an example of a rigid type conduit 18 to be bent. As shown in FIG. 8, the shoe 24 has been rotated relative to the shaft 44 of the frame 22 in order to position the first portion 132 of the shoe 24 proximate the main roller assembly 28. With the shoe 24 properly positioned, the relative positions of the magnet 43 and the absolute encoder 135 provide a signal to the microprocessor 61 indicating that the conduit to be bent is either IMC type or rigid type conduit.

Figure 16:
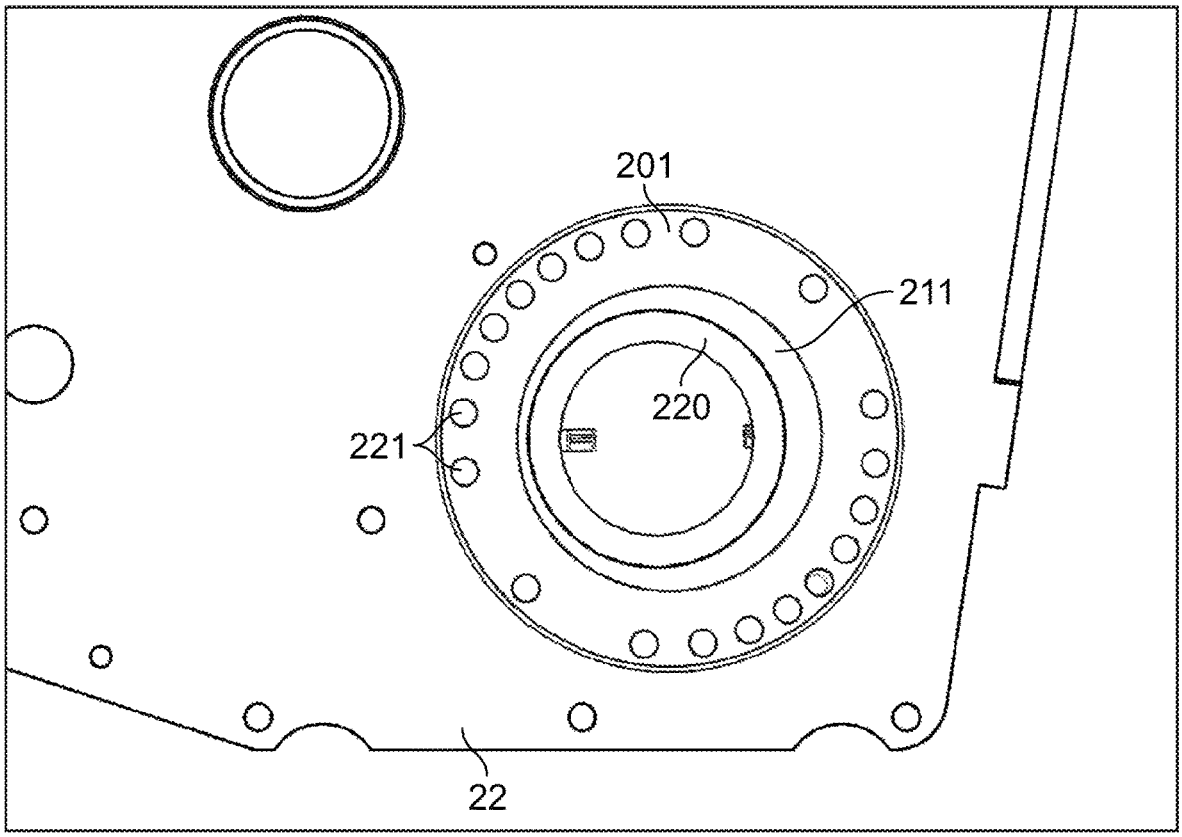
FIG. 16 is an elevated view of the positioning ring relative to the frame base and the sleeve with the sleeve positioned at an intermediate height.
Figure 17:
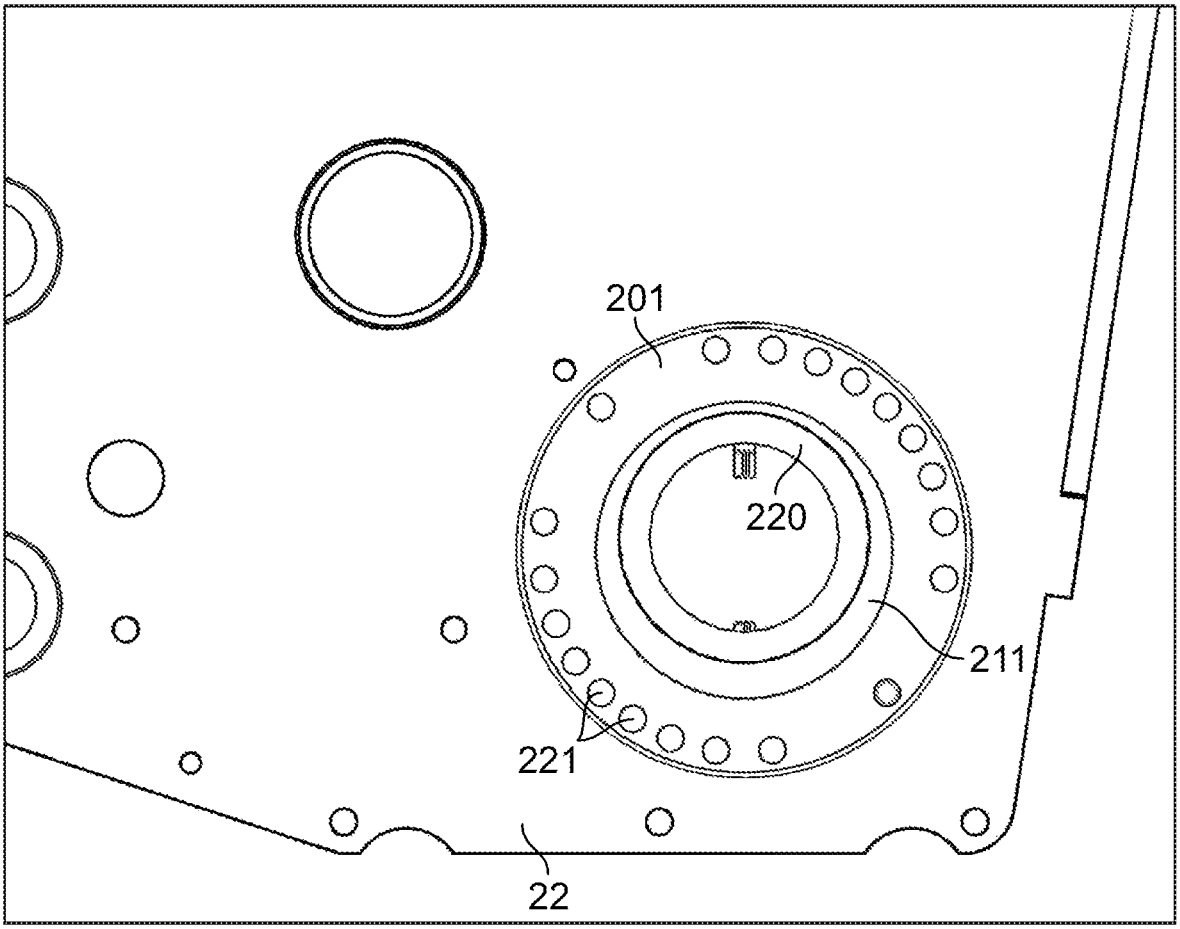
FIG. 17 is an elevated view of the positioning ring relative to the frame base and the sleeve with the sleeve positioned at a maximum height.

Prior to bending conduit 18, if desired, the operator can adjust the height of the inner sleeve 220. This adjustment is sometimes referred to as "squeeze adjustment". To adjust the height of the inner sleeve 220, the operator rotates the positioning ring 201 and joined inner sleeve 220 to an appropriate position and locks the positioning ring 201 and inner sleeve 220 into position relative to the frame base 42 by inserting a fastener through a threaded positioning aperture 221 aligned with the threaded hole in the frame 22. Due to the interaction of the eccentrically shaped bushing 203 and the concentrically shaped inner wall 211 of the ring 201, upon rotation of the inner sleeve 220 and positioning ring 201, the height of the inner sleeve 220 relative to the shoe shaft 44 changes as illustrated in FIGS. 15-17. FIG. 15 illustrates the inner sleeve 220 at a minimum height, i.e. with the greatest distance between the inner sleeve 220 and the shoe shaft 44. FIG. 16 illustrates the inner sleeve 220 at a medium height; and FIG. 17 illustrates the inner sleeve 220 at a maximum height (i.e. with the minimum distance between the inner sleeve 220 and the shoe shaft 44). By varying the height of the inner sleeve 220, excessively high resistive loads can be reduced. Correct positioning of the inner sleeve 220 results in correct positioning of the roller assembly 28 relative to the shoe shaft 44. The adjustment provided by the positioning ring 201 allows the operator to compensate for manufacturing variances in the conduit bender 20 and/or the conduit to be bent.

The roller positioning assembly 32 generally begins in the down position which places the main roller assembly 28 also in a down position. Next, the operator determines if the main roller assembly 28 is to be lifted to an upward position. As noted earlier, FIG. 8 illustrates use of the conduit bender 20 to bend a rigid type conduit. When bending rigid type conduit, additional support rollers are not needed to bend the conduit 18 and therefore the main roller assembly 28 is left in the downward position as shown in FIGS. 8 and 12. As best shown in FIG. 12, in this down position, the lead guide rod 178 which supports the handle 228 of the roller positioning assembly 32, is positioned proximate the lead surfaces 83 of the support members 62*a*-62*e*. In addition, with the main roller assembly 28 in the down position, the roller positioning assembly 32 contacts an arm of the roller positioning switch 226. The roller positioning switch 226 is in electrical communication with the microprocessor 61 and provides a signal COND_SIZE5 738 to the microprocessor 61 indicating that the main roller assembly 28 is in the down position, thereby indicating that the type of conduit to be bent is rigid type conduit.

Once the roller assembly 28 has been properly positioned, next as shown in FIG. 8, the operator aligns a conduit 18 with the appropriately sized conduit passage 213 between the first portion 132 of the shoe 24 and the roller assembly 28. Because the conduit 18 has a two-inch diameter, the conduit 18 is therefore aligned with the two-inch conduit passage 213*a* provided by the first channel 136*a* of the first portion 132 of the shoe 24 and the innermost set of rollers 156*a* of the roller assembly 28. With the conduit 18 aligned with channel 136*a* of the shoe 24 and the innermost set of rollers 156*a*, the conduit 18 will also be aligned between the guide wall 60 and the first support member 62*a* of the support member assembly 52. With the conduit 18 properly positioned, the side wall of the conduit 18 will contact the arc-shaped end surface 128*a* of the lever 102*a*. Contact between the conduit 18 and the lever 102*a* causes the lever 102*a* to rotate about the upper support shaft 46. As the lever 102*a* is rotated, the end surface 117*a* of the second extension 116*a* of the lever 102*a* contacts the arm of the lever switch 92. Contact between the end surface 117*a* of the lever 102*a* with the arm of the lever switch 92, activates the lever switch 92, causing a signal COND_SIZE1 728 to be provided to the microprocessor 61 providing an indication that the conduit 18 to be bent has a diameter of two inches. Contact between the end surface 117*c* of the lever 102*c* with the arm of the lever switch 96 is illustrated in FIG. 11.

The conduit 18 is moved forward within the path defined by the channels 136*a* and the set of rollers 156*a*. When the conduit 18 has been advanced sufficiently forward to position the portion of the conduit 18 at which a bend is be made proximate the shoe 24, the leading portion of the conduit 18 is engaged with the first hook 152*a* of the gripping member 148.

The operator utilizes an input device to indicate the degrees to which the conduit 18 is to be bent and this information is provided to the microprocessor 61. The operator is not required to provide information regarding the characteristics of the conduit 18 to be bent. Rather, this information regarding the characteristics of the conduit to be bent is obtained by the auto-sensing portion 697 of the circuit 699. In particular, with the first portion of the bender shoe 24 positioned proximate the roller assembly 28, the absolute encoder 135 provides signal ENC_DATA signal 726 to the microprocessor 61, identifying the conduit type as IMC or rigid; with the roller assembly 28 positioned in the down position, roller positioning switch 226 provides a signal COND_SIZE5 738 to the microprocessor 61 indicating that the type of conduit to be bent is rigid type conduit; and with the conduit 18 placed within the conduit passage 213 activation of the switch 92 provides a signal, COND_SIZE1 728 to the microprocessor 61 providing an indication that the conduit 18 to be bent has a diameter of two inches. Thus, the microprocessor 61 has all of the conduit characteristic information needed to determine how long and at what speed the motor 26 is to be run in order to provide the appropriate degree of rotation to the shoe 24 to achieve the desired bend.

Thus, without requiring the operator to use look-up tables and without requiring the operator to set dials and/or switches, the microprocessor 61 receives an indication as to the type and diameter of the conduit to be bent. All that is required by the operator is to position the appropriate first or second portion 132, 134 of the shoe 24 next to the roller assembly 28, to position the conduit 18 within the appropriate channel 136/138 of the shoe 24, and finally to place the roller assembly 28 in the up or down position as needed. Each of the steps must be carried out by the operator in order to perform a bending operation and therefore no additional steps are required in order to provide the microprocessor 61 with the information necessary to conduct the bend operation.

With the conduit 18 in place, the operator activates the motor 26 to begin the bend operation. Activation of the motor 26 causes the shoe 24 to rotate via gear 133, and the conduit 18 which is gripped by the gripping member 148 is advanced forward as it is bent around the shoe 24. The two-inch conduit 18 is bent along the channel 136*a* of the first portion 132 of the shoe 24. The rear roller 174 of the innermost set of rollers 156*a* provides a resistive force for the bending operation. If the main roller assembly 28 was placed in the up position for bending, the rear roller 174, the intermediate roller 172 and the lead roller 170 would also provide a resistive force for the bending operation. When the shoe 24 has been rotated to the degree determined by the microprocessor 61, the motor 26 is stopped and rotation of the shoe 24 is completed.

As the shoe 24 is rotated the feedback portion of the circuit 699 of the conduit bender 20 provides signals VBUS MEAS 740 and CURRENTA LEG 750 to the microprocessor 61. As noted above, the microprocessor 61 is configured to utilize these signals 740, 750 to determine the power consumption of the motor 26. Utilizing this information, the microprocessor 61 is configured to adjust the PWM signal to adjust the power provided to the motor in order to increase or decrease the speed of the motor. Adjustment of the PWM signal, therefore, can account for variances in conduit rigidity/elasticity. As the end of the bend operation is approaching, the speed of the motor 26 is gradually decreased, allowing the shoe rotation to stop at the precise end of bending operation without the use of a mechanical brake.

Bending of an IMC type conduit is illustrated in FIG. 11. The bend operation illustrated in FIG. 11 begins by determining which portion of the shoe 24 is to be used for bending the conduit 16. Because the conduit 16 is an IMC type conduit, the operator locates the first portion 132 of the shoe 24 by identifying the first gripping member 148 which has been coded with the color green and positions the first portion 132 of the shoe 24 proximate the main roller assembly 28. With the shoe 24 properly positioned, the relative positions of the magnet 43 and the absolute encoder 135 provide a signal ENC_DATA signal 726 to the microprocessor 61 indicating that the conduit to be bent is one of either IMC type or rigid type conduit.

Figure 19:
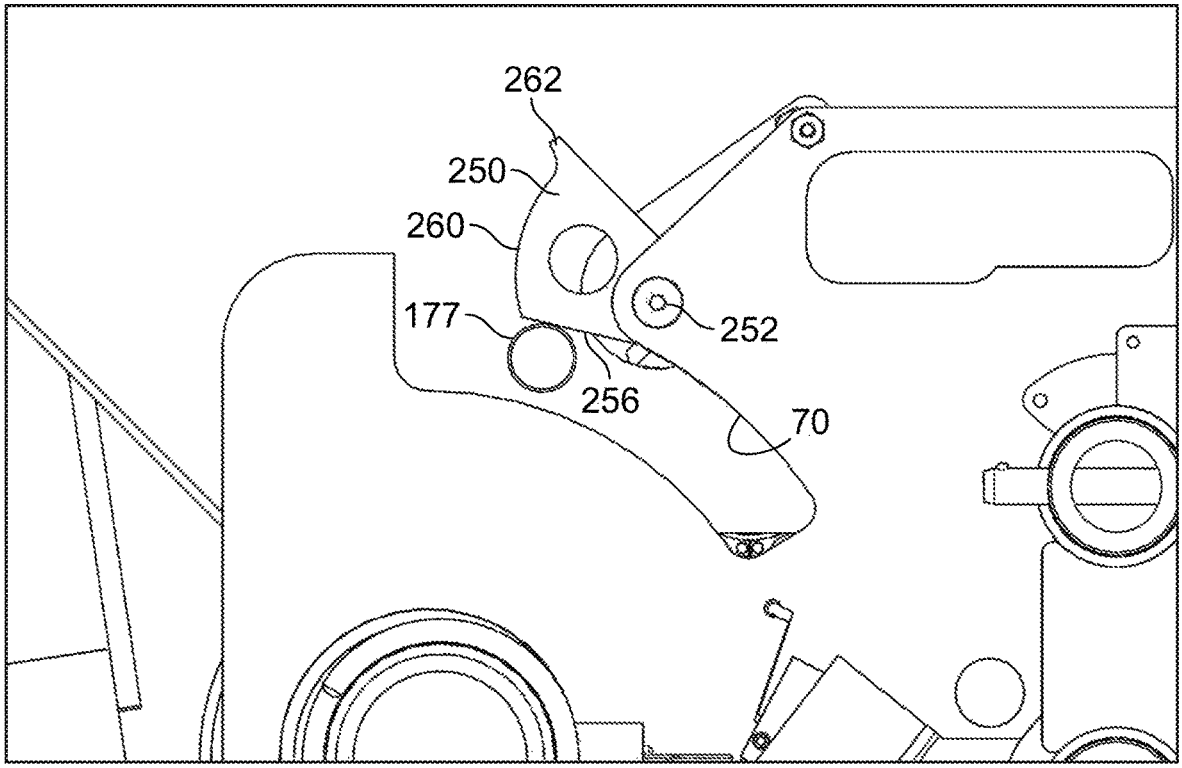
FIG. 19 is an elevated view of the guide wall illustrating the position of the guide shaft relative to the lead guide path and with the guide shaft illustrated in an intermediate position as the roller assembly is lifted and moved to a secured, up, position.
Figure 20:
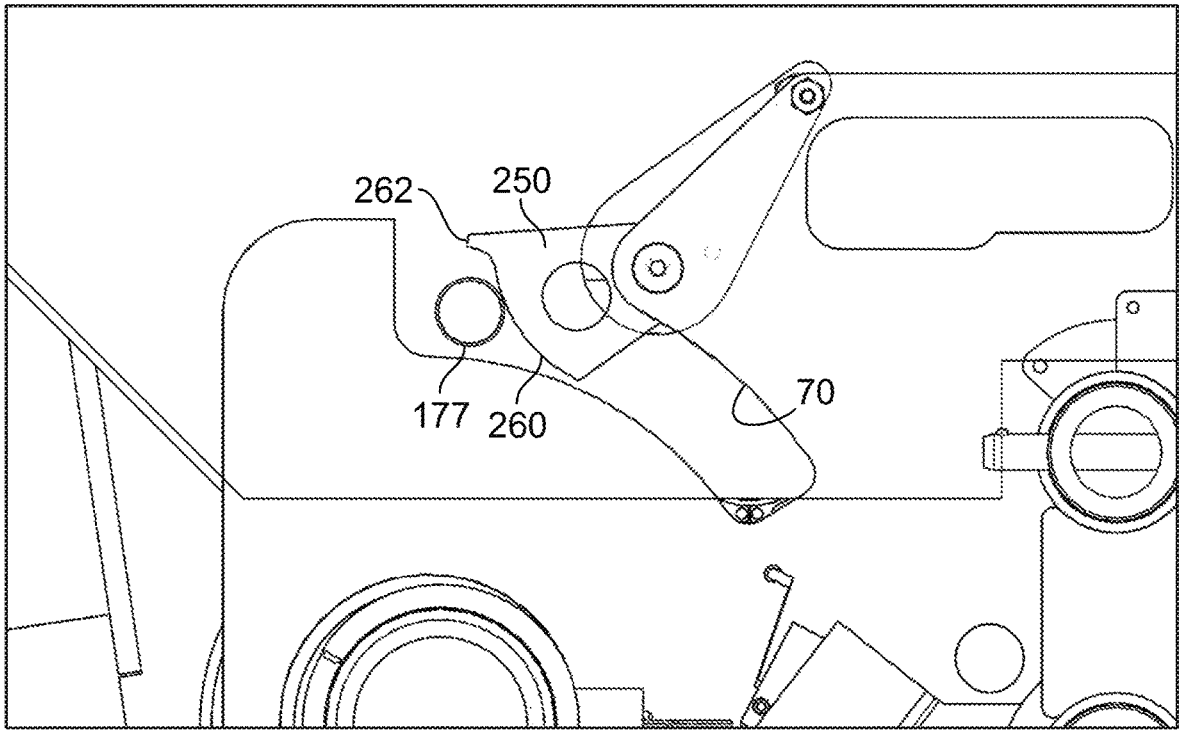
FIG. 20 is an elevated view of the guide wall illustrating the position of the guide shaft relative to the lead guide path and with the roller assembly positioned in a secured "up" position.

Bending of an IMC type conduit requires the use of additional roller support as illustrated in FIG. 11. The operator grasps the handle 228 of the roller positioning assembly 32 and lifts the main roller assembly 28 to the upward position to provide additional support rollers for the bending operation. As the roller positioning assembly 32 is rotated from the down position shown in FIG. 12 to the up position shown in FIG. 11, the first portion 176*a* of the rear guide rod 176 extending within the rear guide path 72 of the guide wall 60 moves forward within the rear guide path 72. In addition, as the main roller assembly 28 is moved from the downward position shown in FIG. 12 to the upward position shown in FIG. 11, the shaft 177 travels along the lead guide path 70 and interacts with the cam 250 as shown in FIGS. 18 to 22. More specifically, the main roller assembly 28 begins in the down position with the shaft 177 positioned at the bottom of the lead guide path 70 as shown in FIG. 18. In this rest position, the cam 250 is positioned such that the first side surface 256 extends approximately across the lead guide path 70 and the protrusion 262 extends to a position approximately equivalent to the 8:00 position on a clock. As handle 228 is rotated in a counter-clockwise direction, the roller assembly 28 is lifted, the shaft 177 begins to move up the lead guide path 70 and will encounter the cam 250 as shown in FIG. 19 and the cam 250 will rotate in a clockwise direction. Once the shaft 177 has moved beyond the first side surface 256 of the cam 250, the cam 250 will begin to rotate counter-clockwise and the arcuate holding surface 260 of the cam and/or the protrusion 262 will engage the shaft 177. With the shaft 177 and the cam 250 so engaged, as illustrated in FIG. 20, the main roller assembly 28 will be secured in the "up" position, preventing the roller assembly 28 from retracting downward. When the main roller assembly 28 is in the up position, the lead guide rod 178, which runs through arms 218 of the roller positioning assembly 32 and through the plates 158, 160, 162, 164, 166, 168 of the main roller assembly 28, is positioned on top of the upper guide surfaces of the support members 62*a*-62*e*.

With the main roller assembly 28 in the up position, the roller positioning assembly 32 does not contact the arm of the roller positioning switch 226. Because no contact is made with the roller positioning switch 226, the signal COND_SIZE5 738 is not provided to the microprocessor 61. As a result, the state of the main roller assembly 28 is known to the microprocessor 61 to be in the up position, thereby indicating that the type of conduit to be bent is IMC type conduit.

Next, the operator aligns the conduit 16 with the appropriately sized channel 136 of the shoe 24. As shown in FIG. 11, the conduit 16 has a one and one-quarter inch diameter and is therefore aligned with the third channel 136*c* of the first portion 132 of the shoe 24. With the conduit 16 aligned with channel 136*c* of the shoe 24, the conduit 16 will also be aligned with the outermost set of rollers 156*c* of the main roller assembly 28 and between the fourth and fifth support members 62*d*, 62*e* of the support member assembly 52. With the conduit 16 positioned within the channel 136*c*, the side wall of the conduit 16 will contact the arc-shaped end surface 128*c* of the lever 102*c*. Contact between the conduit 16 and the lever 102*c* causes the lever 102*c* to rotate about the upper support shaft 46. As the lever 102*c* is rotated, the end surface 117*c* of the second extension 116*c* of the lever 102*c* contacts the arm of the lever switch 96. Contact between the end surface 117*c* of the lever 102*c* with the arm of the lever switch 96 causes a signal COND_SIZE4 732 to be provided by the lever switch 96 to the microprocessor 61 providing an indication that the conduit 16 to be bent has a diameter of one and one-quarter inches.

The conduit 16 is then moved forward within the path defined by the channel 136*c* and the set of rollers 156*c*. When the conduit 16 has been advanced sufficiently forward to position the portion of the conduit 16 at which a bend is be made proximate the shoe 24, a leading portion of the conduit 16 is engaged with the third hook 152*c* of the gripping member 148.

Thus, without requiring the operator to use look-up tables and without requiring the operator to set dials and/or switches, the microprocessor 61 receives an indication as to the type and size of the conduit 16 to be bent. All that is required by the operator is to position the shoe 24 for bending, to position the conduit 16 within the appropriate channel 136*c* of the shoe 24, and to place the main roller assembly 28 in the up position. Each of these steps must be carried out by the operator in order to perform a bending operation and therefore no additional steps are required in order to provide the microprocessor 61 with the conduit characteristic information necessary to determine the degree to which the shoe 24 is to be rotated to perform the bend operation.

Based upon the information received from the absolute encoder 135, the lever switch 96, and the roller positioning switch 226, the microprocessor 61 is configured to determine the degree to which the shoe 24 will be rotated during the bend operation. With the conduit 16 in place, the operator activates the motor 26 to begin the bend operation. Upon activation of the motor 26, the shoe 24 will rotate via gear 133 and the conduit 16, which is gripped by the gripping member 148, is bent along the channel 136*c* of the first portion 132 of the shoe 24. The rear roller 190 and the lead roller 188 of the outermost set of rollers 156*c* provide a resistive force for the bending operation. Similar to the bending operation for the conduit 18 described above, during the bending operation, the feedback portion 695 of the circuit 699 provides the signals VBUS MEAS 740 and CURRENT A LEG 750 to the microprocessor 61. The microprocessor 61 utilizes these signals to determine power consumption of the motor 26. The microprocessor 61 adjusts the PWM signal 711 based upon the feedback information to determine the stop point for the bend operation. When the bend operation is complete, the PWM signal 711 is terminated to stop rotation of the shoe 24.

After the shoe 24 has been rotated to bend the conduit 16, 18, the conduit 16, 18 is removed from the conduit bender 20. Upon removal of the conduit 16, 18, any lever switch 92, 94, 96 which had been previously rotated in a rearward direction is returned to the upright position as a result of the force provided by the lever springs 104*a*, 104*b*, 104*c*.

Figure 21:
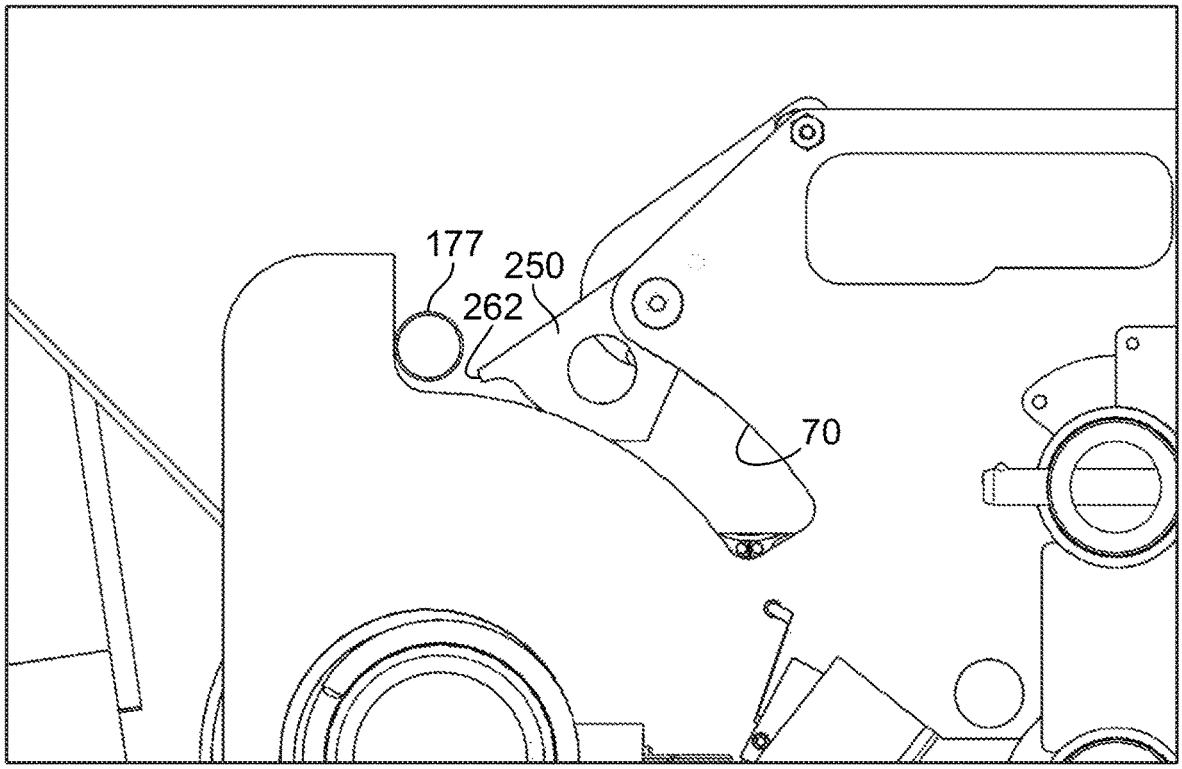
FIG. 21 is an elevated view of the guide wall illustrating the position of the guide shaft relative to the lead guide path with the guide shaft moved further up the guide path relative to FIG. 20 and with the cam disengaged.
Figure 22:
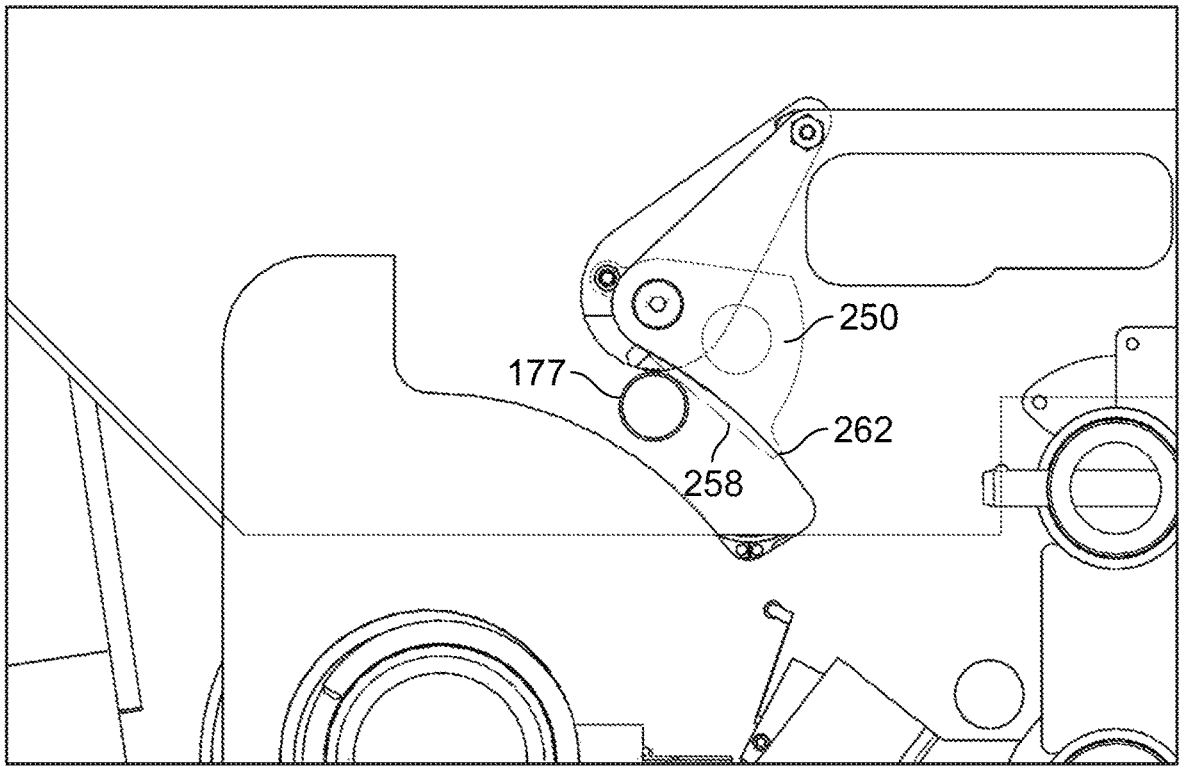
FIG. 22 is an elevated view of the guide wall illustrating the position of the guide shaft relative to the lead guide path with the guide shaft moved downward along the guide path as the roller assembly is lowered relative to FIG. 20 and with the cam disengaged.

Upon completion of the bend, if the operator wishes to lower the main roller assembly 28, the handle 228 is again rotated in the counter-clockwise direction moving the shaft 177 further up the lead guide path 70. As the shaft 177 moves further up the lead guide path 70 the cam 250 rotates in a clockwise direction until the shaft 177 clears the protrusion 262 of the cam 250. Upon clearing the protrusion 262, the cam 250 will begin to rotate counter-clockwise and the shaft 177 will reach the upper end of the lead guide path 70. Once the shaft 177 has cleared the protrusion 262 of the cam 250, the cam 250 will rotate clockwise until it again reaches the rest position with the protrusion 262 positioned at approximately 8:00 as shown in FIG. 21. The handle 228 is then rotated in the clockwise direction. As the handle 228 is rotated the shaft 177 will move down the lead guide path 70 and will abut the second side surface 258 of the cam 250 causing the cam to rotate in a counter clockwise direction as shown in FIG. 22. The shaft 177 will continue to move down the lead guide path 70 until it reaches the lower end of the lead guide path 70. As the shaft 177 moves downward, the cam 250 will continue to rotate in a counterclockwise direction until the shaft 177 clears the second side surface 258 and the protrusion 262. Once the shaft 177 has cleared the cam 250, the cam 250 will return to its rest position as shown in FIG. 18.

Use of the conduit bender 20 to bend one-inch diameter conduit varies from the bending processes described above as follows. If the operator wants to bend a conduit having a diameter of one inch, the operator first positions the appropriate portion 132, 134 of the shoe 24 proximate the main roller assembly 28. With the shoe 24 properly positioned, the operator then aligns the one-inch conduit with the outermost channel (either 136*d* or 138*d*) of the shoe 24. Upon aligning the conduit with the outermost channel (either 136*d* or 138*d*), the conduit will rest upon the roller 208 of the auxiliary roller assembly 30. The operator then moves the conduit forward until the conduit is appropriately gripped by either the outermost hook 152*d* of the gripping member 148 or the outermost hook 154*d* of the gripping member 150.

When the conduit is properly positioned, the operator activates the motor 26 to begin rotating the shoe 24. The microprocessor 61 determines the degree to which the shoe 24 is to be rotated based upon information received from the absolute encoder 135, the lever switches 92, 94, 96, and the roller positioning switch 226. When a one-inch conduit is bent, the microprocessor 61 will receive the signal from the absolute encoder 135 which identifies the one-inch conduit as either IMC or Rigid or as EMT. A lever switch 92, 94, 96 is not associated with the outermost channel 136*d* or 138*d* of the shoe 24, therefore if the microprocessor 61 does not receive an indication that one of the switches 92, 94 or 96 has been activated, the microprocessor 61 is configured to recognize that a one-inch conduit is to be bent. When bending one-inch sized conduit, the roller positioning assembly 32 is not utilized and thus, no indication is provided as to whether IMC or Rigid type conduit is to be bent by the conduit bender 400. The feedback portion of the circuit 699 described above, however, provides the necessary information. By monitoring the power consumption of the motor 26, the rigidity of the conduit can be detected, and the PWM signal can be adjusted as required to adjust the power delivered to the motor 26.

As described, lever switches 92, 94, and 96 are respectively associated with two inch, one and one-half inch, and one and one-quarter inch conduits and no lever switch is associated with one-inch conduits. Thus, only three lever switches are needed to properly identify four sizes of conduit. Although in the embodiment shown, no lever switch is associated with one-inch conduits, it is to be understood that any one of the conduit sizes could be chosen as the conduit size which does not have a lever switch associated with it. For example, lever switches could be associated with one and one-half inch, one and one-quarter inch and one-inch conduits and no lever switch would be necessary in connection with two-inch conduits.

A pivoting assembly 300 for pivoting the frame 22 and the components of the conduit bender 20 mounted thereon is provided between the base 31 and the frame 22. The assembly 300 permits the shoe 24 to be mounted in the vertical position shown in FIG. 1, or rotated to a horizontal position, wherein the shoe 24 is perpendicular to the position shown in FIG. 1 (i.e. the tabletop configuration). Pivoting between the horizontal and vertical positions will be described in connection with the second embodiment of the conduit bender 400. It is to be understood that pivoting of the conduit bender 20 occurs in the same manner as pivoting of the conduit bender 400. A handle 302 is attached to the frame 22 to facilitate pivoting the frame 22 and the components of the conduit bender 20 relative to the base 31 between the horizontal and vertical positions. The handle 302 can also be utilized when rolling the conduit bender 20 on the wheels 33, 35 to transport the conduit bender 20 to a new location.

The unitary construction of the first portion 22' of the frame 22 provides fixed relative positions of the shoe shaft 44, the upper support shaft 46, the lower support shaft 48, and the lead support shaft 50, thereby providing fixed relative positions of the shoe 24 and the roller assembly 28, for example. This fixed position, allows for greater control and consistency in bending the conduit, as this dimension does not vary. In contrast, benders which provide roller assemblies mounted to a base member separate from the frame which supports the shoe shaft, may be subject to variation in the dimension between the shoe shaft and the roller assemblies. This variation may occur, for example, as a result of transporting the bender. If, for example, as the bender is transported between locations, the base member is jarred, an altered dimension between the shoe shaft and the roller assembly may result which in turn effects the bending operation.

A second embodiment of the conduit bender 400 is illustrated in FIGS. 23-26 and 29-33. The conduit bender 400 is similar to the conduit bender 20 except as described herein. Similar to the conduit bender 20, the conduit bender 400 generally includes a frame 402, a shoe 404 mounted on a shoe shaft 444, a main roller assembly 406, an auxiliary roller assembly 408 and a roller positioning assembly 410. The frame 402 includes a frame base 418. The shoe 404, the main roller assembly 406, the auxiliary roller assembly 408, and the roller positioning assembly 410 are cantilevered on the frame 402. The conduit bender 400 utilizes electronic circuit identical to the electronic circuit 699 associated with the conduit bender 20.

Figure 26:
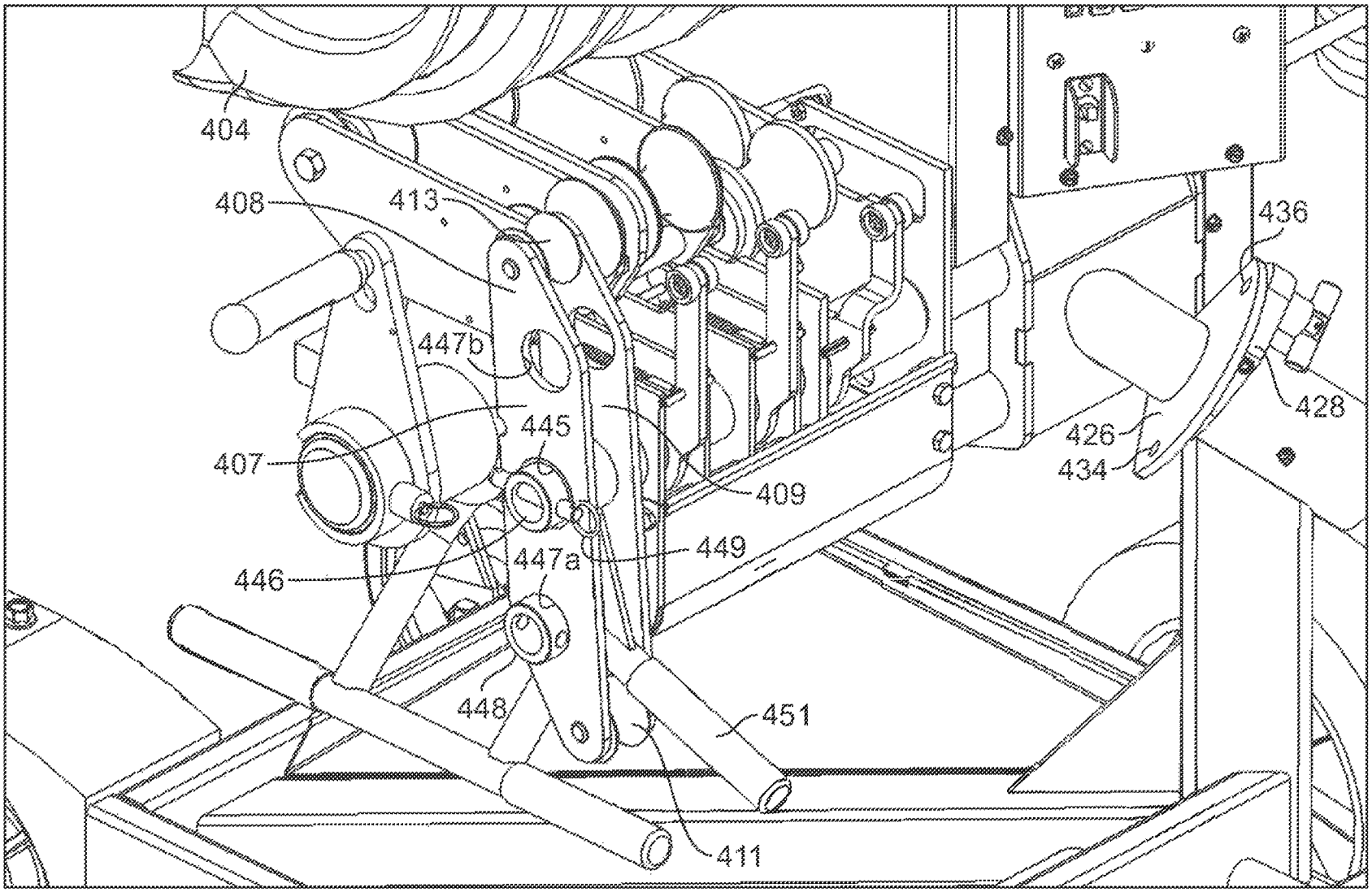
FIG. 26 is a perspective view of a portion of the bender of FIG. 23.

The auxiliary roller assembly 408 of the conduit bender 400 varies from the auxiliary roller assembly 30 of the conduit bender 20. As best shown in FIG. 26, the auxiliary roller assembly 408 of the conduit bender 400 includes a first plate 407, a second plate 409, a first support roller 411, a second support roller 413, and a handle 451. A pair of upper support shaft apertures 445 is provided proximate the center of the first and second plates 407, 409. A first pair of lower support shaft apertures 447*a* and a second pair of lower support shaft apertures 447*b* are spaced from opposite ends of the first and second plates 407, 409. The upper support shaft 446 extends through the pair of upper support shaft apertures 445. The auxiliary roller assembly 408 is positioned so as to position the lower support shaft 448 through either the first or second pair of lower support shaft apertures 447*a*, 447*b*. As shown in FIG. 26, the lower support shaft 448 is positioned within the first pair of lower support shaft apertures 447*a* and the second support roller 413 is positioned proximate the shoe 404 to provide a resistive force for the bending operation. The handle 451 is positioned between the first plate 407 and the second plate 409 and provides a location for the user to grip the conduit bender 400 when transporting the conduit bender 400 between locations.

A retaining pin 449 is provided at the outer end of the upper support shaft 446 to secure the auxiliary roller assembly 408 to the frame 402. Upon removal of the retaining pin 449, the roller assembly 408 can be dismounted from the frame 402 by sliding the assembly 408 off the free ends of the upper and lower support shafts 446, 448. Once removed from the upper and lower support shafts 446, 448, the roller assembly 408 is inverted, and the handle 451 is placed between the first and second plates 407, 409 proximate the second pair of lower support shaft apertures 447*b* to remount the assembly 408, the upper support shaft 446 is again positioned within pair of upper support shaft apertures 445 and the lower support shaft 448 in positioned within the second pair of lower support shaft apertures 447*b*. When the lower support shaft 448 extends through the second pair of lower support shaft apertures 447*b*, the first support roller 411 is positioned proximate the shoe 404 to provide a restive force for the bending operation. When the support roller 411 is positioned proximate the shoe 404, the angle at which the conduit is positioned for bending is different than the angle at which the conduit is positioned for bending when the support roller 413 is positioned proximate the shoe 404. Preferably, a difference of three degrees is provided between the angles provided by the rollers 411 and 413. The different angles provide proper positioning of different types of conduit. For example, one of the support rollers 411, 413 is placed proximate the shoe 404 for bending rigid type conduit and the other roller 411, 413 is placed proximate the shoe 404 for bending IMC type conduit.

As discussed above with respect to the conduit bender 20, the feedback portion 695 of the circuit 699 is utilized to monitor power consumption of the motor 26. By monitoring the power consumption of the motor 26, the PWM signal 711 can be adjusted accordingly to provide the appropriate bend to the one-inch conduit, regardless of the type of conduit inserted in the bender.

The conduit bender 400 is mounted to a base 412. The base 412 includes a pair of lead wheels 414 and a pair of rear wheels 416 which allow the conduit bender 400 to be transported easily between locations.

Figure 23:
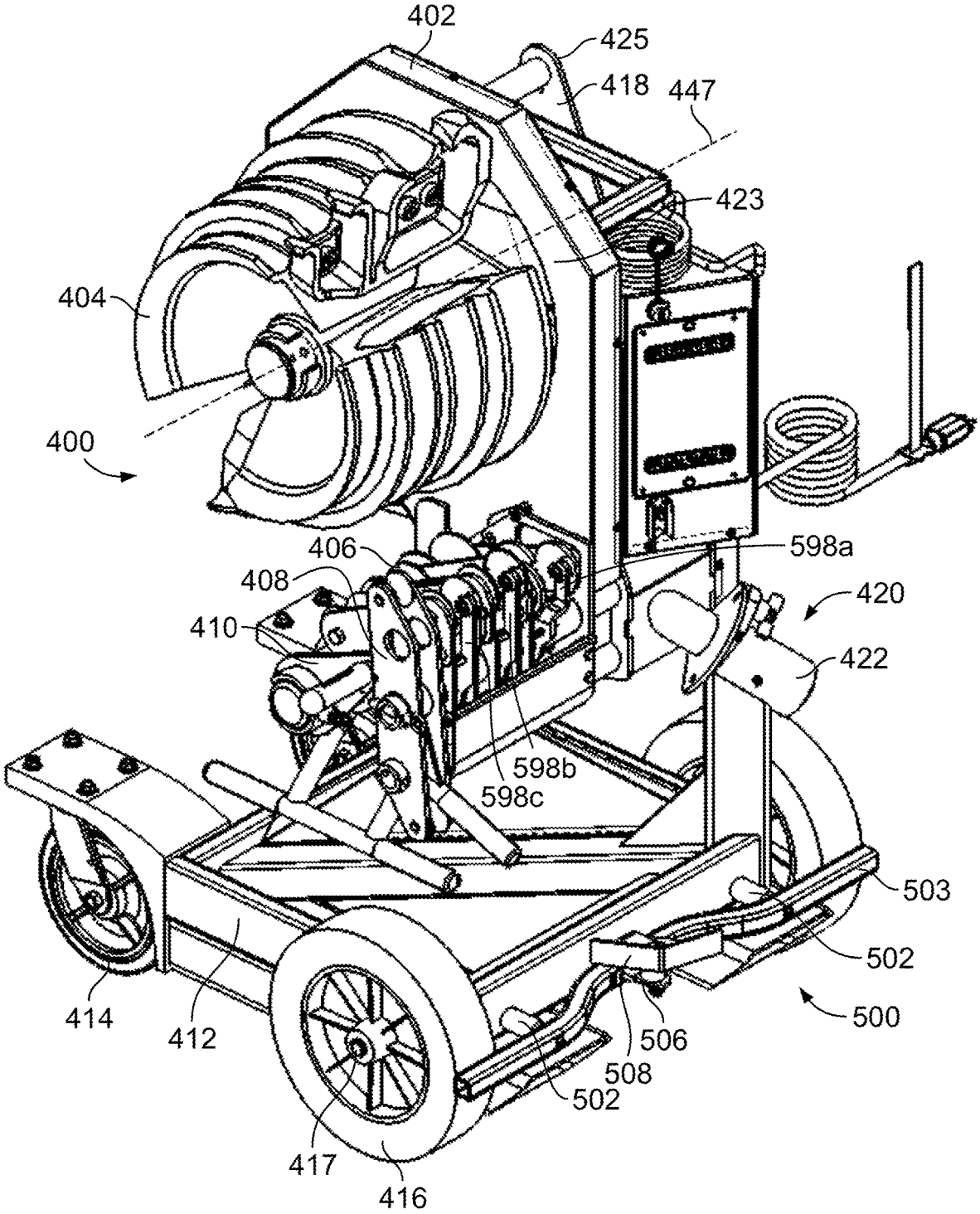
FIG. 23 is a perspective view of a second embodiment of the bender and base assembly.
Figure 24:
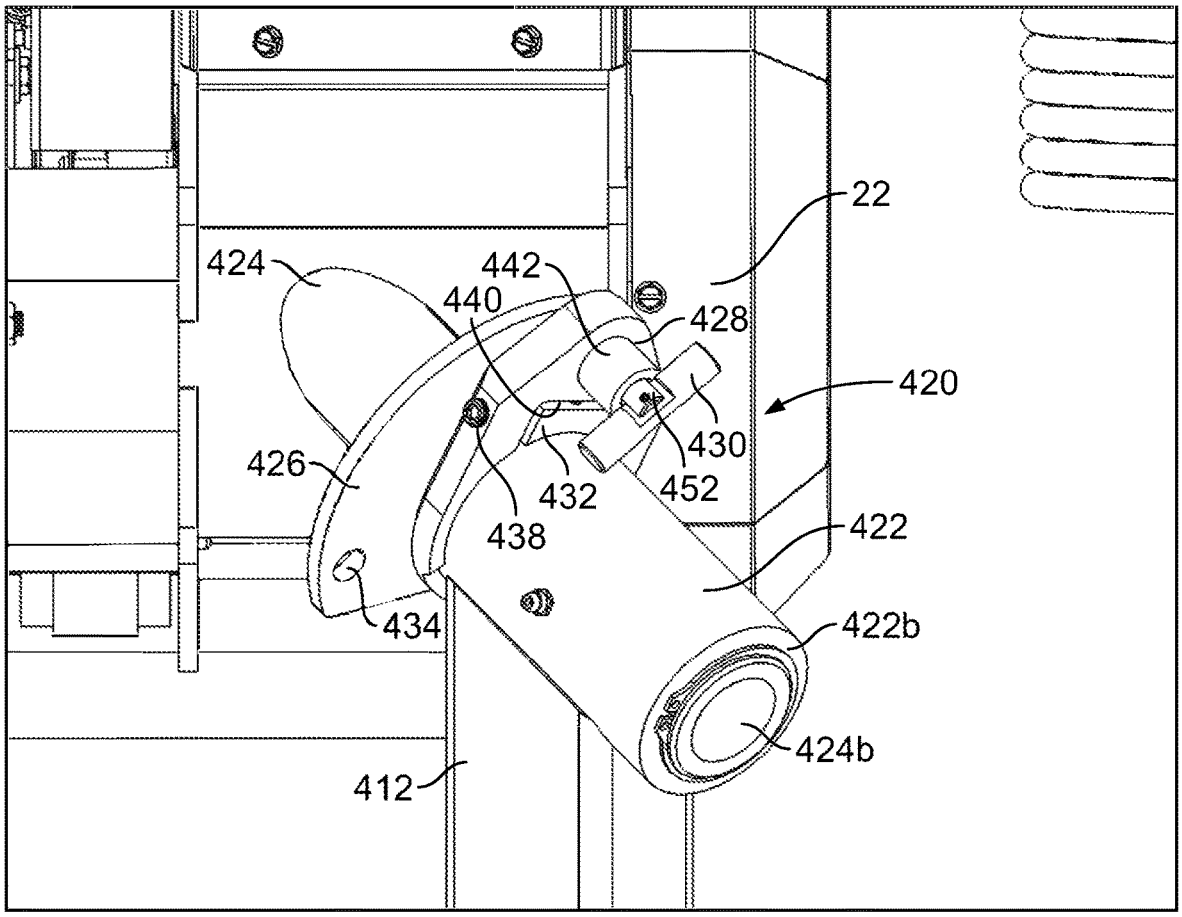
FIG. 24 is a perspective view of a portion of the bender and base illustrated in FIG. 23.
Figure 25:
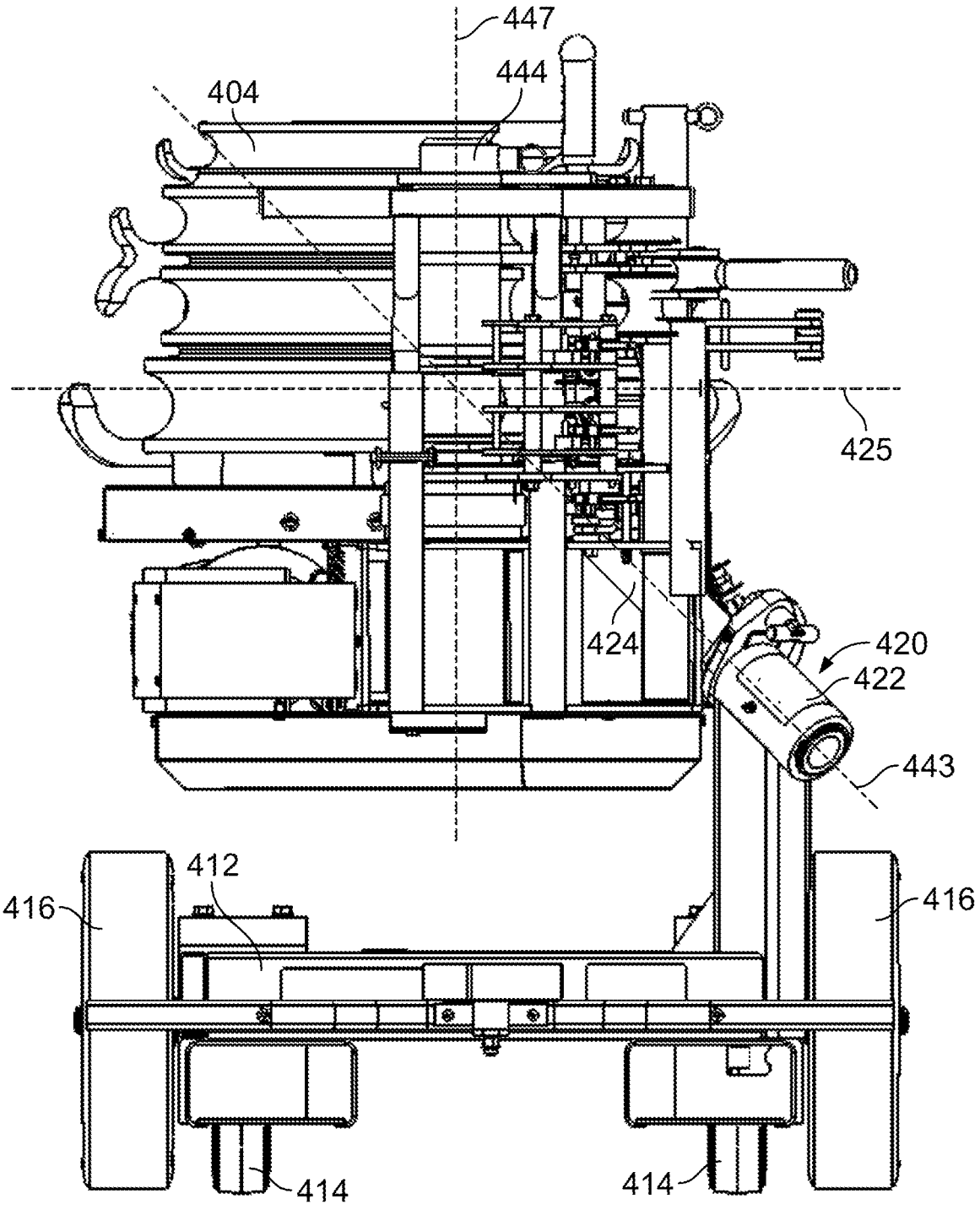
FIG. 25 is an elevated view of the bender and base assembly of FIG. 23 with the bender illustrated in a horizontal position.

The conduit bender 400 includes a pivoting assembly 420. As best illustrated in FIGS. 23-25, the pivoting assembly 420 is generally provided by a shaft receptacle 422, a detent bracket 428, a locking pin 452, a release handle 430, and a detent adjustment stop 432 each of which are mounted to the base 412 and a pivot shaft 424 and an index plate 426 each of which are mounted to the conduit bender 400.

The pivot shaft 424 is cylindrically-shaped and is fixed to the frame 402. The pivot shaft 424 defines pivot axis 443. Preferably the pivot shaft 424 includes a first end positioned between first and second plates 54, 56 of the frame base 418, and an opposite free end 424*b*. As best shown in FIG. 24, the index plate 426 extends perpendicular to the pivot shaft 424 and is fixedly attached to the pivot shaft 424. The index plate 426 is generally planar and semi-circularly shaped. As best shown in FIG. 26, the index plate 426 includes first and second locking apertures 434, 436 spaced from an outer edge of the index plate 426. An angle of approximately 120 degrees extends between the first and second locking holes 434, 436.

The shaft receptacle 422 is secured to the base 412. The shaft receptacle 422 is generally tubular-shaped and includes an upper end (not shown) and lower end 422*b*. As illustrated in FIG. 25, the shaft receptacle 422, defines a pivot axis aligned with the pivot axis 443 of the pivot shaft 424. The pivot axis 443 intersects with a plane 425 which is perpendicular to the axis 447 defined by the shoe shaft 444 when the conduit bender 400 is in a horizontal bending position. As illustrated in FIG. 23, the pivot axis 443 also intersects with a plane 425 perpendicular to the shoe shaft axis 447, when the conduit bender 400 is in a vertical bending position. As shown in FIG. 25, the pivot axis 443 is provided at an angle of approximately 45 degrees angle relative to the perpendicular plane 425.

The detent bracket 428 is rotatably mounted at an upper end of the shaft receptacle 422. The detent bracket 428 includes a recess 440 which receives the detent adjustment stop 432. The generally rectangularly-shaped detent adjustment stop 432 extends perpendicularly from the outer surface of the shaft receptacle 422 and is permanently affixed thereto. Interaction between the recess 440 and the detent adjustment stop 432 limits rotation of the detent bracket 428 relative to the shaft receptacle 422. This limited rotation allows for fine tune adjustment of the position of the detent bracket 428, and thus the position of locking pin 452 relative to the shaft receptacle 422 to ensure proper alignment between the conduit bender 400 and the base 412 despite manufacturing tolerances. Set screws 438, one of which is shown, fix the position of the detent bracket 428 relative to the shaft receptacle 422.

A locking pin sleeve 442 extends from the detent bracket 428. The locking pin 452 is positioned within the locking pin sleeve 442 and the release handle 430 is fixed to an upper end of the locking pin 452. The locking pin 452 is slidably mounted within the locking pin sleeve 442. A spring (not shown) is provided to bias the locking pin 452 towards the index plate 426. When the locking pin 452 is aligned with a locking aperture 434, 436 of the index plate 426, the locking pin 452 extends through the aligned locking aperture 434, 436 of the index plate 426 to lock the position of the conduit bender 400 relative to the base 412.

To pivot the conduit bender 400 from the vertical position as shown in FIG. 23 to horizontal position shown in FIG. 25, the user begins by pulling on the handle 430 to disengage the locking pin 452 from the second locking aperture 436. With the pin 452 disengaged, the pivot shaft 424 of the conduit bender 400 (along with the conduit bender 400) is free to rotate within the shaft receptacle 422. The conduit bender 400 is rotated approximately 120 degrees until the shoe axis 447 is vertically positioned as shown in FIG. 25 and the locking pin 452 is aligned with the first locking aperture 434. When the locking pin 452 is aligned with the first locking aperture 434, the user releases the handle 430 and the locking pin 452 slides within the sleeve 442 under the action of the spring until the locking pin 452 extends through the first locking aperture 434 of the index plate 426 to fix the position of the conduit bender 400 relative to the base 412.

Figure 27A:
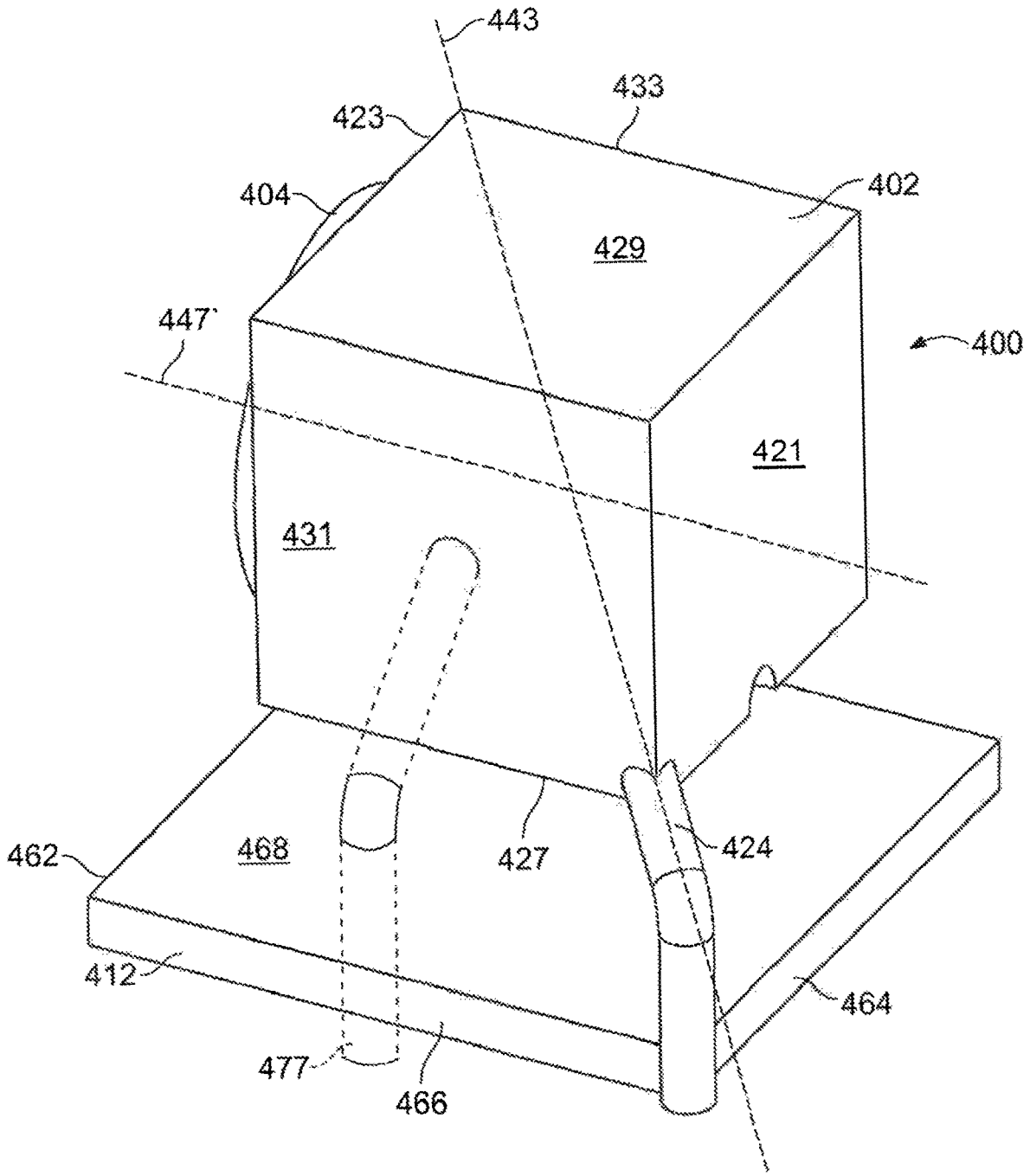
FIGS. 27*a*-27*c* are simplified block diagrams of a portion of the bender assembly of FIG. 23 illustrating the pivoting feature of the bender assembly.
Figure 27B:
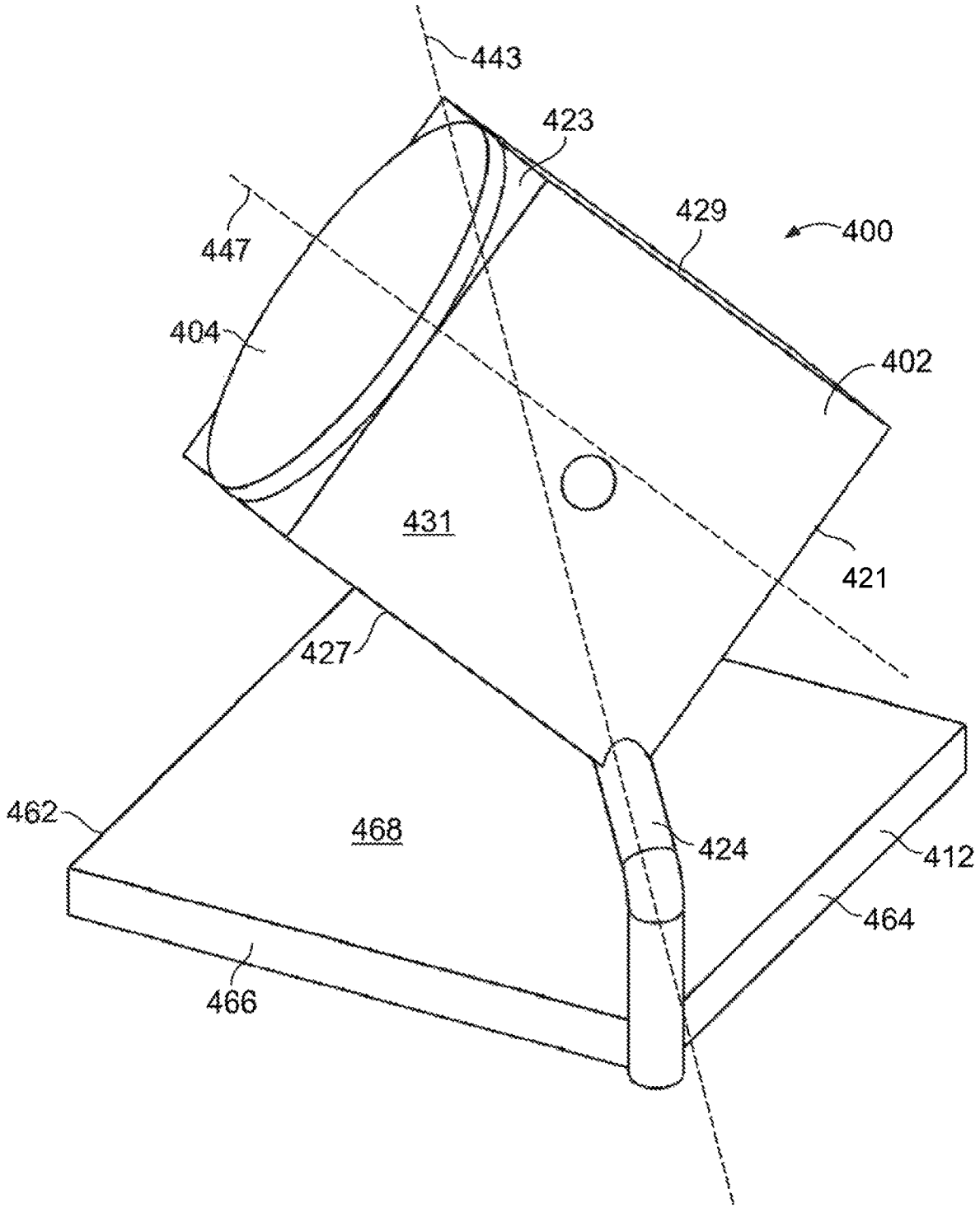
Figure 27C:
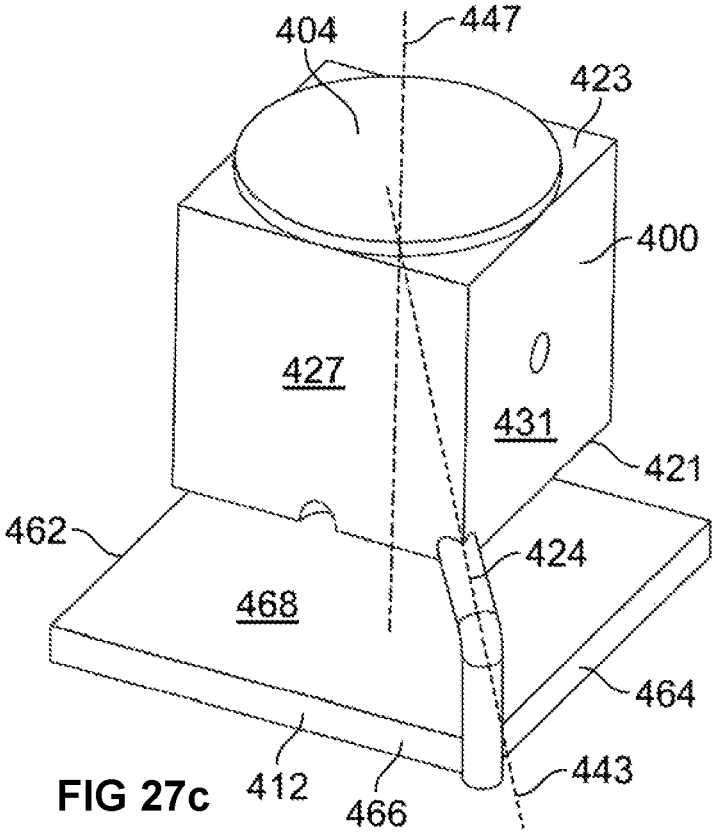

FIGS. 27*a*-27*c* provide a simplified illustration of the conduit bender 400, the base 412 and the pivot shaft 424 to illustrate the pivoting motion of the conduit bender 400 relative to the base 412. As shown in FIG. 27*a* the conduit bender 400 is positioned above a base 412. The conduit bender 400 includes a shoe 404 mounted on a shoe shaft defined by axis 447 proximate a frame face 423. The pivot shaft 424 defines a pivot axis 443. Frame back 421 is provided opposite the frame face 423. Frame bottom 427 extends between frame face 423 and frame back 421. A frame top 429 is provided opposite the frame bottom 427. A rear frame side 431 is provided which is perpendicular to the frame face 423 and the frame back 421. A frame side 433 is provided opposite the frame side 431.

The base 412 includes an outer surface 462, and inner surface 464 opposite to the outer surface 462, a rear surface 466 perpendicular to the outer and inner surfaces 462, 464, and an upper surface 468 perpendicular to the outer, inner and rear surfaces 462, 464, 466.

A centrally positioned pivot axis 477 is illustrated in FIG. 27 shown in phantom lines. This centrally positioned pivot axis 477 illustrates the typical location of a pivot axis for a conduit bender having two shoes wherein the center of gravity of the conduit bender is provided at a position proximate the center of the frame 402. The centrally positioned pivot axis 477 generally extends parallel to a plane perpendicular to the shoe shaft 444 (i.e. a plane parallel to the frame face 423). The centrally positioned pivot axis 477 also generally extends parallel to the frame bottom 427. The conduit bender 400, however, provides a single shoe 404 mounted to the frame 402. The center of gravity of the conduit bender 400, therefore is not located at or near the center of the frame 402. An angled pivot shaft 424 provides a pivotal connection between the frame 402 and the base 412 and defines a pivot axis 443. More specifically, the pivot axis 443 extends generally at an angle of 45 degrees from the frame back 421 to the frame face 423, at an angle of 45 degrees from the frame bottom 427; and at an angle of 45 degrees from side 431 to side 433. The pivot axis 443 extends at an angle of 45 degrees relative to the surface 468 of the base 412.

As the conduit bender 400 is rotated, the conduit bender 400 moves through the intermediate position illustrated in FIG. 27*b* to the position illustrated in FIG. 27*c*. Upon completion of the pivot, as shown in FIG. 27*c*, frame face 423 along with the shoe 404 of the conduit bender 400 will be facing upward, the side 431 of the conduit bender 400 will be aligned with the inner surface 464 of the base 412, and the frame back 421 of the conduit bender 400 will be proximate the upper surface 468 of the base 412.

Rotation of the conduit bender 400 as illustrated in FIGS. 27*a*-27*c* results in the conduit bender 400 being rotated about the pivot axis 443 one hundred twenty degrees. Rotation of the conduit bender 400 on the angled pivot axis 443 allows the pivot load bearing area to be located where it will not interfere with the conduit bending process and at the same time the pivot axis 443 is positioned close to the center of gravity of the conduit bender 400. Therefore, the effort needed to pivot the conduit bender 400 between the horizontal and vertical positions is reduced.

Figure 28A:
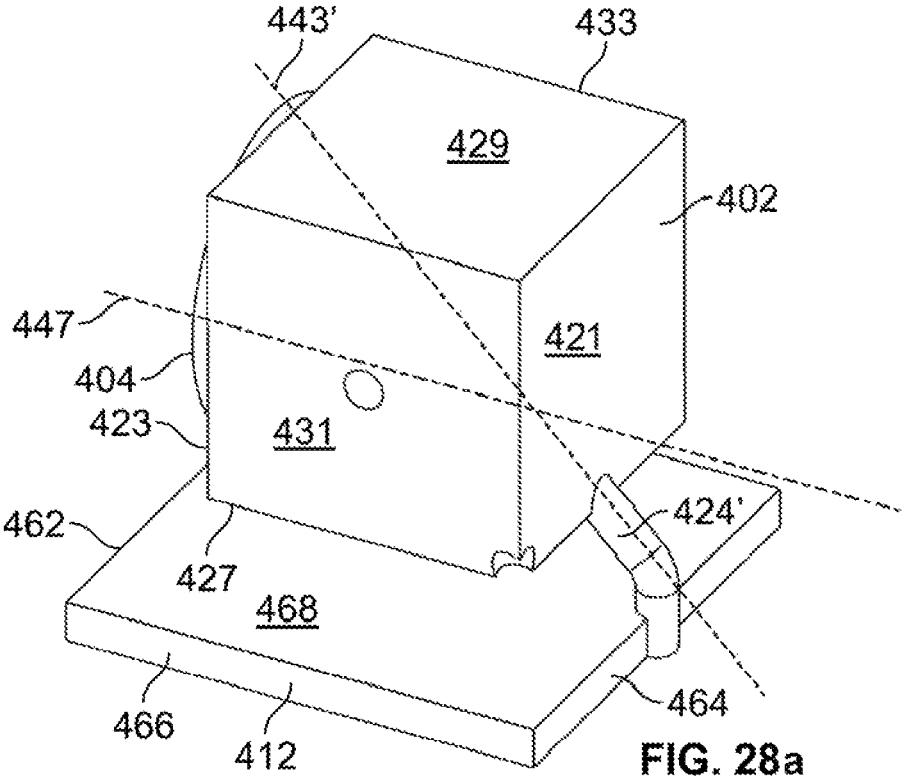
FIGS. 28*a*-28*c* are simplified block diagrams of an alternate bender assembly illustrating an alternate pivoting feature.
Figure 28B:
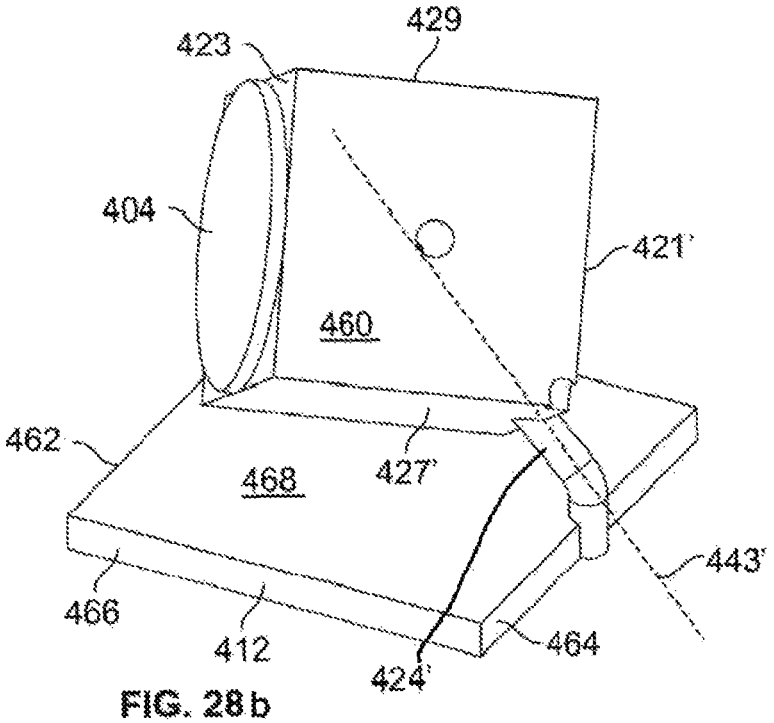
Figure 28C:
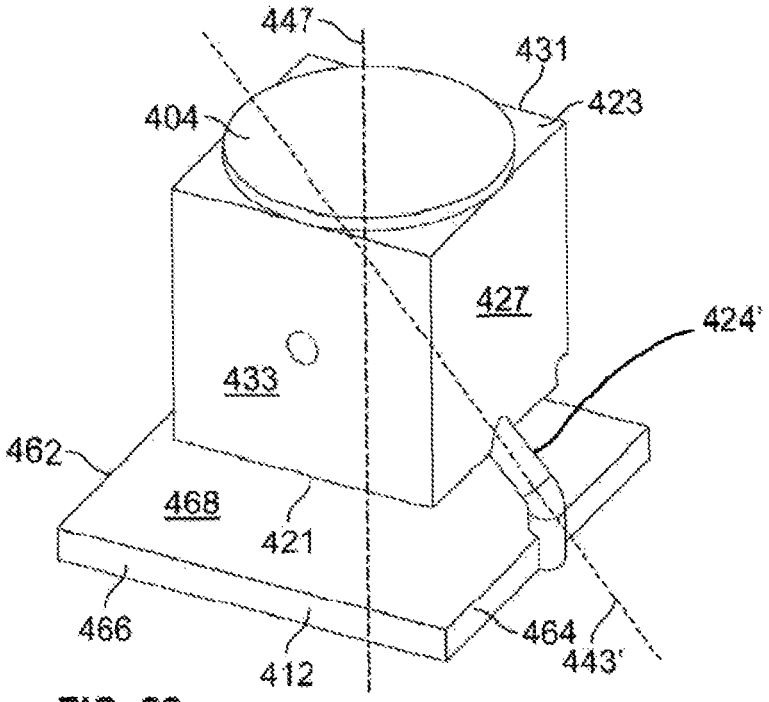

Similar to FIGS. 27*a*-27*c*, FIGS. 28*a*-28*c* illustrate a simplified version of the conduit bender 400 and the base 412. In FIGS. 28*a*-28*c*, the pivot shaft 424' is positioned at an alternate location and an alternative pivoting motion of the conduit bender 400 relative to the base 412 is illustrated. The angled pivot shaft 424' extends from the frame back 421 of the conduit bender 400 and at an angle of approximately 45 degrees relative to the frame back 421. The angled pivot shaft 424' extends from an edge at the intersection of the frame back 421 and the frame bottom 427. The pivot shaft 424' defines a pivot axis 443'.

As the conduit bender 400 is rotated, the conduit bender 400 moves through the intermediate position illustrated in FIG. 28*b* to the position illustrated in FIG. 28*c*. Upon completion of the pivot, as shown in FIG. 28*c*, the frame face 423 of the conduit bender 400 with the shoe 404 attached thereto will be facing upward; the frame side 433 of the bender will be aligned with the rear surface 466 of the base 412, and the frame bottom 427 of the bender will be aligned with the inner surface 464 of the base 412.

Rotation of the conduit bender 400 about the axis 443' as illustrated in FIGS. 28*a*-28*c* results in rotation of the conduit bender 400 approximately one hundred eighty degrees about the axis 443'. Rotation of the bender on the angled axis 443' allows the pivot load bearing area to be located where it will not interfere with the conduit bending process and at the same time the pivot axis 443' is positioned close to the center of gravity of the conduit bender 400. Therefore, the effort needed to pivot the conduit bender 400 between the horizontal and vertical positions is reduced.

Figure 29:
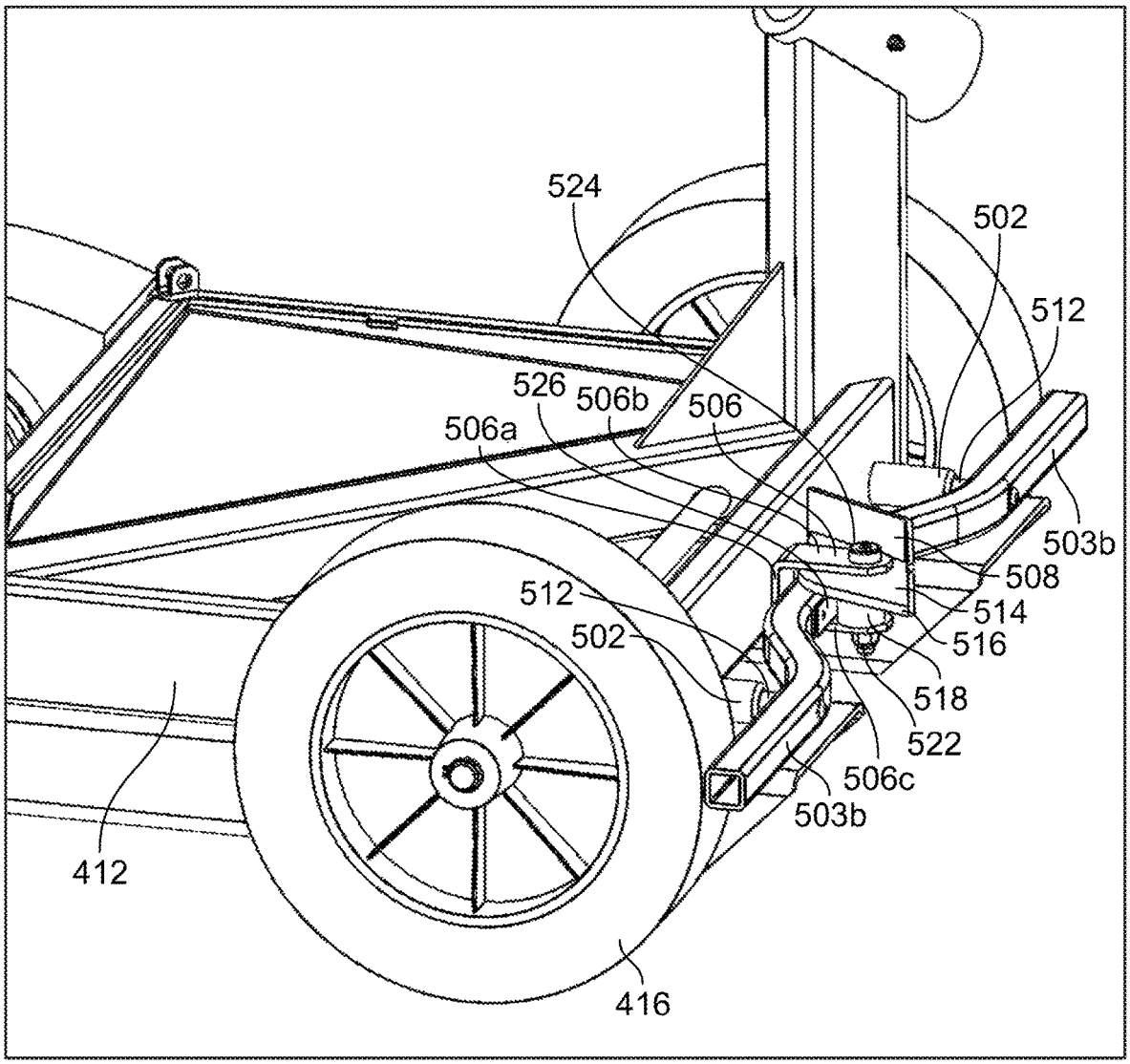
FIG. 29 is a perspective view of the bender of FIG. 23 illustrating the braking mechanism.
Figure 30:
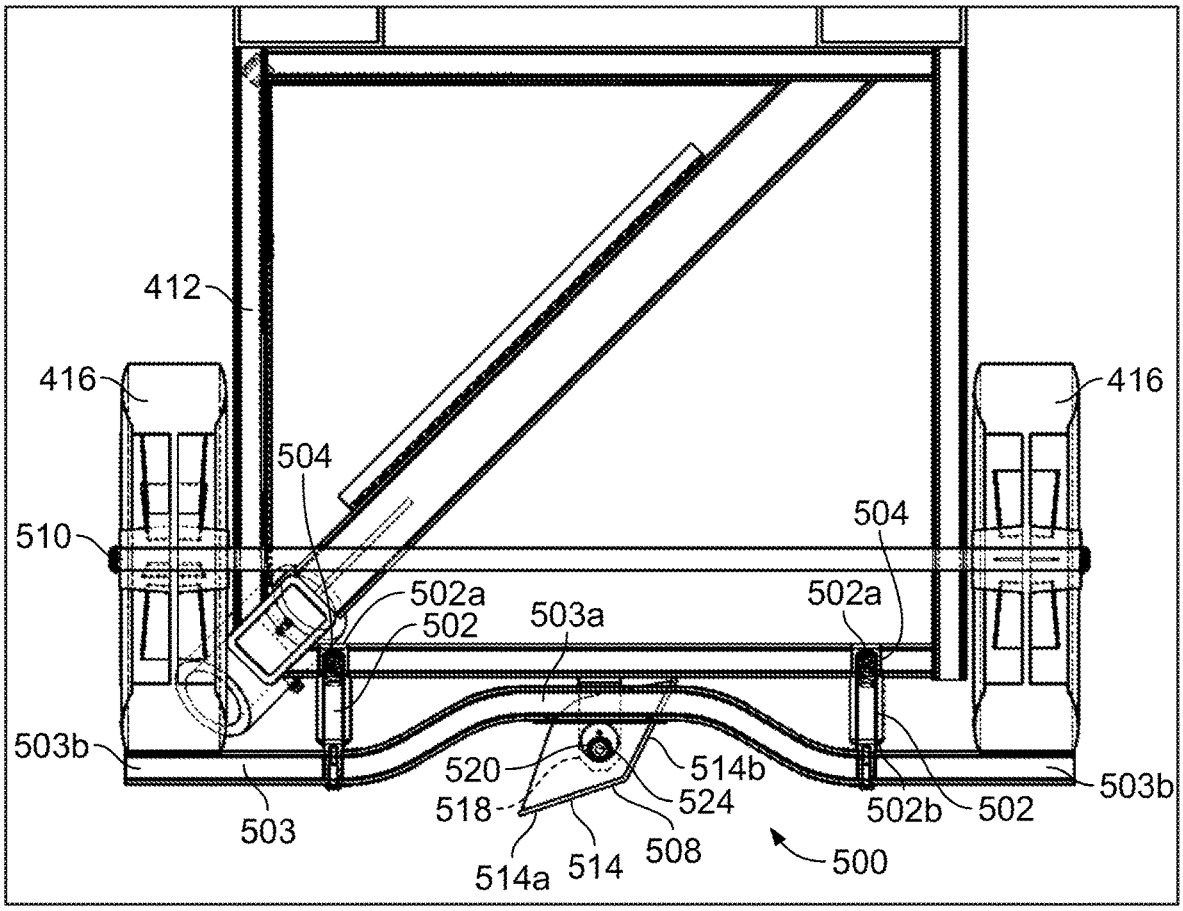
FIG. 30 is an elevated view of the braking mechanism illustrated in FIG. 29 with the braking mechanism in a locked position.
Figure 31:
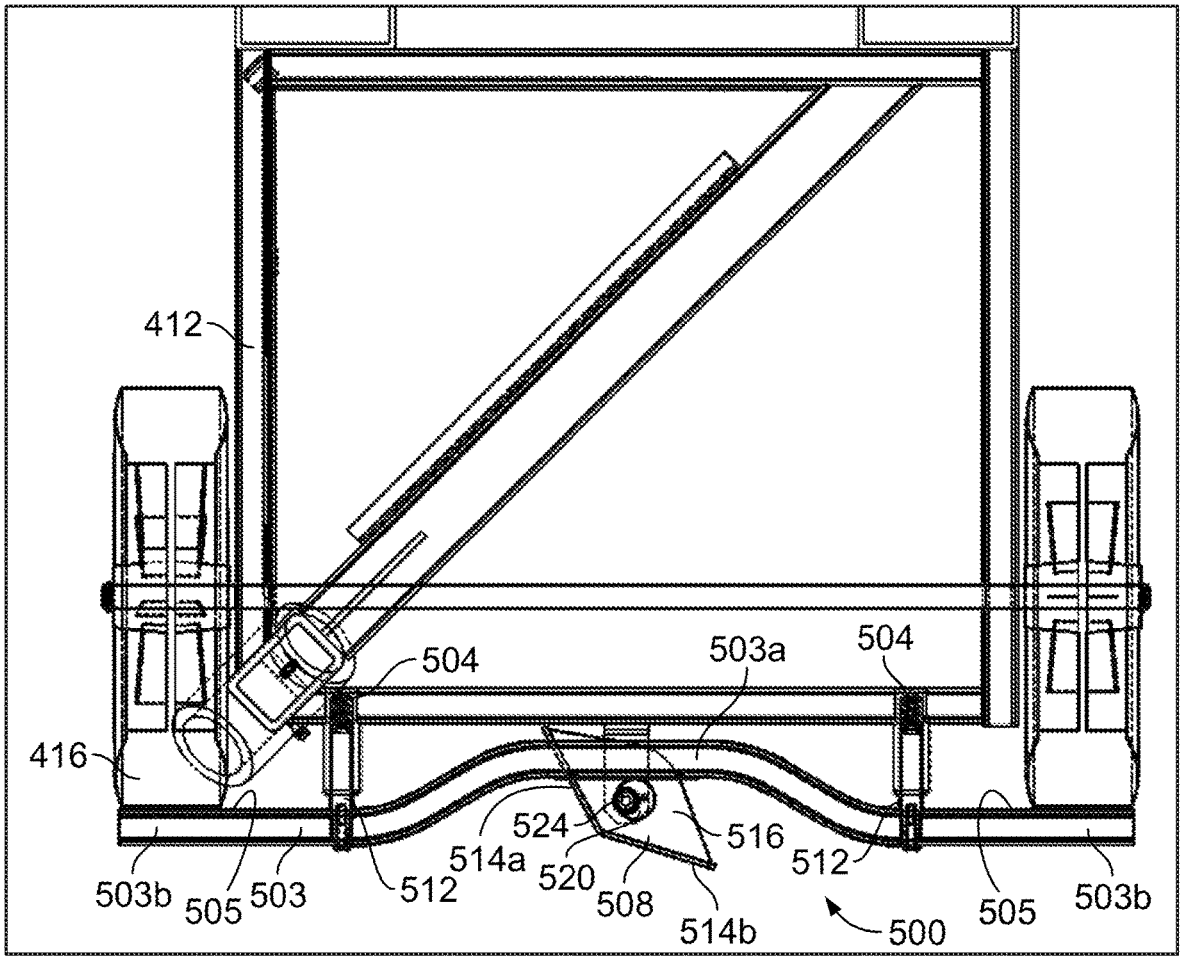
FIG. 31 is an elevated view of the braking mechanism illustrated in FIG. 29 with the braking mechanism in an unlocked or released position.

As best illustrated in FIGS. 29-31, the conduit bender 400 is mounted to a base 412 including a pair of smaller swiveling lead wheels 414 and a pair of larger rear wheels 416 mounted on a common axle 417. The wheels 414, 416 allow for easy mobility of the conduit bender 400 to desired locations for the bending operation. A brake assembly 500 is provided to prevent inadvertent rolling of the conduit bender 400 and the base 412.

The brake assembly 500 includes first and second receptacles 502, a brake bar 503, a bracket 506 and an actuation lever 508.

As best shown in FIGS. 29-31, the first and second receptacles 502 extend rearwardly from the base 412. The receptacles 502 are generally cylindrically-shaped and include closed forward ends 502*a* and open rearward ends 502*b*. Preferably, a spring 504 is provided in each receptacle 502 proximate the forward end 502*a*.

The brake bar 503 includes a central portion 503*a* and first and second wheel engaging portions 503*b*. The brake bar 503 is positioned in approximately the same horizontal plane as the wheel axle 510. The central portion 503*a* of the brake bar 503 is spaced from the wheel axle 510 and is spaced from the base 412. The wheel engaging portions 503*b* are offset from the central portion 503*a* and are positioned rearwardly of the wheels 416. First and second cylindrically-shaped shafts 512 extend from lead surfaces 505 of the wheel engaging portions 503*b*. The shafts 512 are aligned with the receptacles 502 such that the first shaft 512 is slidably engaged with the first receptacle 502 and second shaft 512 is slidably engaged with the second receptacle 502. The springs 504, the receptacles 502 and the shafts 512 provide a piston-like action to bias the brake bar 503 in a rearward direction leaving clearance between the circumferential surface of the wheels 416 and the lead surface 505 of the wheel engaging portions 503*b* of the brake bar 503. Although, the brake assembly 500 has been described with the receptacles 502 extending from the base 412 and shafts 512 extending from the brake bar 503, it is to be understood a similar piston-like action can be achieved with the shafts 512 extending from the base 412 and the receptacles 502 extending from the brake bar 503.

The actuation lever 508 includes a generally V-shaped push plate 514, a generally diamond shaped support plate 516, and a cylindrically-shaped cam 518. The push plate 514 provides a generally vertically positioned wall having a first pushing surface 514*a* and a second pushing surface 514*b*. The support plate 516 is positioned generally horizontally and extends from a lower end of the push plate 514. An aperture is provided through the support plate 516. The cylindrically-shaped cam 518 extends downwardly from the support plate 516. The cam 518 includes an upper end and a lower end. A passageway 520 is provided through the cam 518 and extends from the upper end to the lower end. The cam 518 is aligned with the support plate 516 such that the aperture through the support plate 516 is aligned with the aperture through the cam 518. The push plate 514, support plate 516 and cam 518 are rigidly connected.

As best illustrated in FIG. 29, the bracket 506 is generally U-shaped and includes a base portion 506*a*, an upper arm 506*b* and a lower arm 506*c*. The base portion 506*a* is secured to the base 412 such that the upper and lower arms 506*b*, 506*c* extend rearwardly. Bolt apertures are provided at the free ends of the upper and lower arms 506*b*, 506*c*. The central portion 503*a* of the brake bar 503 is positioned between the upper and lower arms 506*b*, 506*c* and proximate the base portion 506*a* of the bracket 506. The actuation lever 508 is positioned between the upper and lower arms 506*b*, 506*c* of the bracket 506 such that the support plate 516 is positioned under the upper free arm 506*b* and the lower end of the cam 518 rests on the lower arm 506*c* of the bracket 506. A bolt 524 extends through the bolt aperture of the upper arm 506*b*, through the aperture of the support plate 516, through the cam passageway 520, and through the bolt aperture of the lower arm 506*c* of the bracket 506. The bolt 524 provides an axis about which the actuation lever 508 rotates. A hex nut 522 is attached to a lower end of the bolt 524 to secure the actuation lever 508 to the base 412 while allowing the actuation lever 508 to rotate about the bolt 524. As best shown in FIG. 30, the bolt 524 is not centrally positioned within the support plate passage and the cam passageway 520 but rather is offset to provide an eccentric cam.

A released state of the brake assembly 500 is illustrated in FIG. 31. In this released state, the brake bar 503 is pushed rearward due to the action of the springs 504, thereby providing clearance between the wheel engaging portions 503*b* of the brake bar 503 and the circumferential surface of the wheels 416.

To actuate the brake assembly 500, the user places a foot on the second pushing surface 514*b* of the push plate 514 and rotates the actuation lever 508 about the bolt 524 to the position shown in FIG. 30. As the user rotates the actuation lever 508, the outer surface of the cylindrically shaped cam 518 pushes on the brake bar 503 to move the brake bar 503 forward. As the brake bar 503 is moved forward, the shafts 512 slide within the receptacles 502 to compress the springs 504 and the cam 518 rotates about the bolt 524. Upon rotating the push plate 514 beyond a central location as shown in FIG. 31, the cam 518 will be engaged with the brake bar 503 and the brake bar 503 will be engaged with the wheels 416, such that the wheels 416 will be prevented from rotating. The brake bar 503 will be held in this locked position until the brake assembly 500 is released. Optionally, a wear pad 526 may be provided between the cam 518 and the brake bar 503 to prevent excessive wear on the cam 518.

To release the brake assembly 500, the operator places a foot on the first pushing surface 514*a* and rotates the actuation lever 508 about the bolt 524 to the position shown in FIG. 31. As the actuation lever 508 is rotated the springs 504 will be allowed to expand, pushing the brake bar 503 rearward. As the brake bar 503 is pushed rearward, the wheel engaging portions 503*b* of the brake bar 503 are no longer engaged with the circumferential surface of the wheels 416, allowing the wheels 416 to once again rotate.

The brake assembly 500 can therefore be actuated on both wheels 416 upon a single actuation by the operator. Furthermore, the brake assembly 500 does not extend beyond inner and outer sides of the base 412 and therefore additional clearance is not required for the brake assembly 500.

As shown in FIG. 23, the conduit bender 400 includes a plurality of lever assemblies 498*a*, 498*b*, 498*c*. The lever assemblies 598*a*, 598*b*, 598*c* are mounted in a manner identical to the lever assemblies 98*a*, 98*b*, 98*c* and perform the same function as the lever assemblies 98*a*, 98*b*, 98*c*.

Figure 32:
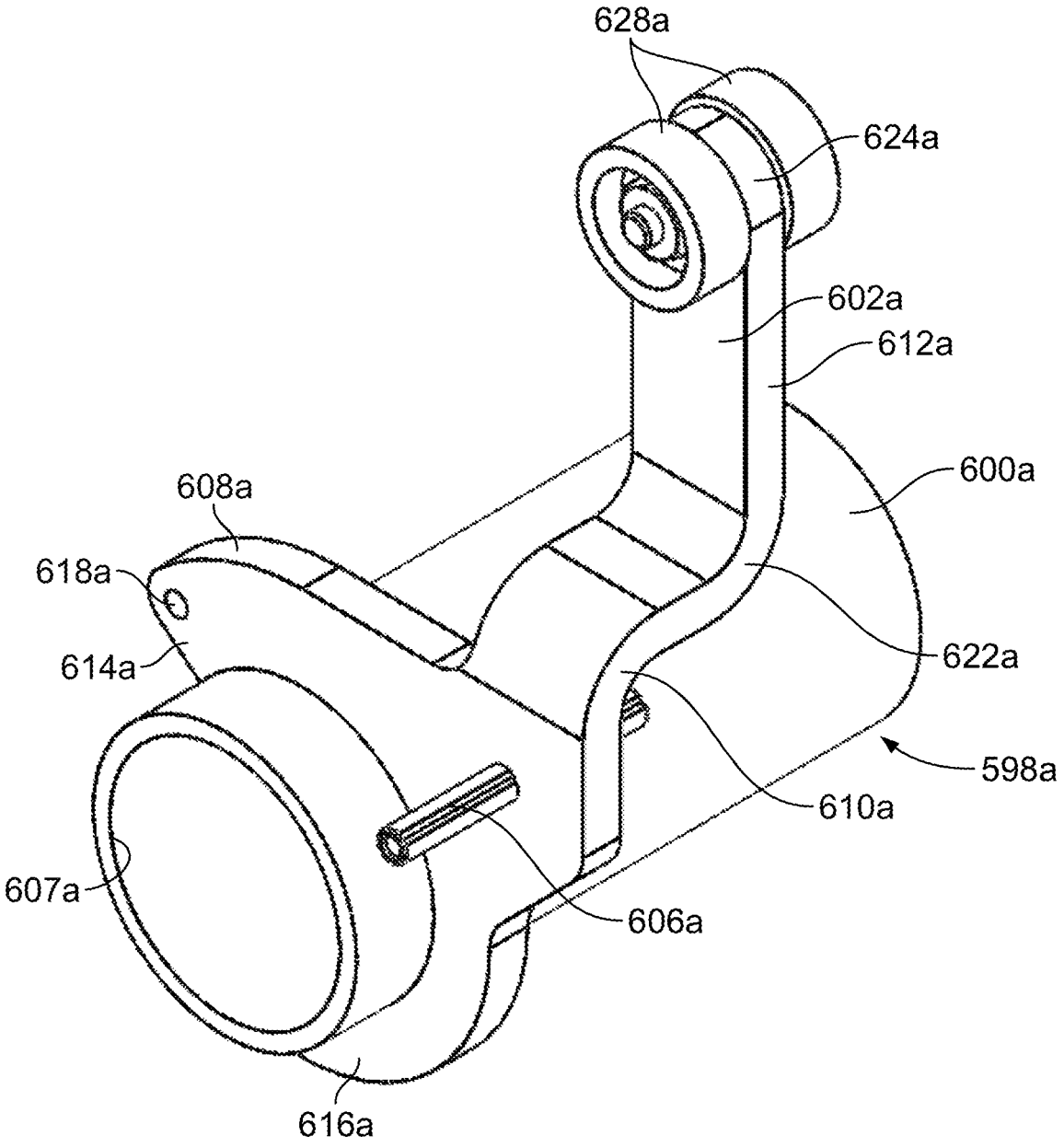
FIG. 32 is a perspective view of a portion of a lever assembly of the bender illustrated in FIG. 23.

The first lever assembly 598*a* includes a lever tube 600*a* and a lever 602*a* fixed thereto as best shown in FIG. 32, and a stop bar 606*a*. The lever tube 600*a* is cylindrically-shaped and defines an upper shaft passageway 607*a*. The lever 602*a* includes a lower gripping portion 608*a*, an intermediate elbow portion 610*a*, and an upper arm portion 612*a*. The lower gripping portion 608*a* includes first extension 614*a* and second extension 616*a* which extends around a portion of the outer surface of the lever tube 600*a*. The second extension 616*a* terminates in an end surface. An aperture 618*a* is provided proximate a leading end of the first extension 614*a* and a stop bar aperture is provided proximate the rear end of the first extension 614*a*. The elbow portion 610*a* extends between the lower gripping portion 608*a* and the upper arm portion 612*a* and is generally S-shaped. The upper arm portion 612*a* of the lever assembly 498*a* extends upwardly from the elbow portion 610*a* and includes a lower end 622*a* and an upper end 624*a*. A pair of rollers 628*a* is provided at the upper end 624*a* of the upper arm portion 612*a*. A first lever spring 604*a* has an end attached to the first extension 614*a* through the aperture 618*a*, is wrapped around the lever tube 600*a*, and an opposite end attached to the lead mounting bar. The first lever spring 604*a* provides a rotational force to the lever tube 600*a* and lever 602*a* to urge the lever 602*a* to an upright position. The first lever tube 600*a* is positioned on an upper support shaft of the frame 402 and, as noted above, operates similar to the first lever 102*a* of the conduit bender 20 of the first embodiment of the invention.

Figure 33:
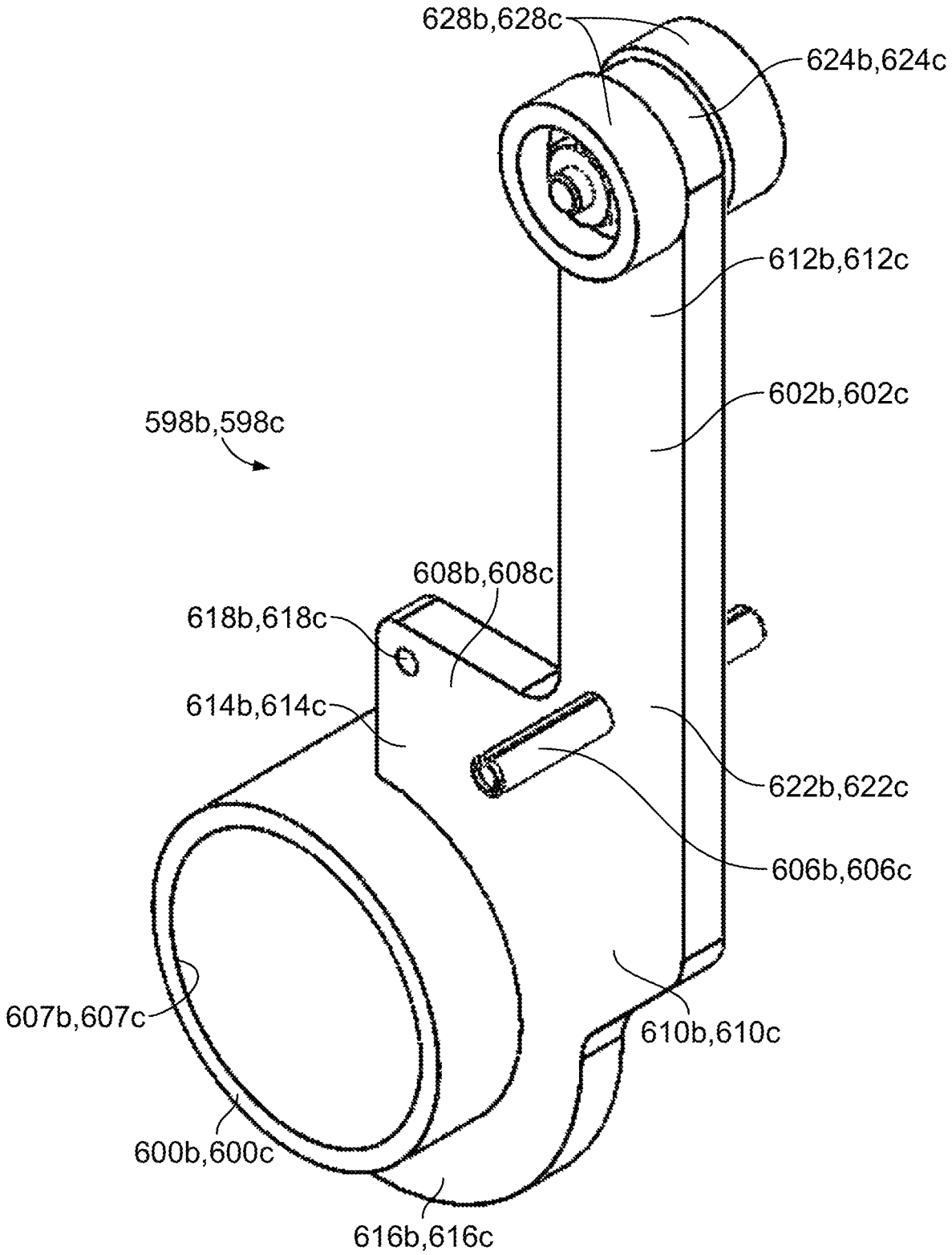
FIG. 33 is a perspective view of a portion of a lever assembly of the bender illustrated in FIG. 23.
Figure 34:
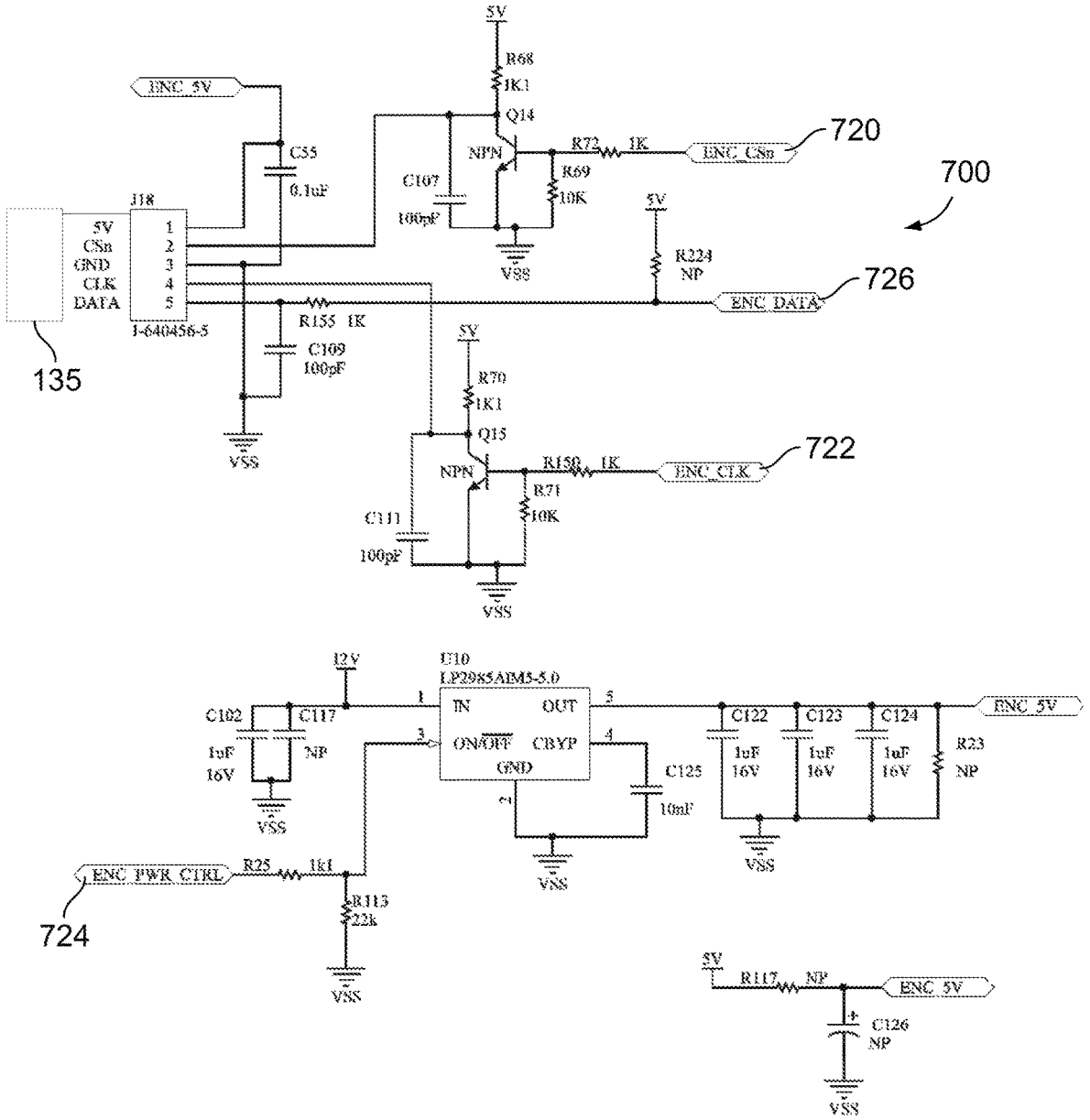
FIG. 34 illustrates an ABS interface portion of the circuit of the present invention.

As best shown in FIG. 33, the second lever assembly 598*b* includes a lever tube 600*b* (which is shorter than the lever tube 600*a*) and a lever 602*b* fixed to the lever tube 600*b*. The second lever assembly 598*b* also includes a lever spring (not shown) and a stop bar 606*b*. The lever tube 600*b* is cylindrically-shaped and defines an upper shaft passageway 607*b*. The lever 602*b* includes a lower gripping portion 608*b*, an intermediate elbow portion 610*b*, and an upper arm portion 612*b*. The lower gripping portion 608*b* includes first extension 614*b* and second extension 616*b* which extends around a portion of the outer surface of the lever tube 600*b*. The second extension 616*b* terminates at an end surface (not shown). A spring aperture 618*b* is provided proximate a leading end of the first extension 614*b*. The elbow portion 610*b* extends upwardly from the lower portion 608*b* to the upper arm portion 612*b* and is generally planar. A stop bar aperture (not shown) is provided proximate the lower end of the elbow portion 610*b*. The upper arm portion 612*b* of the lever assembly 598*b* extends upwardly from the elbow portion 610*b* and includes a lower end 622*b* and an upper end 624*b*. A pair of rollers 628*b* is provided at the upper end 624*b* of the upper arm portion 612*b*. The second lever tube 600*b* is positioned on the upper support shaft of the frame 402 and as noted above second lever assembly 598*b* operates in a manner similar to the second lever assembly 98*b* of the first embodiment.

The third lever assembly 598*c* includes a lever tube 600*c* and a lever 602*c* attached thereto. The structure of the third lever 602*c* is identical to the structure of the second lever 602*b* and therefore, the specifics are not repeated herein. Elements of the lever tube 600*c* and lever 602*c* are designated in FIG. 33 with the suffix "c". The third lever tube 600*c* is positioned on the upper support shaft of the frame 402 and as noted above the third lever assembly 598*c* operates in a manner similar to the third lever assembly 98*c* of the first embodiment.

As the conduit is aligned with the appropriately sized conduit passageway of the conduit bender 400, the sidewall of the conduit will engage the appropriate pair of rollers 628*a*, 628*b* or 628*c* of the levers 602*a*, 602*b* or 602*c*. If, for example, contact is provided between the conduit and pair of rollers 628*a*, this contact will cause the lever 602*a* to rotate about the upper support shaft. Rotation of the lever 602*a*, 602*b*, 602*c* will result in a signal being provided to the microprocessor 61 in the same manner as described in connection with the bender of the first embodiment.

As with the first embodiment of the invention, the frame base 418 of the conduit bender 400 is provided by a unitary member and therefore provides a fixed position of the shoe 404 relative to the roller positioning assembly 410 to provide more precise control over the bending operation.

While preferred embodiments of the present invention are shown and described, it is envisioned that those skilled in the art may devise various modifications of the present invention without departing from the spirit and scope of the appended claims.

What is claimed is:

1. A method of bending a conduit comprising:

providing a bender including a frame, a shoe rotatably mounted to the frame about which the conduit is to be bent, a motor for rotating the shoe, a microprocessor for providing a motor control signal to the motor, and an auto sensing circuit in communication with the microprocessor; and wherein responsive to engagement of the conduit with the bender, the auto sensing circuit provides a signal to the microprocessor, and the motor control signal is based upon the signal from the auto sensing circuit, and wherein the motor control signal ramps down prior to the shoe reaching a stop position to stop rotation of the shoe without use of a mechanical brake.

2. The method of claim 1, wherein the auto sensing circuit includes a conduit size switch and a member movably mounted proximate the conduit size switch, and further comprising moving the member and activating the conduit size switch.

3. The method of claim 1, wherein the bender includes a roller assembly, and wherein the auto sensing circuit includes a roller assembly position switch, and wherein when the roller assembly is positioned in a predetermined position, the roller assembly position switch is activated.

4. The method of claim 1, wherein the auto sensing circuit includes a shoe position sensor and upon initialization of the bender, data is provided by the shoe position sensor to the microprocessor regarding an initial position of the shoe.

5. The method of claim 1, wherein the bender further comprises feedback circuit, and further including:

configuring the microprocessor to provide a motor control signal to the motor; and wherein the feedback circuit is configured to provide a feedback signal to the microprocessor, and the motor control signal provided to the motor is based upon the feedback signal.

6. The method of claim 5, wherein the feedback signal provides a measure of current consumed by the motor.

7. The method of claim 5, wherein the feedback signal provides a measure of voltage consumed by the motor.

8. A method of bending a conduit comprising:

providing a bender including a frame, a shoe rotatably mounted to the frame about which the conduit is to be bent, a motor for rotating the shoe, a microprocessor for providing a motor control signal to the motor, and an auto sensing circuit in communication with the microprocessor;

the microprocessor calculating a shoe rotation stop point and configured to ramp the motor control signal downward, prior to rotation of the shoe reaching the stop point, to stop the rotation of the shoe without the use of a mechanical brake; and;

wherein responsive to engagement of the conduit with the bender, the auto sensing circuit provides a signal to the microprocessor, and the motor control signal is based upon the signal from the auto sensing circuit.

* * * * *